US010465422B2

(12) United States Patent
Ullrich et al.

(10) Patent No.: US 10,465,422 B2
(45) Date of Patent: Nov. 5, 2019

(54) ELECTRONIC LOCK MECHANISM

(71) Applicant: 2603701 ONTARIO INC., Toronto (CA)

(72) Inventors: Theodore Ullrich, Brooklyn, NY (US); John McLeod, Toronto (CA); Tonino Sabelli, Oakville (CA); Dean DiPietro, Toronto (CA); Pepin Gelardi, Brooklyn, NY (US)

(73) Assignee: 2603701 ONTARIO INC., Toronto ON (CA)

( * ) Notice: Subject to any disclaimer, the term of this patent is extended or adjusted under 35 U.S.C. 154(b) by 0 days.

(21) Appl. No.: 15/497,660

(22) Filed: Apr. 26, 2017

(65) Prior Publication Data

US 2018/0073275 A1 Mar. 15, 2018

Related U.S. Application Data

(63) Continuation-in-part of application No. 13/468,219, filed on May 10, 2012, now Pat. No. 9,663,972.

(51) Int. Cl.
*E05B 47/06* (2006.01)
*E05B 47/00* (2006.01)
(Continued)

(52) U.S. Cl.
CPC ..... *E05B 47/0615* (2013.01); *E05B 1/0007* (2013.01); *E05B 17/0066* (2013.01);
(Continued)

(58) Field of Classification Search
CPC ..... E05B 47/0615; E05B 17/0066; E05B 47/0012; E05B 47/0603; E05B 47/0673;
(Continued)

(56) References Cited

U.S. PATENT DOCUMENTS 3,901,542 A 8/1975 Salzman et al.
4,213,118 A 7/1980 Genest et al.
(Continued)

FOREIGN PATENT DOCUMENTS

CA 2388230 11/2003
EP 2450509 A2 5/2012
(Continued)

OTHER PUBLICATIONS

MicroIQ Lock, MicroIQ, http://microiqlock.com/, last visited Nov. 17, 2016.
(Continued)

*Primary Examiner* — James J Yang
*Assistant Examiner* — Kevin Lau
(74) *Attorney, Agent, or Firm* — Squire Patton Boggs (US) LLP

(57) ABSTRACT

An interchangeable electronic lock mechanism provides selective access to a motor controlled latching system including a motorized pin to lock and unlock a knob assembly. The lock mechanism may be used to replace key operated locking cores, on the exterior of a storage unit, with a plug and optional adapter inserted into a remaining shell housing, and a driver to control access to a storage unit. Manual rotation of the knob activates the drive assembly to control access to the storage unit. An optional break away security feature in the knob inhibits unauthorized unlatching of the lock. When the lock is unlatched, the knob rotates the drive assembly including the plug and adapter within the shell housing, and in turn, activates the driver to operate the lock assembly in the storage unit. An optional modular chassis assembly includes a removable array of components for testing, maintenance and repair.

37 Claims, 50 Drawing Sheets

(51) Int. Cl.

| | |
|---|---|
| ***E05B 65/46*** | (2017.01) |
| ***E05B 1/00*** | (2006.01) |
| ***G07C 9/00*** | (2006.01) |
| ***E05B 17/00*** | (2006.01) |
| ***E05B 65/462*** | (2017.01) |
| ***E05B 17/22*** | (2006.01) |
| ***E05B 63/00*** | (2006.01) |

(52) U.S. Cl.
CPC ..... *E05B 47/0012* (2013.01); *E05B 47/0603* (2013.01); *E05B 47/0673* (2013.01); *E05B 65/46* (2013.01); *E05B 65/462* (2013.01); *G07C 9/00182* (2013.01); *E05B 17/22* (2013.01); *E05B 63/0056* (2013.01); *E05B 2047/002* (2013.01); *E05B 2047/0023* (2013.01); *E05B 2047/0024* (2013.01); *E05B 2047/0086* (2013.01); *G07C 9/0069* (2013.01); *G07C 2009/00222* (2013.01); *Y10T 70/7068* (2015.04)

(58) Field of Classification Search
CPC ..... E05B 65/46; E05B 2047/002; E05B 2047/0024; E05B 2047/0086; E05B 1/0007; E05B 47/002; G07C 9/00182; G07C 2009/00222
See application file for complete search history.

(56) References Cited

U.S. PATENT DOCUMENTS

| | | | |
|---|---|---|---|
| 4,712,398 | A | 12/1987 | Clarkson et al. |
| 4,745,784 | A | 5/1988 | Gartner |
| 4,760,380 | A | 7/1988 | Quenneville et al. |
| 4,789,859 | A | 12/1988 | Clarkson et al. |
| 4,887,445 | A | 12/1989 | Beatty |
| 4,901,545 | A | 2/1990 | Bacon et al. |
| 4,931,789 | A | 6/1990 | Pinnow |
| 4,967,305 | A | 10/1990 | Murrer et al. |
| 5,020,345 | A | 6/1991 | Gartner et al. |
| 5,021,776 | A | 6/1991 | Anderson et al. |
| 5,033,282 | A | 7/1991 | Gartner et al. |
| 5,058,258 | A | 10/1991 | Harvey |
| 5,136,870 | A | 8/1992 | Gartner et al. |
| 5,153,561 | A | 10/1992 | Johnson |
| 5,223,829 | A | 6/1993 | Hideto Watanabe |
| 5,265,452 | A | 11/1993 | Dawson et al. |
| 5,321,963 | A | 6/1994 | Goldman |
| 5,367,295 | A | 11/1994 | Gokcebay et al. |
| 5,437,174 | A | 8/1995 | Aydin et al. |
| 5,475,375 | A | 12/1995 | Barrett et al. |
| 5,479,151 | A | 12/1995 | Lavelle et al. |
| 5,507,162 | A | 4/1996 | Chhatwal |
| 5,552,777 | A | 9/1996 | Gokcebay et al. |
| 5,636,880 | A | 6/1997 | Miller |
| 5,685,182 | A | 11/1997 | Chhatwal |
| 5,749,253 | A | 5/1998 | Glick et al. |
| 5,816,084 | A | 10/1998 | Clark |
| 5,823,027 | A | 10/1998 | Glick et al. |
| 5,848,541 | A | 12/1998 | Glick et al. |
| 5,857,365 | A | 1/1999 | Armstrong |
| 5,886,644 | A | 3/1999 | Keskin et al. |
| 5,887,467 | A | 3/1999 | Butterweck et al. |
| 5,894,277 | A | 4/1999 | Keskin et al. |
| 6,000,609 | A | 12/1999 | Gokcebay |
| 6,016,677 | A | 1/2000 | Clark |
| 6,032,500 | A | 3/2000 | Collard et al. |
| 6,092,404 | A | 7/2000 | Chhatwal |
| 6,098,433 | A | 8/2000 | Maniaci |
| 6,116,067 | A | 9/2000 | Myers et al. |
| D438,447 | S | 3/2001 | Gartner |
| 6,209,367 | B1 | 4/2001 | Hyatt, Jr. et al. |
| 6,244,084 | B1 | 6/2001 | Warmack |
| 6,297,725 | B1 | 10/2001 | Tischendorf et al. |
| 6,318,137 | B1 | 11/2001 | Chaum |
| D452,807 | S | 1/2002 | Gartner |
| 6,374,653 | B1 | 4/2002 | Gokcebay et al. |
| 6,384,711 | B1 | 5/2002 | Cregger et al. |
| 6,434,987 | B1 | 8/2002 | Juillerat et al. |
| 6,487,884 | B1 | 12/2002 | Constantinou |
| 6,508,088 | B1 * | 1/2003 | Barbier ..... B60R 25/02118 70/186 |
| 6,552,650 | B1 | 4/2003 | Gokcebay et al. |
| 6,564,601 | B2 | 5/2003 | Hyatt, Jr. |
| 6,588,243 | B1 | 7/2003 | Hyatt, Jr. et al. |
| D484,390 | S | 12/2003 | Abernethy et al. |
| 6,655,180 | B2 | 12/2003 | Gokcebay et al. |
| 6,722,167 | B1 | 4/2004 | Hsu |
| 6,730,867 | B2 | 5/2004 | Hyp |
| 6,739,164 | B2 | 5/2004 | Warmack |
| 6,745,603 | B1 | 6/2004 | Shaw |
| 6,760,964 | B1 | 7/2004 | Gartner |
| 6,826,935 | B2 | 12/2004 | Gokcebay et al. |
| D501,388 | S | 2/2005 | Carpintero |
| 6,865,916 | B2 | 3/2005 | Goldman |
| 6,876,293 | B2 | 4/2005 | Frolov et al. |
| 6,891,458 | B2 | 5/2005 | Hyatt, Jr. et al. |
| 6,895,791 | B2 | 5/2005 | Alexander et al. |
| 6,926,318 | B2 | 8/2005 | Oxley |
| 6,927,670 | B1 | 8/2005 | Gokcebay et al. |
| 6,967,562 | B2 | 11/2005 | Menard et al. |
| D512,297 | S | 12/2005 | Metivier et al. |
| 7,010,947 | B2 | 3/2006 | Miko |
| D520,848 | S | 5/2006 | Metivier et al. |
| 7,144,053 | B2 | 12/2006 | Bashford |
| 7,209,029 | B2 | 4/2007 | Coelho et al. |
| 7,221,272 | B2 | 5/2007 | Hosselet |
| 7,296,448 | B1 | 11/2007 | Shaw |
| 7,316,139 | B2 | 1/2008 | Nakazima et al. |
| 7,334,443 | B2 | 2/2008 | Meekma et al. |
| 7,336,150 | B2 | 2/2008 | Gokcebay et al. |
| 7,397,343 | B1 | 7/2008 | Gokcebay et al. |
| D580,837 | S | 11/2008 | Kluck |
| 7,469,564 | B1 | 12/2008 | Shaw |
| 7,472,934 | B2 | 1/2009 | Burke et al. |
| 7,516,633 | B1 | 4/2009 | Chang |
| D593,398 | S | 6/2009 | Pelletier et al. |
| 7,637,131 | B2 | 12/2009 | Amir |
| 7,647,797 | B1 | 1/2010 | Cabrera et al. |
| 7,747,286 | B2 | 6/2010 | Conforti |
| 7,768,378 | B2 | 8/2010 | Hill et al. |
| 7,770,423 | B2 | 8/2010 | Wu |
| 7,845,202 | B2 | 12/2010 | Padilla et al. |
| 7,870,770 | B2 | 1/2011 | Blanch |
| 7,891,222 | B2 | 2/2011 | Ratkus et al. |
| 8,035,478 | B2 | 10/2011 | Lee |
| 8,122,746 | B2 | 2/2012 | Hyatt, Jr. |
| 8,141,399 | B2 | 3/2012 | Hyatt, Jr. |
| 8,141,400 | B2 | 3/2012 | Sorensen et al. |
| 8,161,781 | B2 | 4/2012 | Gokcebay |
| 8,176,761 | B2 | 5/2012 | Sorensen et al. |
| 8,228,030 | B2 | 7/2012 | Pukari et al. |
| 8,276,414 | B2 | 10/2012 | Luo |
| 8,468,861 | B2 | 6/2013 | Pukari et al. |
| 8,490,443 | B2 | 7/2013 | Gokcebay |
| 8,495,898 | B2 | 7/2013 | Gokcebay |
| 8,495,899 | B2 | 7/2013 | Gartner |
| 8,528,373 | B2 | 9/2013 | Hyatt, Jr. et al. |
| 8,683,832 | B2 | 4/2014 | Watanabe et al. |
| 8,742,889 | B2 | 6/2014 | Kaczmarz et al. |
| 8,866,439 | B2 | 10/2014 | Pukari et al. |
| 8,869,574 | B2 | 10/2014 | Schmidt-Lackner et al. |
| 8,902,040 | B2 | 12/2014 | Greisen et al. |
| 8,970,344 | B2 | 3/2015 | Payson et al. |
| 9,208,628 | B2 | 12/2015 | Gokcebay |
| 9,222,284 | B2 | 12/2015 | Gokcebay |
| 2001/0005998 | A1 | 7/2001 | Imedio Ocana |
| 2001/0045112 | A1 | 11/2001 | Berton et al. |
| 2002/0056300 | A1 | 5/2002 | Pierre et al. |
| 2002/0125992 | A1 | 9/2002 | Harwood |
| 2004/0003633 | A1 | 1/2004 | Alexander et al. |
| 2004/0177660 | A1 | 9/2004 | Tsai |
| 2005/0128050 | A1 | 6/2005 | Frolov et al. |

(56) References Cited

U.S. PATENT DOCUMENTS

| | | | | |
|---|---|---|---|---|
| 2005/0179517 | A1 | 8/2005 | Harms et al. | |
| 2005/0199026 | A1 | 9/2005 | Geringer et al. | |
| 2005/0253715 | A1 | 11/2005 | Awobue | |
| 2006/0226948 | A1 | 10/2006 | Wright et al. | |
| 2006/0238294 | A1 | 10/2006 | Gokcebay et al. | |
| 2006/0283216 | A1 | 12/2006 | Marcelle et al. | |
| 2007/0169525 | A1 | 7/2007 | Chang | |
| 2007/0209413 | A1 | 9/2007 | Dobbs | |
| 2007/0257773 | A1 | 11/2007 | Hill et al. | |
| 2008/0084836 | A1 | 4/2008 | Baird et al. | |
| 2008/0223093 | A1 | 9/2008 | Amir | |
| 2008/0252083 | A1 | 10/2008 | Carabalona | |
| 2008/0296912 | A1 | 12/2008 | Whitner et al. | |
| 2009/0058102 | A1 | 3/2009 | Garneau et al. | |
| 2009/0085717 | A1 | 4/2009 | Kirkjan | |
| 2010/0073129 | A1 | 3/2010 | Pukari | |
| 2010/0079240 | A1 | 4/2010 | Higham | |
| 2010/0300163 | A1 | 12/2010 | Loughlin et al. | |
| 2010/0307206 | A1 | 12/2010 | Taylor et al. | |
| 2010/0320971 | A1 | 12/2010 | Zhu et al. | |
| 2011/0012709 | A1 | 1/2011 | Payson et al. | |
| 2011/0056253 | A1 | 3/2011 | Greiner et al. | |
| 2011/0181060 | A1 | 7/2011 | Geringer et al. | |
| 2013/0043973 | A1 | 2/2013 | Greisen et al. | |
| 2013/0298618 | A1 | 11/2013 | Gotter | |
| 2014/0047878 | A1 | 2/2014 | Zheng et al. | |
| 2015/0211258 | A1* | 7/2015 | Gokcebay | E05B 47/06 70/278.1 |
| 2015/0376916 | A1* | 12/2015 | Roatis | E05B 37/00 70/277 |

FOREIGN PATENT DOCUMENTS

| | | | |
|---|---|---|---|
| WO | 0186097 | A2 | 11/2001 |
| WO | 2005/017293 | A1 | 2/2005 |
| WO | 2006/114330 | A2 | 11/2006 |
| WO | 2006114330 | A2 | 11/2006 |
| WO | 2007000576 | A1 | 1/2007 |
| WO | 2010/124851 | A1 | 11/2010 |
| WO | 2011160628 | A1 | 12/2011 |

OTHER PUBLICATIONS

Codelocks CL2255-BS Electronic Tubular Mortise-Style Keypad Door Lock, Smarthome, http://www.smarthome.com/codelocks-cl2255-bs-electronic-tubular-mortise-style-keypad-door-lock-brushed-steel.html, last visited Nov. 17, 2016.

Lockey M210, GoKeyless, http://www.gokeyless.com/product/43/lockey-m210-keyless-deadbolt, last visited Oct. 11, 2016.

Codelocks KL 1200 Heavy Duty Push Button Electronic Cabinet Lock, American Builder Outlet, http://www.americanbuildersoutlet.com/codelocks-cl1200-heavy-duty-push-button-electronic-cabinet-lock.html, last visited Oct. 11, 2016.

Entry Check TM 923 Narrow Series Digital Keypads, Security Door Controls, http://www.sdcsecurity.com/newproducts.htm, last visited Oct. 11, 2016.

Schlage Sense Smart Deadbolt with Century Trim in Satin Nickel (BE479 CEN 619), Amazon, http://www.amazon.com/dp/B00YUPDUYE?psc=1, last visited Oct. 18, 2016.

Two-Point Electronic Lock Retrofit Kit, System 1000, Chatsworth Products, https://catalog.chatsworth.com/environmental-monitoring-security/electronic-locks/two-point-electronic-lock-retrofit-kit-system-1000, last visited Oct. 11, 2016.

KL 1000 Kitlock Locker Lock, Codelocks, http://www.codelocks.us/kitlock/kl1000-kitlock-locker-lock.html, last visited Oct. 19, 2016.

Browning S&G Retrofit Electronic Lock Kit #156022, Amazon Sports & Outdoors, http://www.amazon.com/Browning-Retrofit-Electronic-Lock-156022/dp/B000PW45C2, last visited Oct. 11, 2016.

Electronic Door Access, Locking Systems, http://www.lockingsystems.com/electronicdooraccess.htm, last visited Oct. 18, 2016.

Push Button Mechanical Lock, Ningbo Yosec Industrial, http://safes-china.en.hisuppliercom/product-1133779-pushbutton-mechanical-lock.html, last visited Nov. 17, 2016.

Theodore Ullrich et al., U.S. Appl. No. 13/468,240, filed May 10, 2012.

Notice of Allowance, U.S. Appl. No. 13/468,240, dated Sep. 9, 2013.

* cited by examiner

60

Preferred Circuit Board Components

Steps to Open the Lock

Steps to Open the Lock

Figure 18
KEYPAD LAYERS
FRONT VIEW OF LOCK PRODUCT
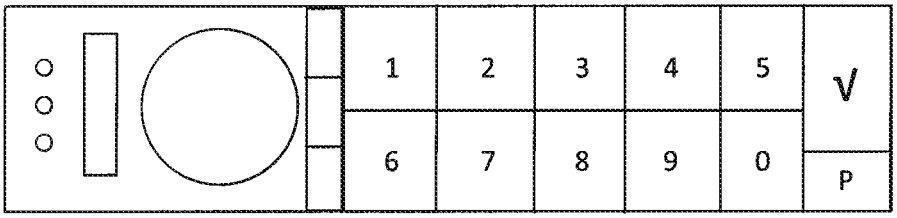
TOP LAYER
Graphics, silicone rubber, translucent LED colors
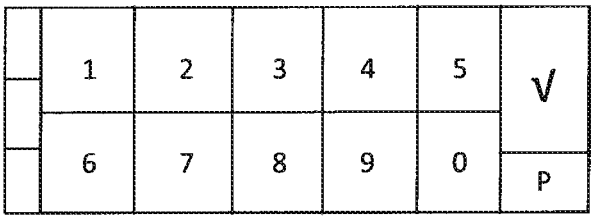
LAYER 2
Membrane Domes and LED Lights
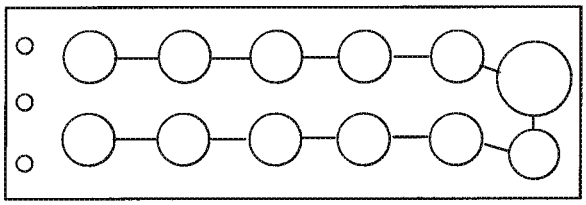

Figure 18-1
KEYPAD LAYERS
LAYER 3 TOP VIEW
Button Circuit and Antenna Lead #1
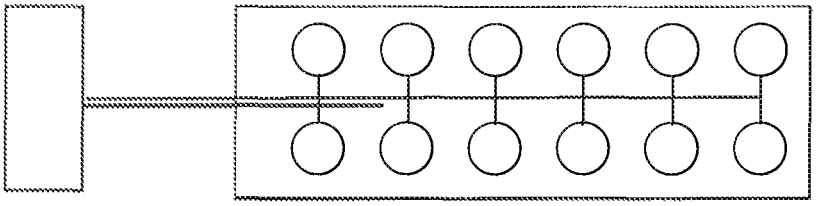
LAYER 3 BOTTOM VIEW
RFID Coli Antenna with Antenna lead #2. Antenna leads pass through layer 3 membrane
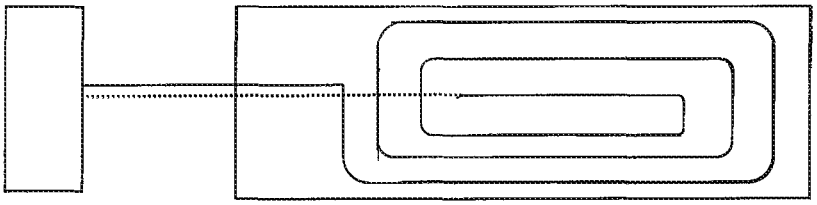
LAYER 4
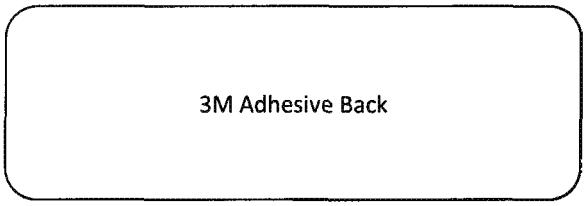

REAL-TIME CLOCK

MOTOR DRIVER

1.) STAT connected to ADC0 on PORT F of AT90USB

The MCP73831T includes a pass transistor, integrated current sensing and reverse-discharge protection.

RFID/NFC Antenna and Circuit Schematic

Continues on Figure 20-1

NOTE: Values shown on Figures 20-2 and 20-3.

RFID/NFC Antenna and Circuit Schematic

NOTE: Values shown on Figures 20-2 and 20-3.

Figure 20-2

RFID/NFC Antenna and Circuit Schematic

Resistor Values

| | |
|---|---|
| R1 | 1.0K |
| R2 | 1.69K |
| R3 | 1.5 |
| R4 | 1.5 |

Capacitor Values

| | |
|---|---|
| C1 | 22pF |
| C2 | 22pF |
| C3 | 220pF |
| C4 | 220pF |
| C5 | NC |
| C6 | NC |
| C7 | 100pF |
| C8 | 100pF |
| C9 | NC |
| C10 | NC |

| | |
|---|---|
| C11 | 0.1μF |
| C12 | 18pF |
| C13 | 18pF |
| C14 | 0.1μF |
| C15 | 1000pF |
| C16 | 0.1μF |
| C17 | 0.1μF |
| C18 | 10μF |
| C19 | 10μF |
| C20 | 0.1μF |

| | |
|---|---|
| C21 | 10μF |
| C22 | 10μF |
| C23 | 0.1μF |
| C24 | 0.1μF |
| C25 | 10μF |

Crystal Value

| | |
|---|---|
| Y1 | 27.12 MHz |

Figure 20-3

RFID/NFC Antenna and Circuit Schematic

RFID Circuit Connections

| | | | | | | | |
|---|---|---|---|---|---|---|---|
| 1 | DGND | 11 | AGND | 21 | NC2 | 31 | P31 |
| 2 | LOADMOD | 12 | AUX1 | 22 | NC3 | 32 | P32 |
| 3 | TGND1 | 13 | AUX2 | 23 | PVDD | 33 | P33 |
| 4 | TX1 | 14 | XTAL1 | 24 | P30/UART_RX | 34 | P34/SIC_CLK |
| 5 | TVDD | 15 | XTAL2 | 25 | IRQ | 35 | SIGOUT |
| 6 | TX2 | 16 | I0 | 26 | RSTOUT_N | 36 | SIGIN |
| 7 | TGND2 | 17 | I1 | 27 | NSS/P50_SCL/HSU_TX | 37 | SVDD |
| 8 | AVDD | 18 | TESTEN | 28 | MOSI/SDA/HSU_TX | 38 | RSTPD_N |
| 9 | VMID | 19 | P35 | 29 | MISO | 39 | DVDD |
| 10 | RX | 20 | NC1 | 30 | SCK | 40 | VBAT |

Figure 23

PREFERRED SOFTWARE

Programming Commands

- Toggle security lockout mode on or off
- Display approximate battery charge level
- Add or remove users to database
- Add or remove master users to database
- Switch lock mode: corporate, public locker or other security profiles
- Change password length from 4 to 10 digits
- Toggle sound on or off
- Add or remove temporary password(s)
- Add or remove valid date(s) and time range(s)
- Add or remove RFID Tag(s)
- Add or remove NFC Tag(s)
- Enable or disable RFID mode
- Enable or disable NFC mode
- Activate USB connect
- Update software revision via USB connect
- Update data values via USB connect
- Activate USB Host Other versions of the software may be provided to incorporate new rules and lock logic.

Figure 24

PREFERRED SOFTWARE

MC Database Files

- User codes with privileges (master or user)
- Keystroke log file including keystrokes with date & time stamp and status (success/fail)
- Lock information including serial number, data values and battery charge level

ELECTRONIC LOCK MECHANISM

CROSS REFERENCE TO RELATED APPLICATION

This is a Continuation-in-Part of co-pending U.S. patent application Ser. No. 13/468,219 filed May 10, 2012, which is hereby incorporated in its entirety by reference.

FIELD OF THE INVENTION

The invention relates to locking mechanisms used in filing and storage cabinets, office furniture, storage compartments, including built in cabinets, and other lockable storage units.

BACKGROUND OF THE INVENTION

Many furniture manufacturers and their customers desire electronic locking mechanisms that use a keypad or other electronic means, such as an RFID Card reader or other security scanner, rather than traditional mechanical locks, to access and secure their office furniture and other kinds of storage units. In many instances, electronic locks are desirable to avoid the costs and inconvenience associated with replacing lost keys, rekeying locks because of staffing changes or security breaches, and the like. Manufacturers and users often prefer programmable electronic locks which can be reprogrammed to deal with staffing changes, and other security concerns, and to, for example, monitor access and usage of the locking devices, and the associated storage units.

Electronic locks in the prior art have been used to provide secure storage and access control in office furniture, storage cabinets and other compartments. These prior art locks have special latching mechanisms and housings which require the furniture manufacturers and others to make tooling changes to their furniture or make other potentially time consuming, difficult, and costly adaptations to accept the special locking mechanisms and housings of these prior art locks as replacements for pre-existing locking systems.

By way of example, FIG. 1 in published US Patent Application 2011 0056253 shows such an electronic lock with a unique housing and latching apparatus. FIGS. 1, 2, 3 and 4 of U.S. Pat. No. 6,655,180 also show an electronic lock with a unique housing and latching system requiring custom installation.

Similarly FIG. 5 of U.S. Pat. No. 5,886,644 shows a unique installation of outer and inner housings for an electronic lock.

Furthermore, neither of these locks can be used with lateral filing cabinets or pedestal drawers because they cannot be easily adapted to existing central locking systems.

Canadian Patent No. 2,388,230 shows an example of a mechanical lock used in a central locking application for a lateral filing cabinet or other storage unit. In FIGS. 1 and 2 of that patent, the mechanical lock is shown with a zigzag shaped lock shaft and a round retainer. The illustrated lock shaft is connected to a locking core which is included in a standard "Double D" lock housing unit. An example of this mechanical lock is shown as being installed in a conventional 2 drawer locking cabinet.

Prior art locking systems come in various shapes, sizes and configurations. Many of these prior art locking systems include multi component drawer slide locking arrays.

Therefore, it is desirable to provide a new electronic locking system that is conveniently interchangeable with existing mechanical locks without requiring costly tooling changes by office furniture manufacturers, and without using difficult or complicated installation procedures by installers, customers or other users.

By way of example, it is preferable that an electronic lock include a replaceable or interchangeable driver selected from a group of preselected drivers of different shapes, sizes, and configurations, the group being compatible for use with a plurality of tenons, cranks, linkage bars and other components in locking systems which are widely used in many standard locking applications within the industry.

In some instances, electronic locks of the prior art include a solenoid device operating with a linear action. Typically, this linear action engages or disengages a latching bolt or engages a shear pin to prevent a knob from turning.

Often, these prior electronic locks use a substantial number of batteries connected in series and require a large housing to store the batteries. Typically, these batteries require frequent replacement. Solenoid motors are not generally recommended for locking applications because their performance may be affected, or security features may be compromised, by strong magnets which may be brought into close proximity to the solenoid motors.

Many electronic locks in the prior art use DC motors to drive their latching mechanisms. US Patent Application 2007/0257773 Brian Hill et al shows an example of such a mechanism. The motor required to rotate the gear train including 7 gears draws a significant current and requires a large battery capacity. Typically this type of electronic lock requires 4 or more "AA" batteries which are installed in a separate housing inside the storage cabinet. The service life of these batteries is such that the batteries must be replaced frequently, thus leading to increased operating costs for users of these electronic locks.

In some prior art electronic locks, piezo-electric motors may be used to drive the latching mechanisms. However, such piezo-electric motors are typically more expensive than other conventional electric motors. In addition, piezo electric motors typically draw substantial electric currents, thus leading to shortened battery life and increased operating costs associated with frequent replacement of batteries.

Further, these prior electronic locks often utilize latches and detents to ensure that the lock can either be in a locked position, or in an unlocked position, to avoid a continuous application of electrical power from a substantial battery power supply.

Accordingly, it is also desirable to provide an electronic lock design which avoids a substantial consumption of electrical power.

It is also desirable to provide a compact electronic lock design.

It is also desirable to provide an alternative electronic lock design with enhanced security features.

It is also desirable to provide an electronic lock design, preferably with programmable features, to enable users to adapt the electronic lock to meet one or more user needs.

It is desirable to provide an electronic lock design which incorporates one or more of the foregoing features, or other useful features.

SUMMARY OF SELECTED ASPECTS OF THE INVENTION

In one aspect, an electronic lock is designed to be installed in a storage unit. When installed, the electronic lock is operationally associated with a locking assembly (for example, a locking bar assembly) for locking and unlocking a storage unit (for example, storage units suitable for one or more storage compartments). In this aspect, the electronic lock includes a lock housing which can be releasably secured to the storage unit. The electronic lock may be adapted for use in retrofit installations, as a replacement for previously installed locks, or as an original equipment manufacturers' (OEM) component.

Various features and components may be used to releasably secure the electronic lock housing to a storage unit. Fasteners, couplings, quick connect and other elements may be provided to secure the electronic lock, yet allow the manufacturer, installer or other user to remove the electronic lock, if replacement, repair or removal for some other reason, is desired.

It is preferable that the housing is replaceable or interchangeable with other housings selected from a group of preselected housings of different shapes, sizes, and configurations, the group being compatible for use with a plurality of other locking systems which are widely used in many standard locking applications within the industry.

The electronic lock includes a driver to operationally engage the locking assembly. Typically, the driver moves between a first driver position and a second driver position. In the first driver position, the locking assembly is in the locked position. In the second driver position, the locking assembly is in the unlocked position.

Preferably, the driver is replaceable or interchangeable with other drivers selected from a group of preselected drivers of different shapes, sizes, and configurations, the group being compatible for use with a plurality of tenons, cranks, linkage bars and other components in locking systems which are widely used in many standard locking applications within the industry.

A drive shaft assembly is protected in the housing. The drive shaft assembly is adapted to be selectively and operationally engaged with the driver. For example, an operator may select a locked position for the electronic lock in which the drive shaft assembly will not activate the locking assembly in the storage unit. In one mode, such as for example, when the electronic lock is in the locked position, the drive shaft assembly is operationally disengaged from the driver so that the driver is unable to lock or unlock the locking assembly in the storage unit. Similarly, by way of example, the operator may select an unlocked position for the electronic lock in which the drive shaft assembly may be operationally engaged with the driver, so that the operator may manually unlock the locking assembly.

The electronic lock includes a gear segment assembly which moves between a first gear segment position and a second gear segment position. In the first gear segment position, the drive shaft assembly is operationally disengaged from the driver. In the second gear segment position, the drive shaft assembly is operationally engaged with the driver.

The electronic lock also includes an electronic access control to operate the gear segment assembly between the first gear segment position and the second gear segment position. The electronic access control will, often, but not necessarily, include an operator activation device such as a programmable keypad or a programmable access card reader (for example, and RFID card reader). The electronic access control may include an electric motor in combination with a rechargeable or replaceable battery power source. The electric motor may be used to move the gear segment assembly to the second gear segment position, so that the operator may operationally engage the driver, to, in turn, operate the locking assembly between a first position in which the locking assembly is "locked" (for example, to prevent opening of the storage unit) and a second position in which the locking assembly is unlocked (so that the locking assembly may be moved by the operator, between the locked and unlocked positions).

In a preferred embodiment, when the electronic lock is in the unlocked mode, and the electric motor has moved the gear segment assembly to the second gear position, the operator may manually operate the driver by rotational movement, or other movement, of the drive shaft assembly. Preferably, the motor may be used sparingly to operate the gear segment assembly, without operating the entire drive shaft assembly, to reduce power consumption and thus, prolong battery life, or reduce the frequency of battery recharging or replacement.

A port, such as a USB port, may be provided to allow convenient recharging of a suitable rechargeable battery and to allow data storage, data access or exchange with the electronic access control.

The electronic lock in this aspect also includes a manual activation assembly which is operationally connected to the driver when the gear segment assembly is in the second gear segment position. In this mode, the operator may manually operate the driver between the first driver position and the second driver position. In preferred embodiment, the manual activation assembly includes a manually operated knob which the operator may rotate, to move the drive shaft assembly and to operate the driver so that the locking assembly may be operated between its locked position and its unlocked position.

The manual activation assembly may also provide a bypass feature. In certain situations, for example, when the motor in the electronic access control is not operational (or for administrative convenience), the bypass feature may be activated to permit the operator to manually operate the drive shaft assembly, without using the motor to move the gear segment assembly to the second gear segment position. In some instances, the bypass feature may allow the operator to manually move the gear segment assembly to the second gear segment position (for example, when the motor is not operational). In other embodiments, the bypass feature may allow the operator to activate other elements to operationally engage the drive shaft assembly with the driver. In some instances, the bypass feature may operationally engage the drive shaft assembly with the driver without activating or moving the gear segment assembly to the second gear segment position.

For example, in some embodiments, the bypass feature may include a key activated locking core to operationally engage the drive shaft assembly with the driver, without moving the gear segment assembly. The operating key may be inserted by the operator into the locking core, to turn the drive shaft assembly, and in turn, move the driver so that the locking assembly in the storage unit may be moved between the locked and unlocked positions.

In another aspect, an electronic lock operates between a locked position and an unlocked position, to allow an operator to lock and unlock a storage unit. In this aspect, the electronic lock comprises:

- A lock housing which may be used to secure the electronic lock to the storage unit;
- A driver which operationally engages with a locking assembly in the storage unit to lock and unlock the locking assembly;
- A drive shaft assembly which is located in the housing to selectively and operationally engage with the driver;
- An electronic access control which operates a gear segment assembly. The gear segment assembly operates between a first gear segment position and a second gear segment position. In the first gear segment position, the drive shaft assembly is operationally disengaged from the driver when the electronic lock is in the locked position. In the second gear segment position, the drive shaft assembly is operationally engaged with the driver when the electronic lock is in the unlocked position; and A manual activation assembly which is operationally connected to the driver when the gear segment assembly is in the second gear segment position. When the gear segment assembly is in the second gear segment position, an operator may manually operate the driver between the first driver position and the second driver position.

In yet another aspect, an electronic lock operates between a locked position and an unlocked position to lock and unlock a locking assembly in a storage unit. In this aspect, the electronic lock may include:

A lock housing for secure releasable engagement with the storage unit;

A drive shaft in the housing, in which the drive shaft includes:

A first shaft segment secured to a removable driver for engagement with the locking assembly;

A second shaft segment which is operationally disconnected from the first shaft segment in a first mode, and the second shaft segment is operationally connected to the first shaft segment in a second mode;

An electronic access control to operate a gear segment assembly between a first gear segment position and a second gear segment position; in the first gear segment position, the second shaft segment is operationally disconnected from the first shaft segment; in the second gear segment position, the second shaft segment is operationally connected to the first shaft segment;

The electronic access control may include:

a programmable keypad or a card reader to activate a battery powered motor for operation of the gear segment assembly between the first gear segment position and the second gear segment position; and A third shaft segment which may be provided in a manual activation assembly for manual rotational operation of the drive shaft when (a) the gear segment assembly is in the second gear segment position, or (b) the manual activation assembly is in a bypass mode to operate the first shaft segment without activating the battery powered motor.

By way of example, in some embodiments, the third shaft segment may include a keyed locking core configured to operate the drive shaft without activating the electronic access control or without drawing power from a battery power source to operate an electric motor or other electronic components. In other embodiments, the third shaft segment may be configured to operate separately from the manual activation assembly. In some instances, one or more of the shaft segments may be constructed from multiple components or pieces.

The invention includes a method of operating the electronic lock including the steps of:

enabling a passcode for motorized operation of a gear assembly in the electronic lock between a disengaged position and an engaged position, wherein:

in the disengaged position, a manual drive assembly in the electronic lock is disengaged from a lock assembly in a storage unit; and in the engaged position, the manual drive assembly is engaged with the lock assembly, to permit manual movement of the manual drive assembly between a first position in which the lock assembly is in a locked position, and a second position in which the lock assembly is in an unlocked position.

The passcode may be provided to the electronic lock by manually entering the passcode via a keypad, or by communication with a permitted electronic device. For example, the passcode may be scanned by a card reader, or the passcode may be detected by communication with a computer, smartphone, an RFID enabled device, an NFC device, or other type of device capable of communicating the passcode to the electronic lock, or more particularly, to a controller in the electronic lock.

In another aspect, the method includes applying power to a motor for linear movement of a gear assembly to engage the drive assembly with the locking system in the storage unit. The method may include switching steps to stop the application of power to the motor when the gear assembly has completed a movement of the gear assembly between the disengaged position and the engaged position.

In another aspect of the invention, the motorized movement of the gear assembly between the disengaged position and the engaged position corresponds to an operational engagement of a first portion of the drive assembly with a second portion of the drive assembly. In the disengaged position, the manual drive assembly will not operate the locking system between the locked position and the unlocked position. In the engaged position, the first portion is engaged with the second portion of the drive assembly, permitting the user to operate the locking system between the locked and unlocked position, to allow the user to gain access to the storage unit.

Another aspect of the invention includes a manual drive assembly with a manually operated knob including a security feature to permit a portion of the knob to break away from the drive assembly, to inhibit further damage or tampering with the drive assembly.

The method may include storing data relating to the operation of the electronic lock in a memory element (such as for example, a removable flash drive, memory card, or some other compatible memory element).

The method may also include activating a manual bypass element, to permit manual operation of the locking system, without operating the motor to engage or disengage the gear assembly with the manual drive assembly.

The invention includes a system for operating an electronic locking system in a storage unit. The system may include:

a motor to operate a gear assembly in the electronic lock between a disengaged position and an engaged position;

a controller to selectively apply power to a motor for operation of the gear assembly between the disengaged position and engaged position; and a manual drive assembly in the electronic lock for selective engagement and disengagement from a lock assembly in a storage unit, permitting a user to move the lock assembly between a locked position and an unlocked position.

The system may also include a manual bypass to permit access to the electronic lock without motorized operation of the gear assembly.

The manual bypass may be lockable to prevent unauthorized use of the manual bypass to operate the manual drive assembly.

The system may include an electrical component selected from the group of components consisting of:

- a battery providing a power reservoir for operation of the motor;
- a switch associated with the motor, to affect the operation of the motor according to the position of the gear assembly;
- a switch to shut off power to the motor after the gear assembly has moved between the disengaged position and the engaged position;
- a memory device for storing data associated with the electronic lock;
- a data access port associated with the memory device;
- a real time clock for associating real time data with use of the electronic lock;
- an access element selected from the group of elements consisting of: a keypad for entering a predetermined access code; a device reader; and a receiver to receive an access code from a permitted electronic device.

Other methods, systems, and software will also be readily apparent to persons skilled in the art, having regard to the more detailed description provided herein.

There are other possible embodiments of this invention which may include interchangeable drivers, interchangeable housings, electronic access control features which may include a programmable keypad, a programmable card reader, a manual bypass feature, a removable chassis, interchangeable electronic components including a controller and modular circuits, and one or more of the other features described elsewhere within this specification. An optional modular chassis assembly may also be provided in which a removable array of components are assembled in a modular format for testing, maintenance, repair, convenience, or improved quality control during assembly of the electronic lock. A preferred embodiment of the invention is described having regard to the following drawings.

Other aspects of the invention will become apparent to those persons who are skilled in the art upon reading the following detailed description, drawings and appended claims.

BRIEF DESCRIPTION OF THE DRAWINGS

FIG. 4-1 shows a partial interior view of the Electronic Lock of FIG. 3 to illustrate an example of the Motor and Gear Assembly.

FIG. 4-2 shows a partial interior top view, in perspective, of the Electronic Lock of FIG. 3 to illustrate an example of the circuit board assembly.

FIG. 4-3 shows a partial interior bottom view, in perspective of the Electronic Lock of FIG. 3 to illustrate the example of the circuit board assembly.

FIG. 6-1 shows examples of fully assembled Electronic Locks with different embodiments of the Lock Drive Shaft.

FIG. 6-2 shows examples of different embodiments of the Lock Drive Shaft.

FIG. 7-1 shows the steps to open an embodiment of the Electronic Lock.

FIG. 7-2 shows the steps to close an embodiment of the Electronic Lock.

FIG. 8-1 shows a partial interior view of the illustrated embodiment of the Electronic Lock in the Fully Locked Position.

FIG. 8-2 shows a partial interior view of the illustrated embodiment of the Electronic Lock as the Motor begins to rotate.

FIG. 8-3 shows a partial interior view of the illustrated embodiment of the Electronic Lock after the motor is fully rotated and the Manual Knob is ready to be turned.

FIG. 8-4 shows a partial interior view of the illustrated embodiment of the Electronic Lock as the user begins turning the Manual Knob.

FIG. 8-5 shows a partial interior view of the illustrated embodiment of the Electronic Lock in the fully opened position.

FIG. 10-1 shows an exploded front view, in perspective, of a modular chassis assembly in the Electronic Lock.

FIG. 10-2 shows an exploded rear view, in perspective, of the modular chassis assembly illustrated in FIG. 10-1.

FIG. 10-3 shows a front view, in perspective, of the assembled modular chassis assembly illustrated in FIGS. 10-1 and 10-2.

FIG. 11-1 shows a front view of a partial section, in perspective, of the modular chassis assembly, when the key and the locking core are partially rotated.

FIG. 11-2 shows a rear view of a partial section, in perspective, of the modular chassis assembly, when the key and the locking core are partially rotated as illustrated in FIG. 11-1.

FIG. 12-1 shows a front view of a partial section, in perspective, of the modular chassis assembly, when the key and the locking core are rotated 180 degrees in a clockwise direction.

FIG. 12-2 shows a rear view of a partial section, in perspective, of the modular chassis assembly, when the key and the locking core are rotated 180 degrees as illustrated in FIG. 12-1.

FIG. 13-1 shows a front view, in perspective, of the locking core assembled with the inner cam.

FIG. 13-2 shows an exploded front view, of the locking core and the inner cam illustrated in FIG. 13-1.

FIG. 13-3 shows a rear view of the locking core, and a front view of the inner cam, to illustrate the mating features of these two components.

FIG. 15-1 is a plan view of selected components in the modular chassis assembly, illustrating the interaction between the drive gear assembly and a visual indicator, showing the position of the drive gear assembly.

FIG. 15-2 is a rear view, in perspective, of the selected components in the modular chassis assembly, illustrated in FIG. 15-1.

FIGS. 17-1 and 17-2 are flowcharts representing the operational steps of the microcontroller switches of the present invention, in opening a preferred embodiment of the invention.

FIG. 17-3 is a flowchart representing the operational steps of the microcontroller switches of the present invention, in closing a preferred embodiment of the invention.

FIGS. 18 and 18-1 are illustrations of the component layers of an example of a keypad assembly included in an embodiment of the present invention.

FIGS. 19-1 to 19-12 illustrate schematic representations of the components in a preferred microcontroller controller circuit board of the present invention.

FIG. 19-1 is a schematic drawing of a preferred (AT90USB) microcontroller circuit.

FIG. 19-2 is a schematic drawing of a keypad connection circuit.

FIG. 19-3 is a schematic drawing of an audible buzzer circuit.

FIG. 19-4 is a schematic drawing of a microSD card holder circuit.

FIG. 19-5 is a schematic drawing of a voltage regulator circuit.

FIG. 19-6 is a schematic drawing of a circuit comprising the three micro electronic switches 1, 2 and 3 shown in FIG. 16.

FIG. 19-7 is a schematic drawing of the USB port circuit.

FIG. 19-8 is a schematic drawing of the main battery circuit.

FIG. 19-9 is a schematic drawing of the real time clock (RTC) battery backup circuit.

FIG. 19-10 is a schematic drawing of the motor driver circuit.

FIG. 19-11 is a schematic drawing of the real time clock circuit.

FIG. 19-12 is a schematic drawing of the LiPo battery charger circuit.

FIGS. 20 and 20-1 are schematic drawing of an optional microcontroller circuit including RFID and NFC antennas. FIGS. 20-2 and 20-3 are tabled lists of specifications for the circuit components shown in FIGS. 20 and 20-1.

FIG. 23 is a chart illustrating a set of preferred programming commands for an electronic lock of the present invention.

FIG. 24 is a chart illustrating a set of preferred database files for use in association with the microcontrollers in an embodiment of an electronic lock of the present invention.

FIG. 25-1 is an exploded frontal view in perspective of another embodiment of the invention.

FIG. 25-2 is an exploded rear view in perspective of the embodiment shown in FIG. 25-1.

FIG. 27-1 is a side view in perspective of a portion of the motorized latching assembly of the embodiment in FIG. 25-1.

FIG. 27-2 is a bottom view in perspective of the motorized pin and rotor components shown in FIG. 27-1.

FIG. 27-3 is top view in perspective of the motorized pin components shown in FIG. 27-1 and FIG. 27-2.

FIG. 28-1 is a top view of the motorized pin and knob assembly in which the knob includes an optional breakaway security feature.

FIG. 28-2 is an exploded top view of the motorized pin and knob assembly shown in FIG. 28-1.

FIG. 29-1 is a front view in perspective of a plug and adapter (not shown) inserted in a shell housing in combination with a driver assembly.

FIG. 29-2 is an exploded frontal view in perspective of the plug, adapter, shell housing and driver assembly shown in FIG. 29-1.

FIG. 31-1 is a side sectional view of a change key CK partially inserted into a plug 222, advanced in the direction of arrow 1.

FIG. 31-2 is a side sectional view of the change key CK further advanced into the plug 222, in the direction of arrow 2.

FIG. 31-3 is a side sectional view of the change key CK fully inserted into the plug 222, after being advanced in the direction of arrow 3.

DESCRIPTION OF PREFERRED EMBODIMENTS OF THE INVENTION

Figure 2:
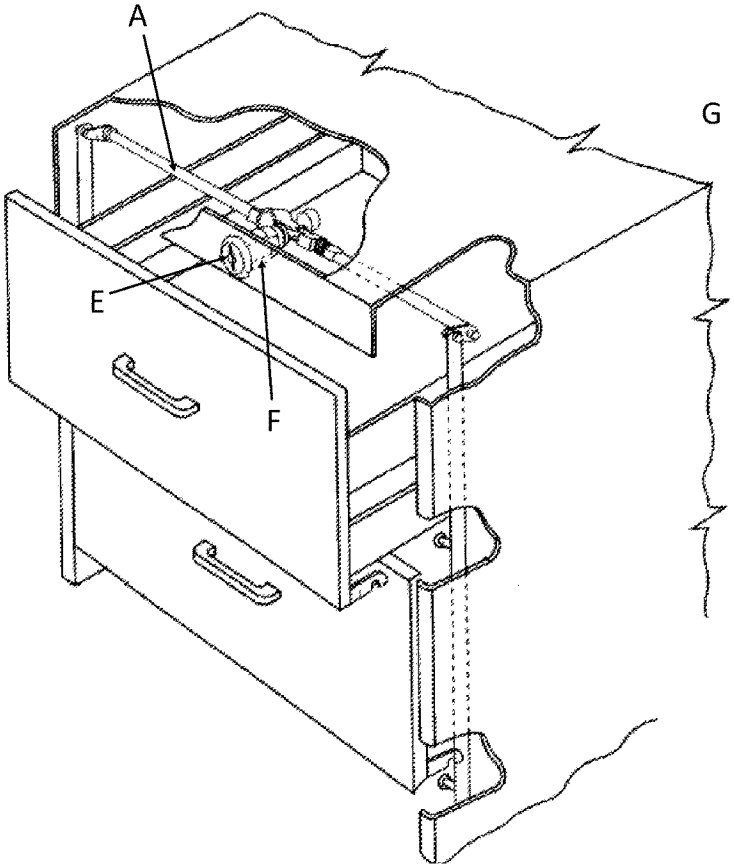
Fig. 2 Prior Art
FIG. 2 shows the prior mechanical lock of FIG. 1 as used in a central locking application for a lateral filing cabinet.
Figure 1:
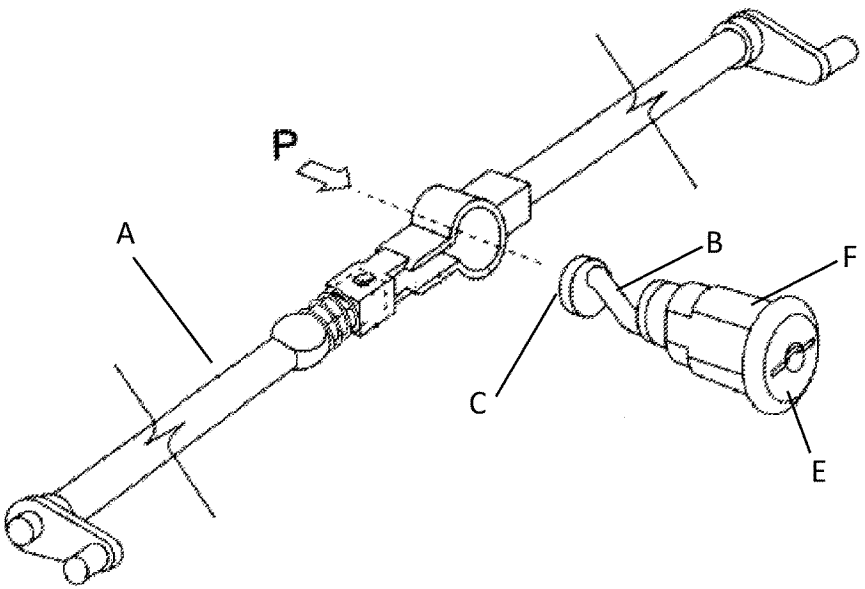
Fig. 1 Prior Art
FIG. 1 shows one embodiment of the prior mechanical locks.

FIG. 1 and FIG. 2 show an embodiment of a prior art latching system illustrated and described in Canadian Patent No. 2,388,230. FIG. 1 and FIG. 2 show one embodiment of an irregularly shaped driver B having a retainer C which is generally circular in cross-section. The mechanical locking system shown in this patent includes a crank arm A with a zigzag configuration. This crank arm A is connected to a key operated locking core E which is included in a standard "Double D" lock housing unit F. This mechanical lock is shown installed in a conventional two drawer locking cabinet G.

Electronic locks of the prior art are not readily or easily adapted for retrofit installation in storage units fitted with prior art latching systems.

FIGS. 3 to 24 show a preferred embodiment of the present invention.

Figures 1, 4:
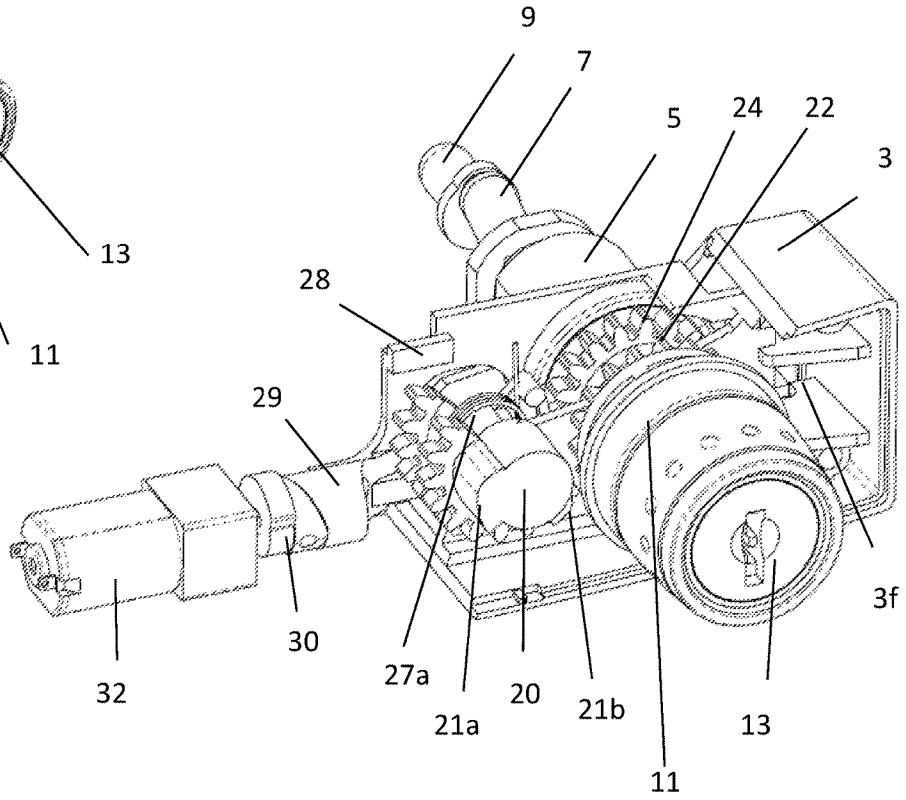
Figure 3:
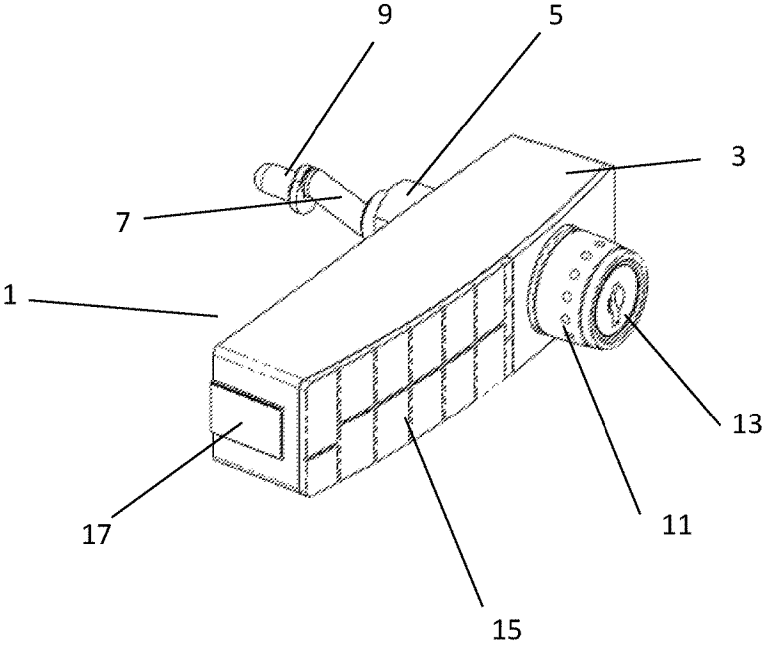
FIG. 3 shows fully assembled preferred embodiment of the Electronic Lock of the present invention.
Figures 2, 4:
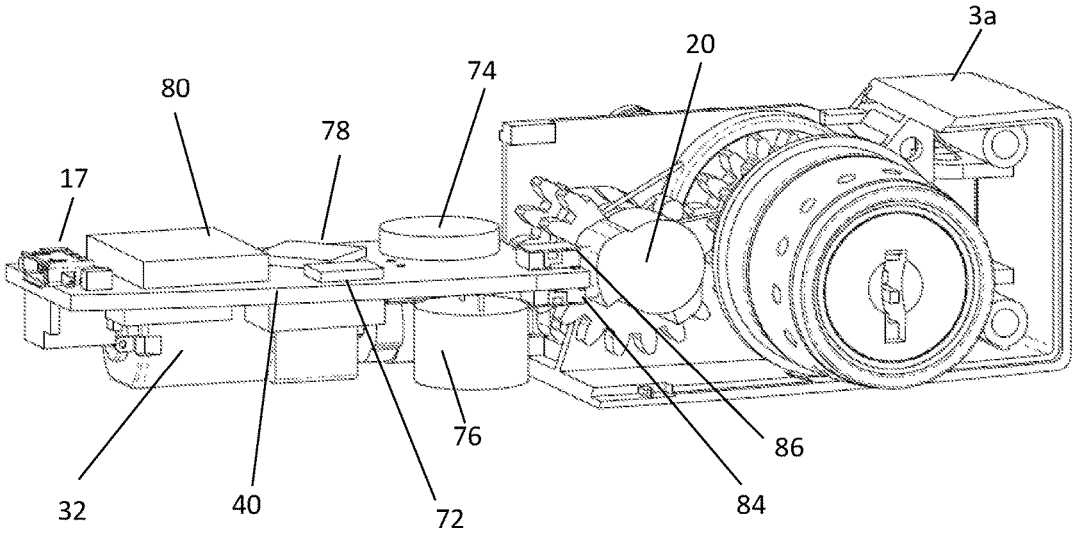
Figures 3, 4:
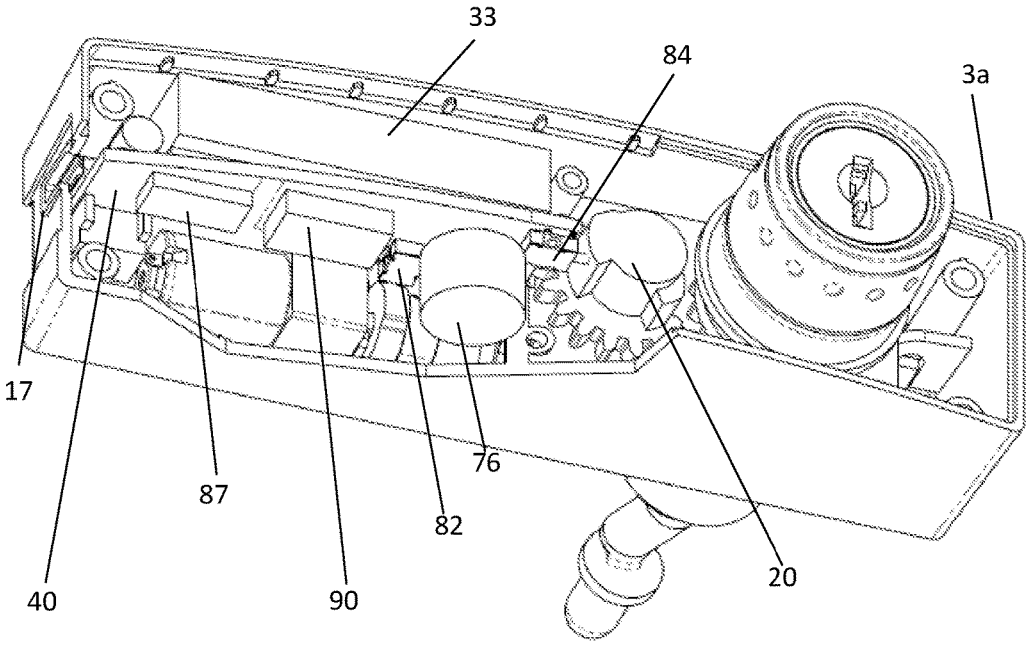
Figure 5:
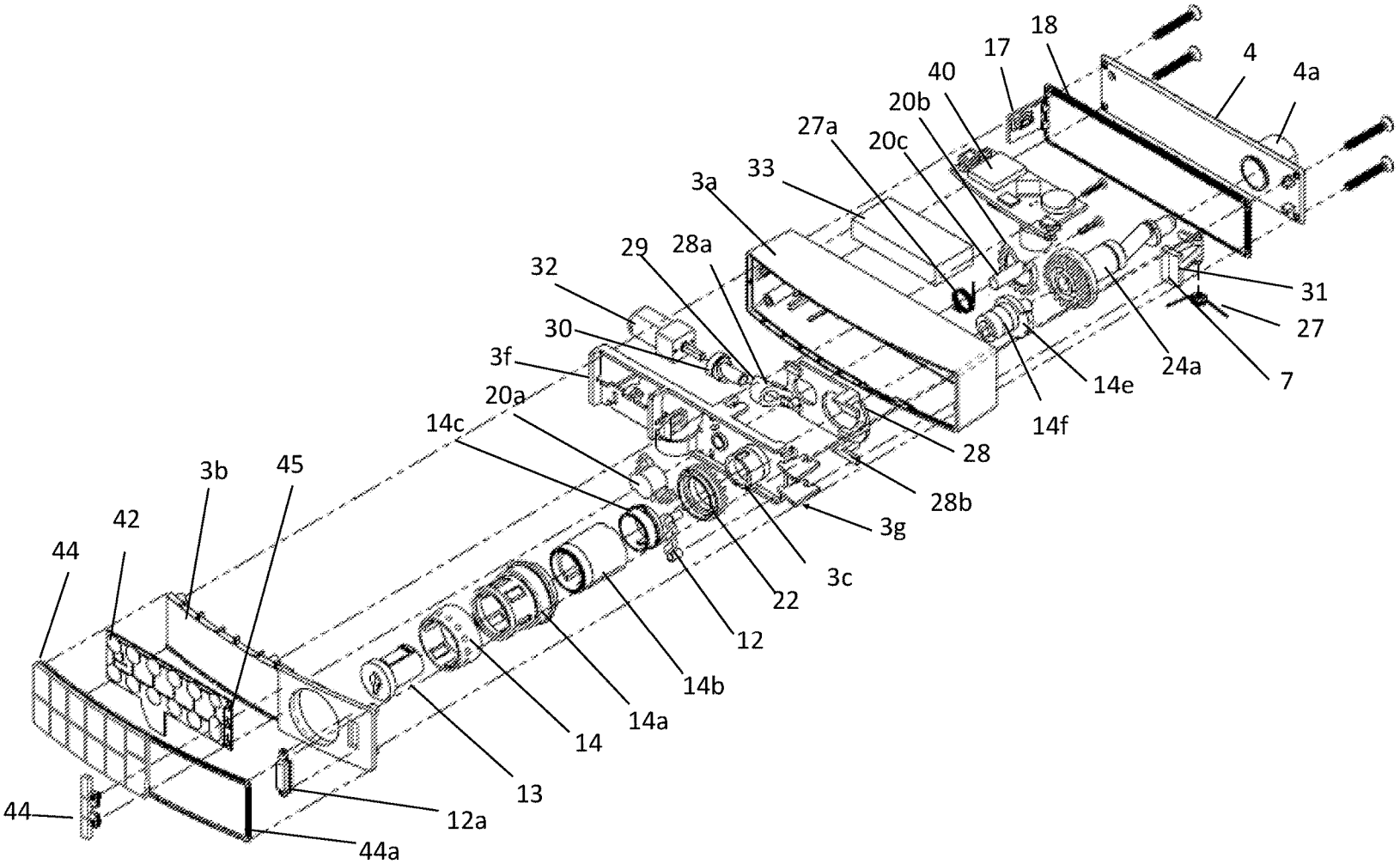
FIG. 5 shows an exploded view of the preferred embodiment of the Electronic Lock.

FIG. 3 shows an exterior view of an electronic lock 1, FIG. 4-1 shows a partial section of the electronic lock 1, and FIG. 5 shows an exploded view of the electronic lock. The electronic lock 1 includes a lock housing 3 with a standard "Double D" configuration lock housing insert 5. The lock housing 3 includes a housing frame 3*a* connected to a housing front plate 3*b*. (Persons skilled in the art will appreciate that gaskets and additional protective features may be provided between interconnecting components, to protect against dirt, moisture and other potentially damaging hazards. One or more of these optional features may be provided, where needed or desired, as a matter of design choice.)

The lock housing insert 5 extends from the interchangeable rear housing plate 4 of the lock housing 3. The lock housing insert 5 is configured to fit within a corresponding opening with a like configuration in a storage unit. The lock housing insert 5 may be cast with the rear plate 4 as one piece. In other embodiments, the lock housing insert 5 may be a separate piece 4*a* secured (in some other manner) to a suitable back plate piece.

A drive shaft 7 extends rearwardly from the lock housing 3 toward the interior of a storage unit (not shown). A driver 9 extends from the distal end of the drive shaft 7. The driver 9 is provided to connect with a locking system in a storage unit (which may be similar to an existing unit similar to the locking system described in Canadian Patent No. 2,388,230. Preferably, the driver 9 is interchangeable with other replacement drivers. A substitute driver may be attached to a suitably configured drive shaft segment which may also differ in configuration from the drive shaft 9 illustrated in FIG. 3.

Different drive shaft configurations may be accommodated within the interior of the lock housing 3. The drive shaft, driver and housing components may be interchangeable with other replacement components to allow the electronic lock 1 to be interchangeable with comparable mechanical locks or other electronic locks. The interchangeability of these components enhances the adaptability of the electronic lock system for simplified repairs and replacements of existing locks and in OEM manufacture.

A keypad 15 is provided as part of an electronic access control situated on the proximate face of the electronic lock 1. In this embodiment, keypad 15 includes an external protective keyboard membrane 44 and a front gasket 44*a*. The keypad 15 supports the entry of pass codes and programming commands via a keyboard circuit 42 into the memory element included in circuit board 40 by regular users and master users. Indicator light array 45 is connected to the circuit board and the power supply, to notify the operator of one or more status indicators associated with the maintenance and operation of the electronic lock. A USB port and cover 17 are provided on the side face of the lock housing 3. The USB port may be provided to facilitate recharging of the interior power storage (battery 33) used to power the electronic components of the electronic lock 1 including a battery powered rotary motor 32. In this embodiment, the USB port cover 17 is shown as a flexibly hinged attachment to a protective gasket 18 positioned between the interchangeable housing rear plate 4 and the housing frame 3*a*.

A manual knob assembly 11 surrounds a rotatable bypass (override) key core 13. The manual knob assembly 11 includes a knob grip 14 which extends outwardly from the housing front plate 3*b*. The knob grip 14 is secured to a manual knob 14*a* which partially extends inwardly, away from the front plate 3*b*. When the knob grip 14 is secured to the manual knob 14*a* (for example, in a snap fit configuration), the manual knob assembly 11 is rotatably secured to the housing front plate 3*b*. In other embodiments comprising a lock housing 3*a*, a dummy plug (not shown) may be permanently installed so that a keyed bypass feature is not available. Some customers may wish to avoid the risk of the keyed lock being picked and therefore those customers may choose to decline the keyed bypass feature.

The knob barrel 14*b* nests within knob 14*a*, and knob barrel cap 14*c* is positioned within knob barrel 14*b*, in a predetermined alignment so that the matched internal channels and abutments may selectively engage with the locking core 13 in the event that the operator chooses to operate the manual knob assembly in a manual override mode. The manual knob assembly 11 engages with a front drive gear 22 mounted about the knob barrel cap 14*c*, both of which are mounted on a fixed collar 3*c* projecting in a forward direction from the chassis 3*f* located within the housing frame 3*a*. Inner cam 14*f* is positioned rearwardly of the chassis 3*f*. The inner cam 14*f* extends through the interior channel of the collar 3*c*.

Figures 1, 10:
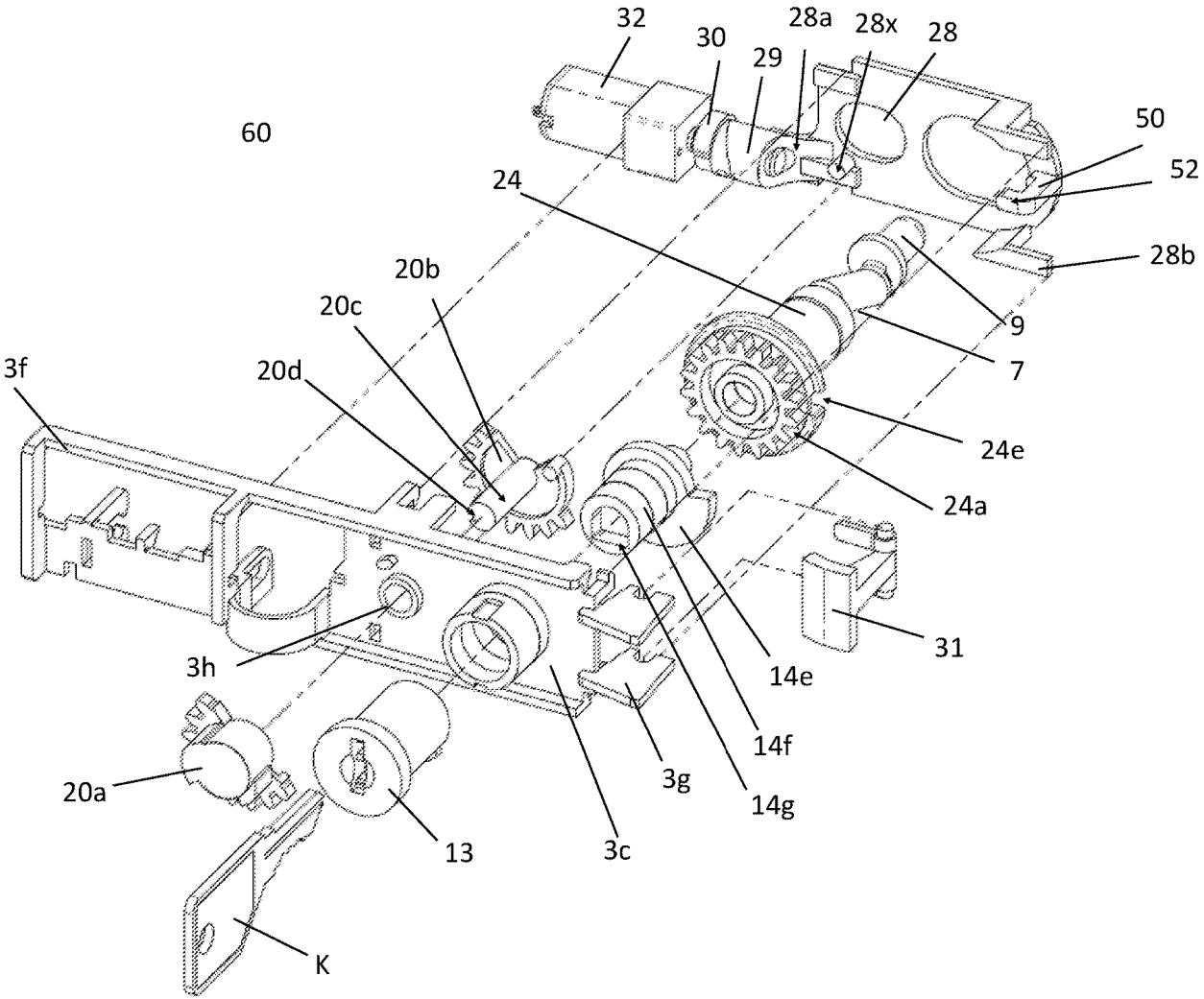
Figures 2, 10:
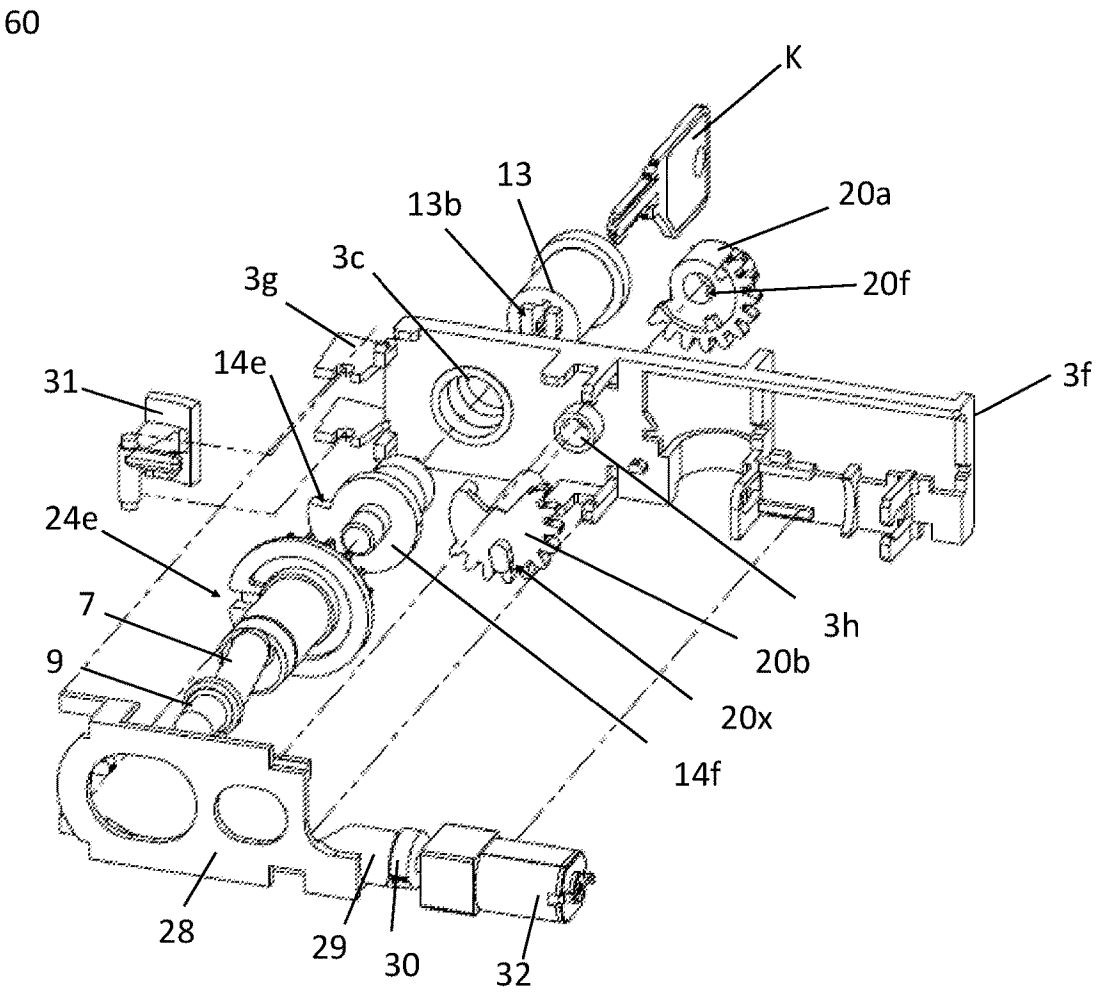

FIGS. 10-1 to 10-2 illustrate a modular chassis assembly 60. An optional chassis 3*f* is provided so that the motor 32, circuit board 40, gears and other parts may be easily assembled outside of the housing 3. An optional modular chassis assembly 60 may be utilized to obtain one or more of the following advantages, or other advantages which will be apparent to those skilled in the art:

To manage or accommodate production tolerances and to improve the alignment of parts and micro switches during assembly;

To permit convenient testing of modular assemblies within the lock assembly, and preferably, the circuit board, battery and motor, prior to installation into the housing. This also allows for convenient replacement of faulty parts prior to final assembly.

To simplify assembly and installation steps so that any parts designated for association with the modular chassis assembly 60 may be snapped into (or otherwise connected to) the chassis 3*f*, for subsequent installation into the housing 3.

When the electronic lock 1 is in a locked state, the manual knob assembly 11 and the drive shaft 7 are not engaged and will not permit operation of the driver 9. In the disengaged state, the manual knob 14*a* spins freely.

Figures 1, 15:
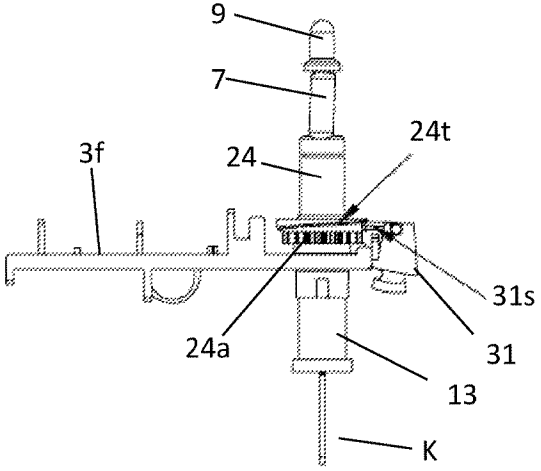
Figures 2, 15:
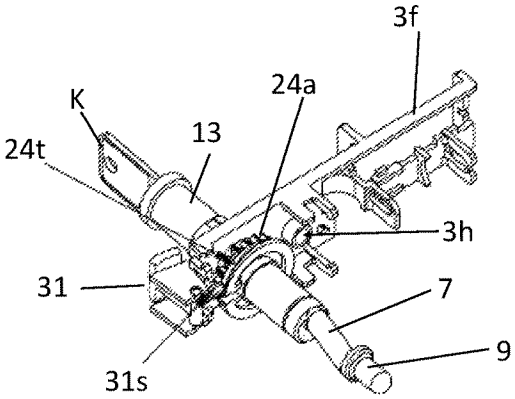
Figure 14:
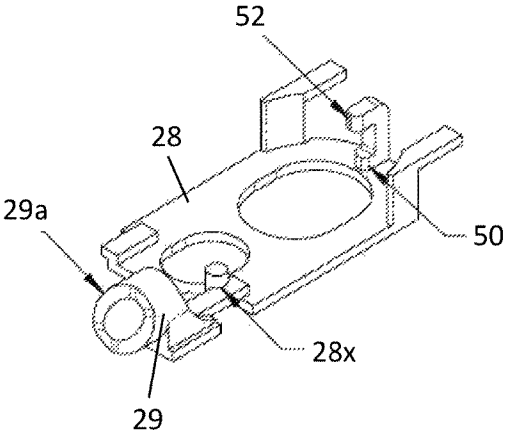
FIG. 14 is a perspective detail view of the slider cam included in the modular chassis assembly illustrated in FIGS. 11-1 to 11-3.
Figure 16:
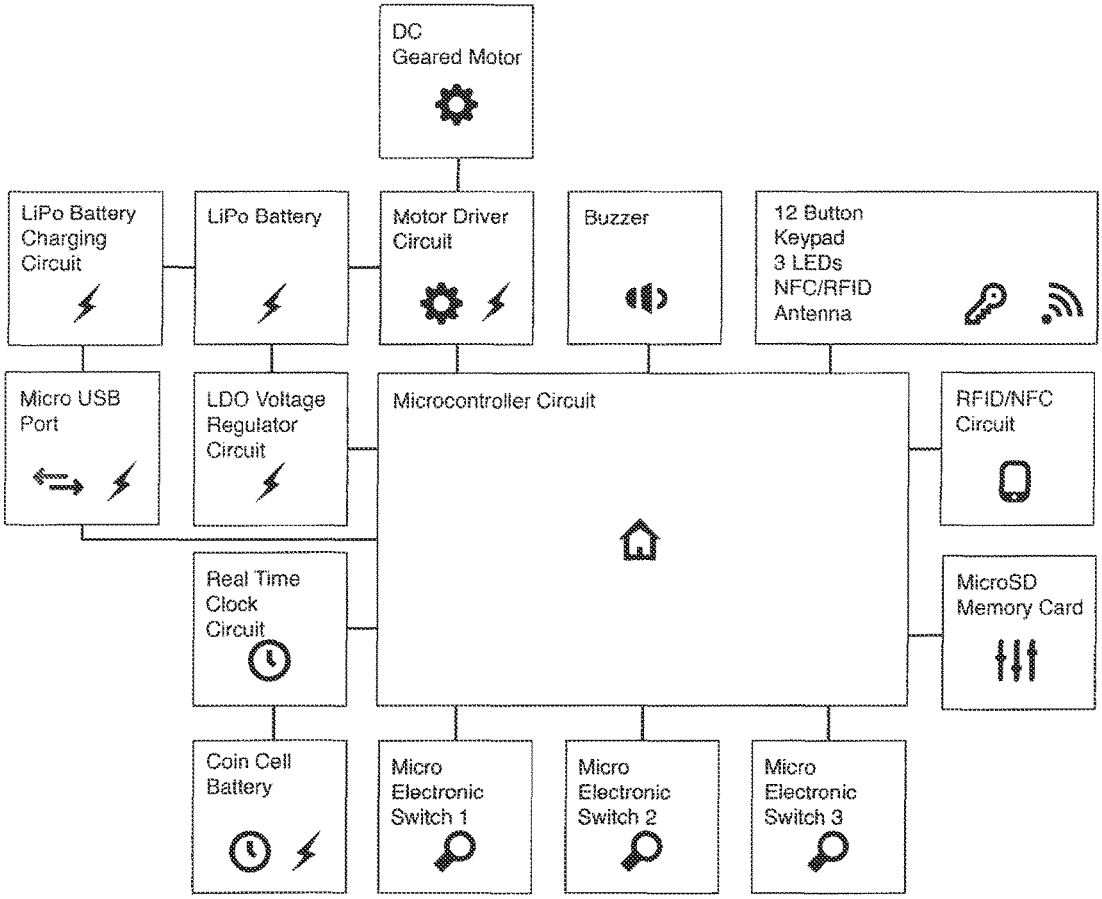
FIG. 16 is a schematic representation of a sample circuit board of a preferred embodiment of the present invention.

Once the appropriate passcode has been successfully entered and accepted by the software, the motor 32 begins to rotate. Ramped collar cam 30 which is mounted on the motor shaft also rotates. This collar cam 30 interacts with the ramped follower surface 29*a* on the first slider cam 29 so that as the collar cam 30 rotates, the slider 28 is urged away from the collar cam 30. This linear movement of the slider 28 displaces the locking dog 50 in the second slider cam 28*b*, to disengage locking dog 50 from recess 24*e* in rear drive gear 24*a*, to unlock and permit manual rotation of the drive shaft 7. The slider lobe 28*x* engages gear lobe 20*x*, when the slider 28 is displaced, to rotate the front and rear gear segments 20*a*, 20*b*, so that the gear segments 20*a*, 20*b* are aligned for engagement with the front drive gear 22 and rear drive gear 24*a*. When the knob 14 is turned, the gears 20*a*, 20*b*, 22, and 24*a* are meshed and the drive shaft 7 also turns. As shown in FIGS. 15-1 and 15-2, the ramped surface 24*t* on the rear drive gear 24*a*, engages indicator tab 31*s* (configured to act as a cam follower, along ramped surface 24*t*), to pivotally displace the indicator 31, to show that the lock is in the open position, or in the closed position, as the case may be.

The gear segment assembly 20 includes a front gear segment 20*a* located forward of the chassis 3*f* and a rear gear segment 20*b* located rearward of the chassis 3*f*. A gear segment sleeve 20*c* extends through an aperture 3*h* in chassis 3*f* to connect front gear segment 20*a* to rear gear segment 20*b*. Torsion spring 27*a* urges the gear segment assembly 20 in a preferred direction, preferably to hold the gear segment assembly 20, in a starting position, abutting against rest 3*j*, when the gear assembly 20 is disengaged from the corresponding gears of the front drive assembly 14*d* and the rear drive gear assembly 24 when the electronic lock is in the locked position. In this embodiment the front drive assembly 14*d* includes front drive gear, and parts 14, 14*a*, 14*b* and 14*c*. The rear drive gear assembly includes rear drive gear segment 24*a*.

Front gear segment 20*a* includes a first cam segment 21*a* and a second cam segment 21*b*. Cam segments 21*a* and 21*b* interact with the drive gear assembly, during rotation of the drive gear assembly, to activate control switches which interact with the motor, during the opening and closing steps of the electronic lock.

When the manual knob assembly 11 and the gear assembly 20 are operationally engaged and the manual knob assembly 11 is turned, the drive shaft 7 also turns. The user turns the manual knob assembly 11 through 180 degrees to open a matched locking assembly (not shown) within a storage unit (not shown). This manual action provides the power to lift locking bars, rotate cams and other locking features without electrical power. This optional power saving feature allows an operator to apply manual power to perform these steps thereby reducing the power draw from the battery 33.

The electronic lock 1 supports an optional manual override key K. The override key K bypasses the keypad 15 and allows the manual knob assembly 11 to be turned in operational engagement with the drive shaft assembly after the override key has been turned.

When tumblers (not shown) in the locking core 13 are key activated, they engage with the internal channels and abutments of the manual knob assembly 11 to enable the bypass (override) option, allowing the operator to operationally engage the drive shaft assembly and rotate it upon rotation of the locking core 13 and the manual knob assembly 11.

With reference to FIGS. 10 to 14, the lock core 13 has a horseshoe shaped extension 13*b* on its rear face which latches, in a slide-fit, with a corresponding, horseshoe shaped slot 14*g* on inner cam 14*f*. When the key K is inserted into the lock core 13, and the key K and lock core 13 are turned, the inner cam 14*f* also turns. The inner cam surface 14*e* acts against the cam follower 52 on the slider 28. This manual action moves the slider 28 in the same direction as the motor 32 would move the slider 28, if the motor 32 were used to operate the drive shaft 7 rather than the manual bypass. This movement of the slider 28 displaces the locking dog 50 on the second slider cam 28*b*, to disengage locking dog 50 from locking recess 24*e*, thereby unlocking the rear drive gear segment 24*a* and the drive shaft 7 so that the drive shaft 7 and the driver 9 may be rotated. The slider lobe 28*x* engages gear lobe 20*x*, when the slider is displaced, to rotate the front and rear gear segments 20*a*, 20*b*, so that the gear segments 20*a*, 20*b* are aligned for engagement with the front drive gear 22 and rear drive gear 24*a*. When the knob 14 is turned, the gears 20*a*, 20*b*, 22, and 24*a* are meshed and the drive shaft 7 also turns. As shown in FIGS. 15-1 and 15-2, the ramped surface 24*t* on the rear drive gear 24*a*, engages indicator tab 31*s* (configured to act as a cam follower, along ramped surface 24*t*), to pivotally displace the indicator 31, to show that the lock is in the open position, or in the closed position, as the case may be. The indicator tab 31*s* is kept in contact with the ramped surface 24*t* by a torsional spring 27 (shown in FIG. 5).

Figures 1, 11:
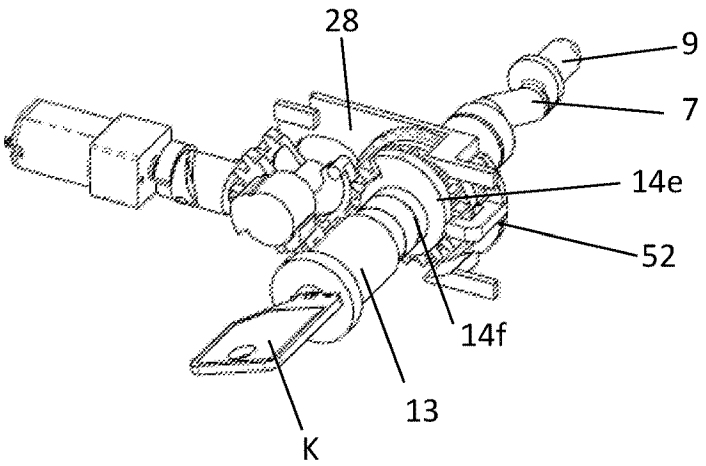
Figures 3, 10:
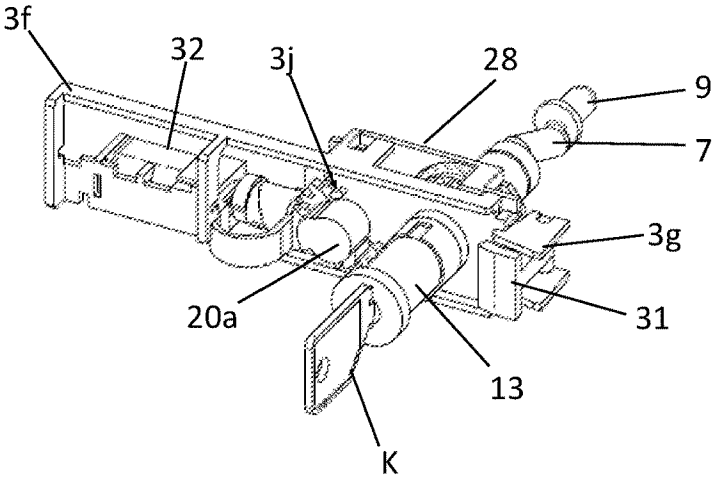
Figures 1, 12:
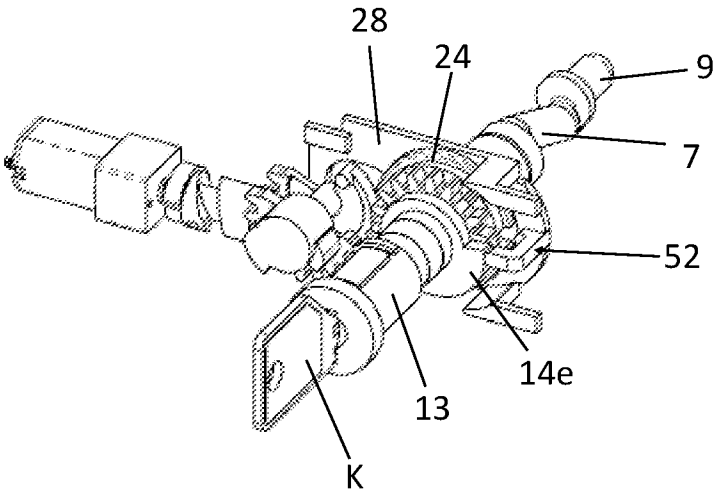
Figures 2, 11:
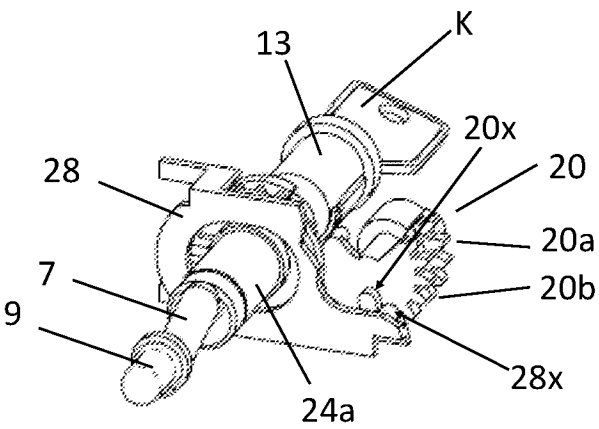
Figures 1, 13:
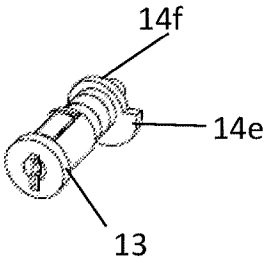
Figures 3, 13:
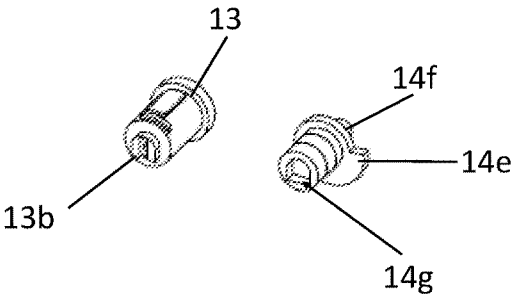
Figures 2, 12:
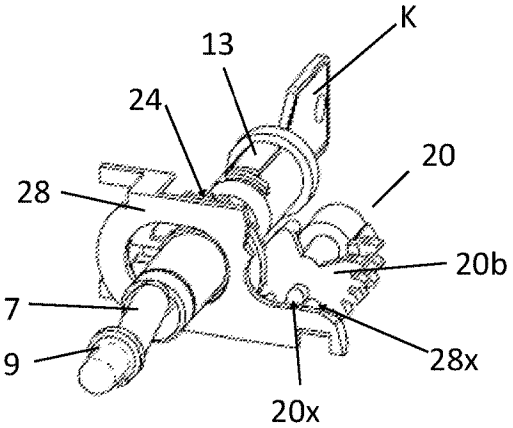
Figures 2, 13:
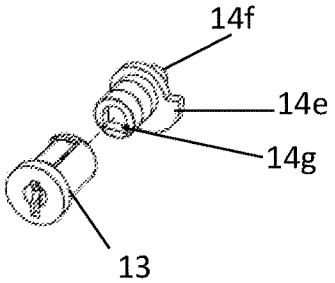

FIGS. 11-1 and 11-2 show partial sectional views of select components of the manual override system, as the key K is partially rotated. As the key K is rotated (along with the lock core 13), the inner cam 14*f* pushes the slider 28 outwardly from the rear drive gear, to disengage the dog 50 from recess 24*e*. At the same time, the slider lobe 28*x* engages the gear lobe 20*x*, to initiate rotation of the gear segments 20*a*, 20*b*. As the key K is rotated 180 degrees, as shown in FIGS. 12-1 and 12-2, the inner cam 14*f* continues to push the slider 28 outwardly away, to engage gear segments 20*a*, 20*b*, with gears 22, 24*a*.

An index spring 12 acts as a detent so the user can feel discrete clicks as the manual knob assembly 11 is rotated to advance through the operational steps of locking and unlocking.

In this embodiment, the indicator 31 is used to show different colours in the window lens 12*a* corresponding to the rotational position of the manual knob assembly 11 and whether the driver 9 has opened or closed the locking assembly. Torsion spring 27 urges the indicator 31 in a preferred direction to indicate the status of the electronic lock 1. These different colours provide the user with a visual cue showing the status of the electronic lock and its corresponding affect on the locking assembly in the storage unit: (i) fully opened, (ii) fully closed or (iii) manual knob assembly 11 is partially turned.

The electronic lock is readily adapted for use with various locking systems and storage units. A variety of interchangeable drive shafts and drivers may be provided with the electronic lock. The drive shafts and drivers are designed to fit with pre-existing locking components or standard OEM parts used by furniture manufacturers and the like. In addition, interchangeable lock housings of different configurations may be provided. For example, with regard to the example of the standard "Double D" lock housing, an opening of the same size and corresponding configuration is provided by furniture manufacturers in their furniture to accept a standard mechanical lock with a Double D mechanical lock housing. The electronic lock is easily adapted to be surface mounted on the furniture so that the housing insert 4*a* may be inserted as a replacement into a corresponding opening in an existing storage unit, including office furniture, fitted with a standard mechanical lock with a Double D housing.

The electronic lock is easily adapted to be installed into an existing central locking system of a storage unit in exactly the same manner as an existing mechanical lock. In a preferred embodiment, the back plate of the lock housing assembly is first mounted within the gable of the cabinet structure using a hex nut, spring clip or other means suitable to secure the housing back plate to the structure. For convenience, a template may be provided to locate a single drill hole for a mounting screw (not shown) on the cabinet structure to match a threaded opening or other fastening feature on the lock. The hole may be drilled in the cabinet (or other structure) and the screw may be threaded through the drilled hole and into the electronic lock housing to ensure that the housing does not rotate or move relative to the structure after installation. Provided that the appropriate housing insert, drive shaft and driver configurations have been selected, the installer should be able to install the electronic lock without other tooling changes.

The central locking system is installed in the same manner and configuration as with a mechanical lock.

Figures 1, 6:
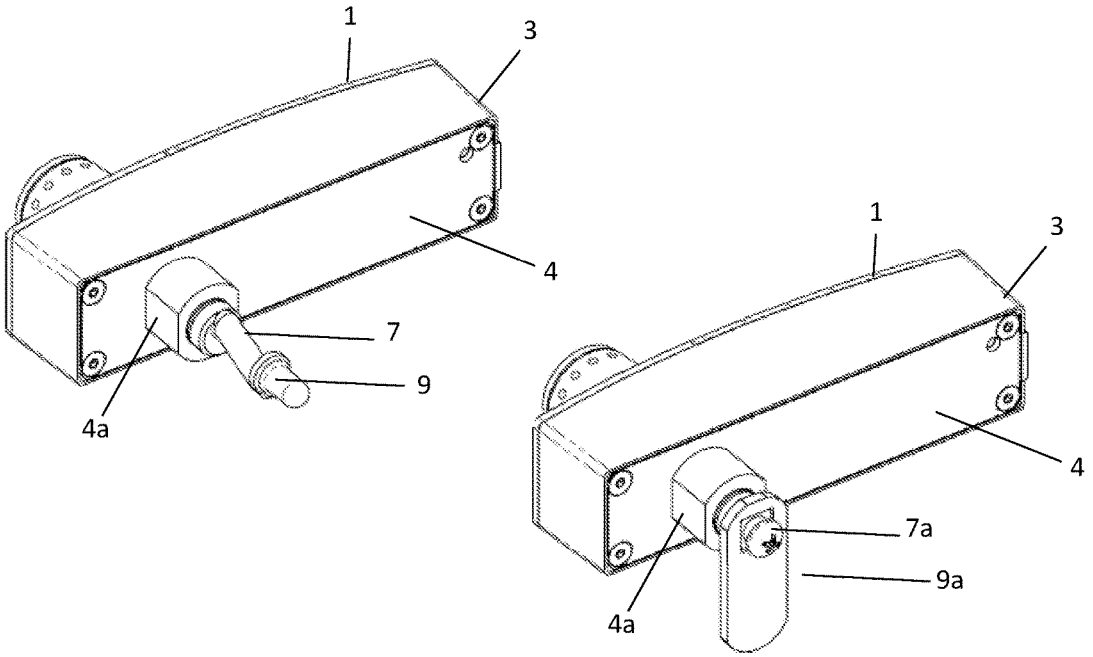
Figures 2, 6:
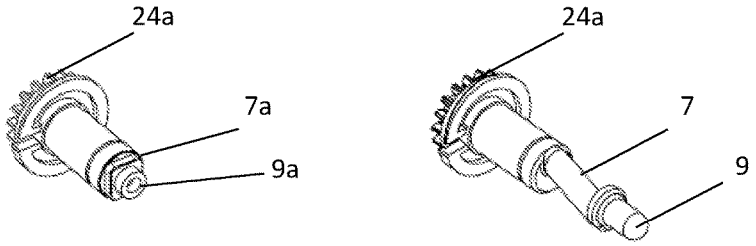

In different embodiments, the lock drive shaft and or driver may be replaced with a plurality of shapes and sizes such as square, horseshoe or other configurations. FIG. 6-1 and FIG. 6-2 illustrate two examples of two drive shafts 7,7*a* fitted with driver configurations 9,9*a*. A variety of locking cam configurations may be affixed to, or incorporated into, the end of a driver to suit many specific locking requirements of office furniture manufacturers and other manufacturers. A locking cam may be affixed to a driver or drive shaft with a hex nut or other suitable means. For example, driver cam 9*b* is shown as one embodiment of a removable cam feature. In some instances, it may also be convenient to provide a drive shaft segment, driver and cam element which may be manufactured as a single work piece.

Opening the Lock

Figures 1, 7:
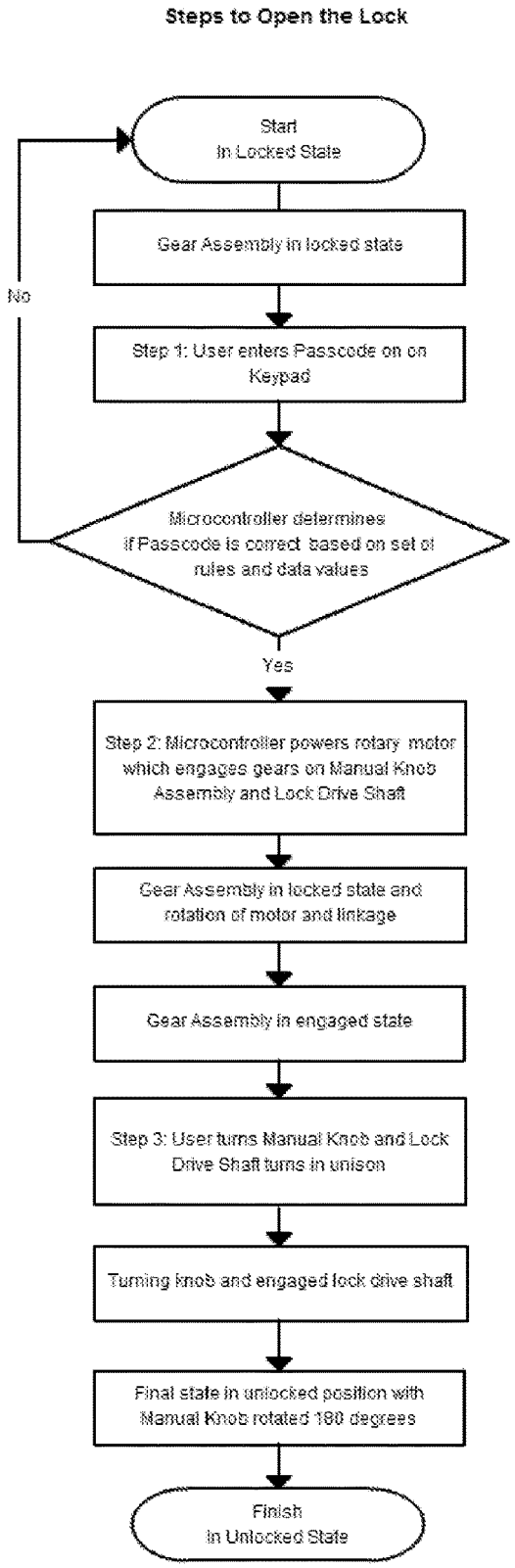
Figures 2, 7:
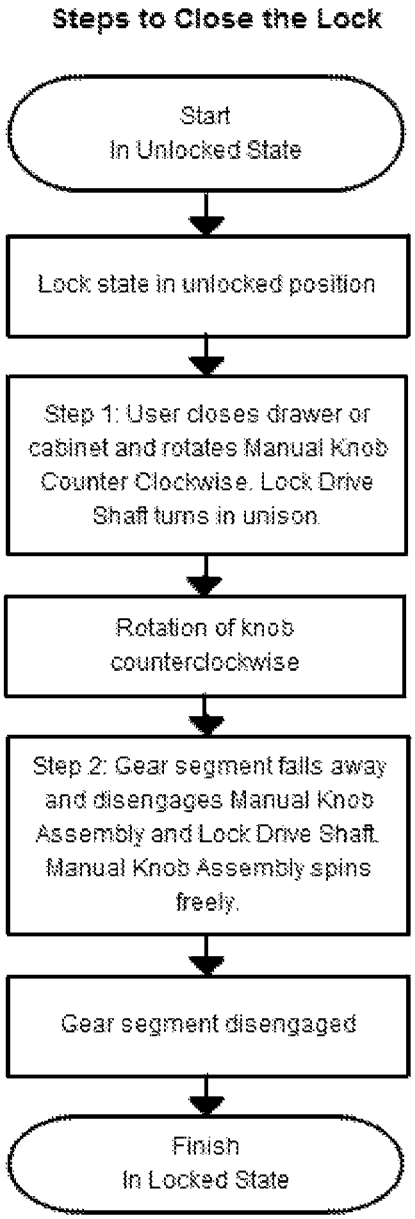

FIG. 7-1 shows an example of the logical steps taken to open the electronic lock.

Figures 1, 8:
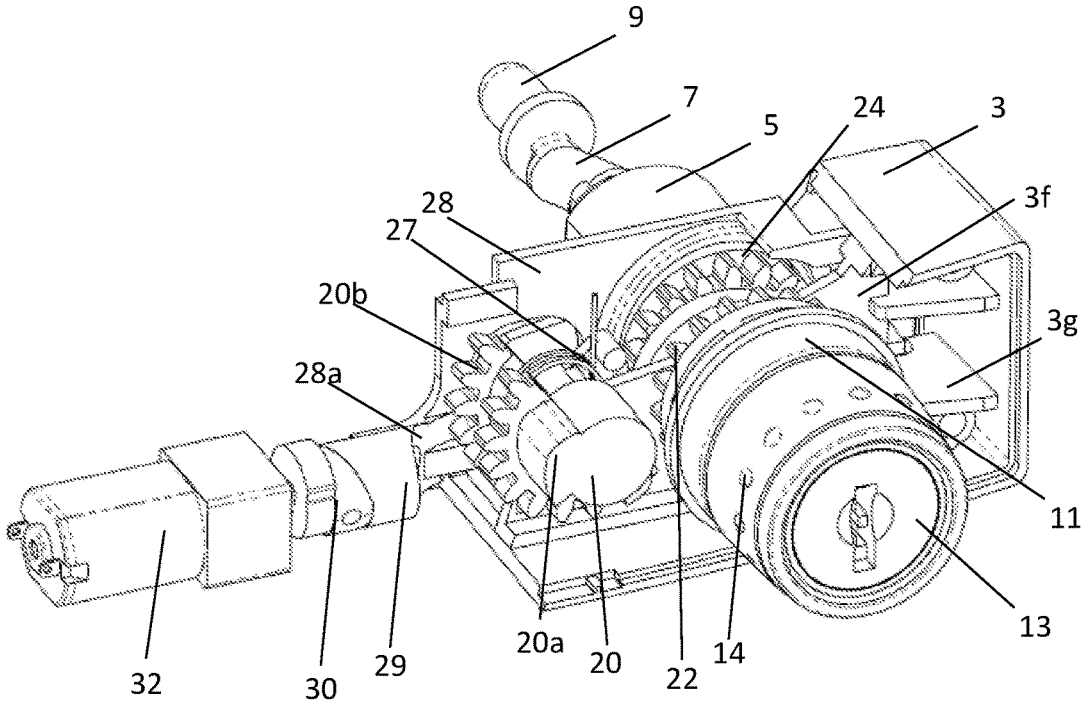
Figures 2, 8:
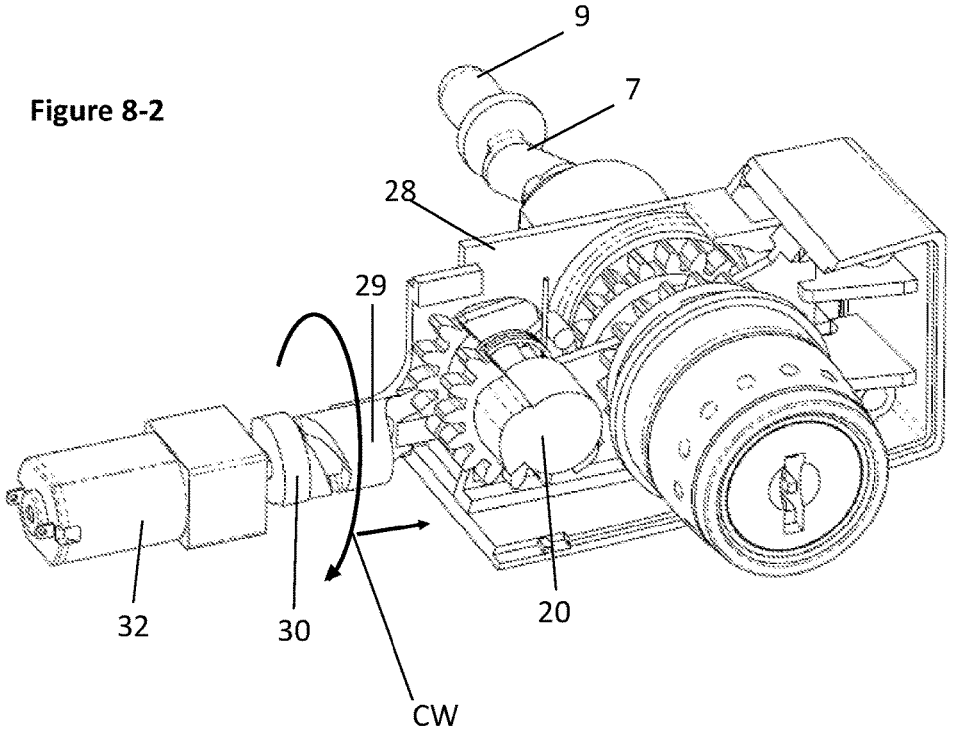
Figures 3, 8:
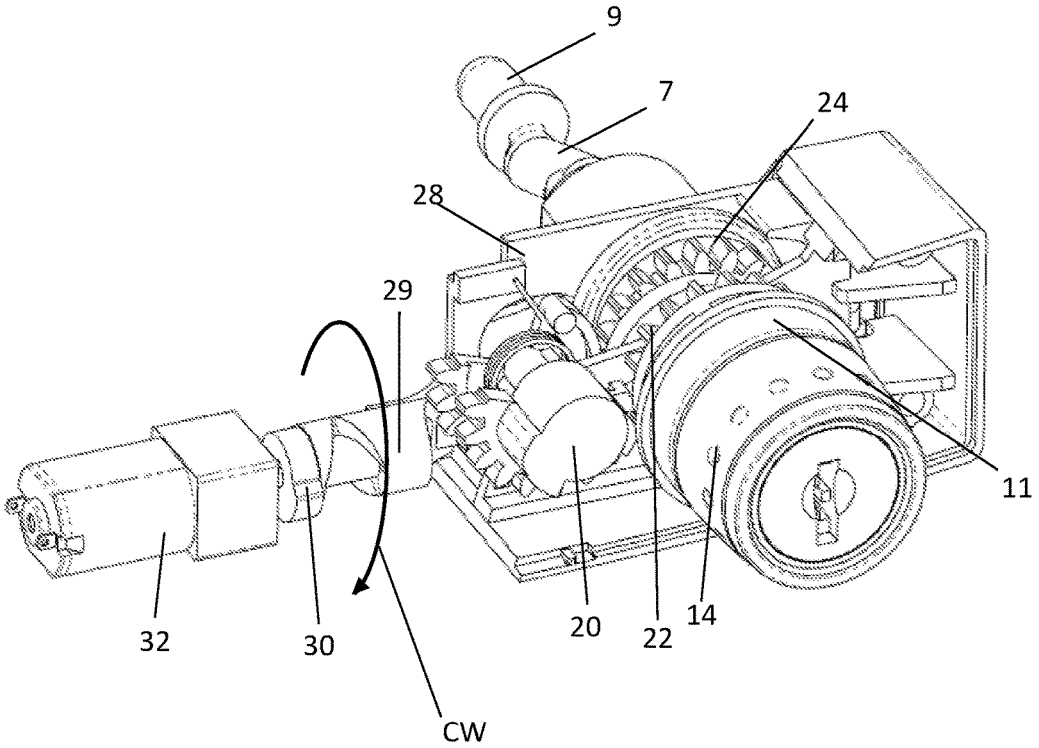
Figures 4, 8:
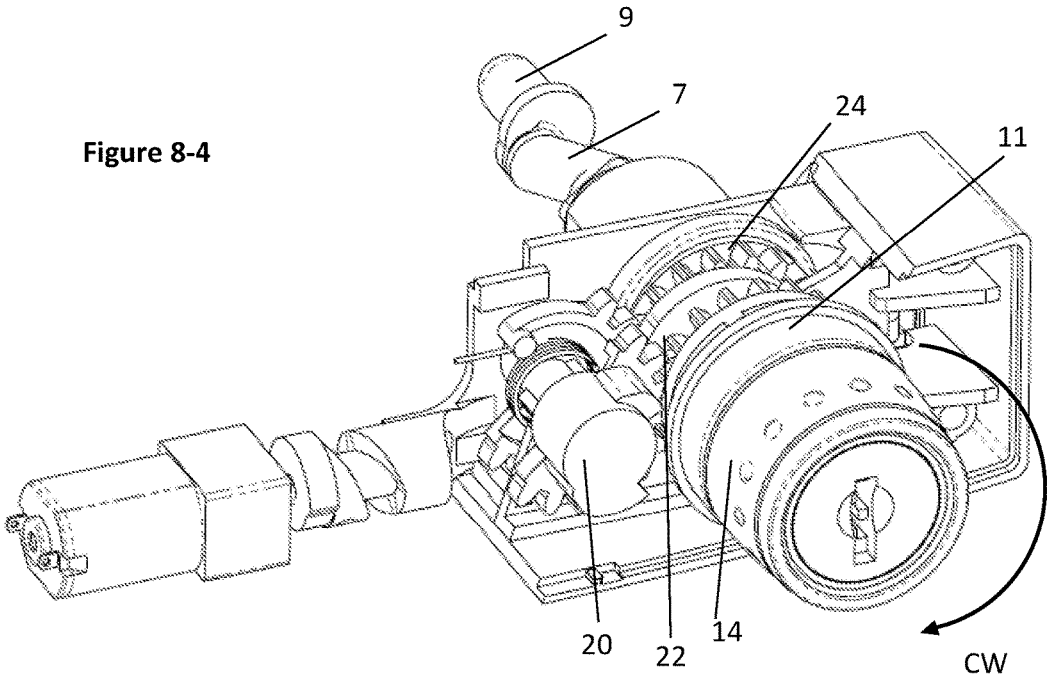
Figures 5, 8:
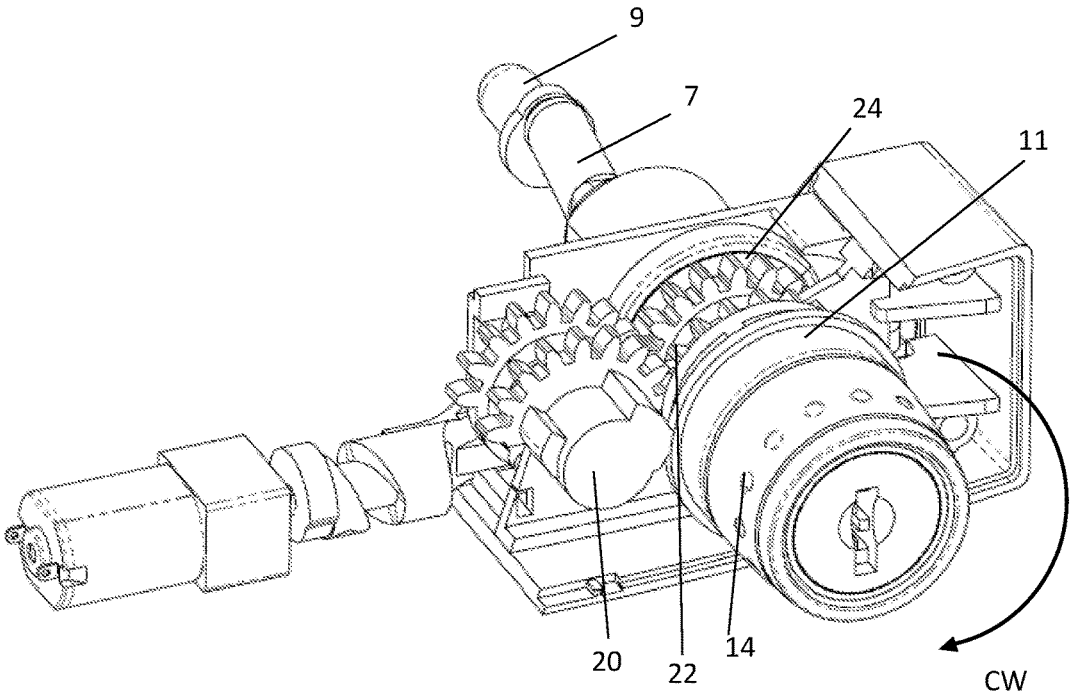

The electronic lock 1 is initially in the locked state as shown in FIG. 8-1. The torsion spring 27*a* biases the gear segment assembly 20 away from the rear drive gear assembly 24 associated with the drive shaft and away from the front drive gear 22 of the front drive assembly 14*d* associated with the manual knob assembly 11. In this state, the manual knob spins freely and does not engage with the drive shaft. The slider 28 also retains the drive shaft in a fixed position so that it cannot rotate when the lock is in the locked position.

Step 1

The user enters a pass code on the keypad which is validated by the microcontroller against the data stored in the database. The data includes a pass code and other pre selected information, for example, the time of day. If the pass code is valid, then power is applied to the motor to engage the gear segment assembly to engage the manual knob assembly with the drive shaft.

Step 2

FIG. 8-2 shows the assembly as the motor 32 begins to rotate. As power is applied to the motor 32, the motor 32 and collar cam 30 rotate in a clockwise direction. The collar cam moves the slider 28 which engages the gear segment assembly 20 with drive gears 22, 24*a* (to connect drive assemblies 14*d*, 24) and unlocks the drive shaft to allow manual rotation.

FIG. 8-3 shows the assembly with the various gears fully engaged and the manual knob assembly is ready for manual rotation.

Step 3

Once the gear segment assembly 20 is engaged with both drive gears 22, 24*a* (e.g., the gear segments from the rear drive gear assembly 24 and the front drive assembly 14*d* associated with the manual knob assembly 11), the user can now turn the manual knob assembly 11 to open the locking assembly (for example, a locking bar assembly) in the storage unit. FIG. 8-4 shows the electronic lock assembly as the user commences rotation of the manual knob assembly 11.

FIG. 8-5 shows the lock in the fully opened position after the manual knob assembly has been turned 180°.

Closing the Lock

FIG. 7-2 shows the steps to close and lock the electronic lock.

FIG. 8-5 shows the lock in the fully opened position.

Step 1

Figure 9:
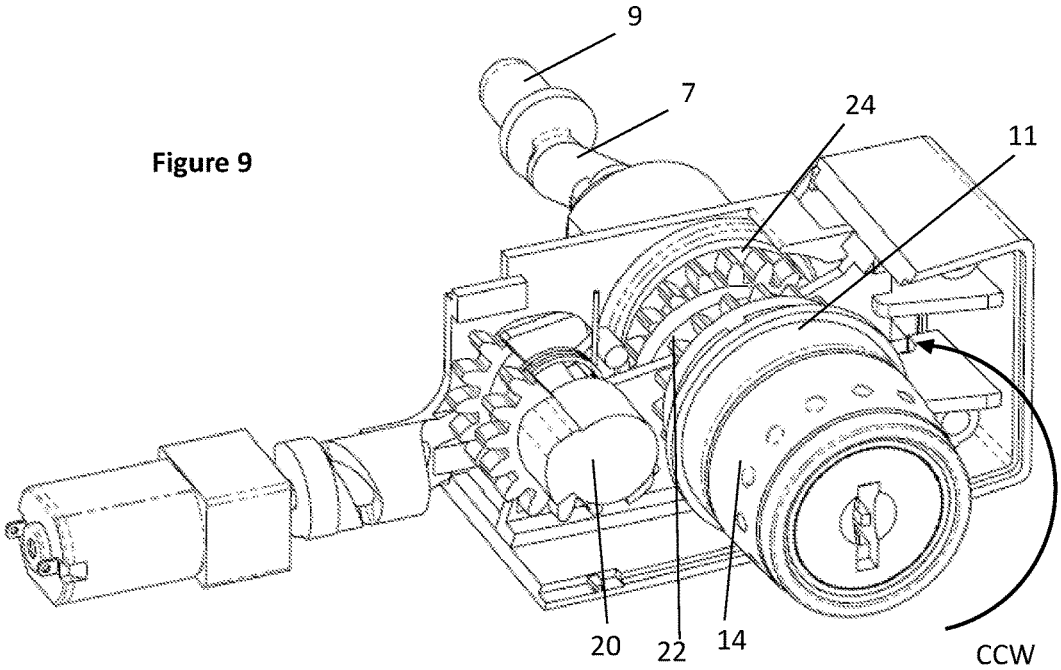
FIG. 9 shows a partial interior view of the illustrated embodiment of the Electronic Lock as the user begins the locking operation.

The user then closes a drawer or door (not shown) on the storage unit (for example, in a furniture cabinet) and turns the manual knob assembly 11 through 180° in a counter clockwise direction. This action is shown in FIG. 9.

Step 2

As the user continues to turn the manual knob assembly 11 fully through 180°, the gear segment assembly 20 disengages and falls away and is biased away by the torsion spring 27*a*. In Step 2, the electronic lock is in the fully locked position shown in FIG. 8-1.

FIGS. 4-2, 4-3 and 16 show a preferred embodiment of the microcontroller circuit components, including: microcontroller 78, DC geared motor 32, keypad 15 with LED lights, LiPo battery 33, USB port 17, microSD memory card 80, a battery charging circuit and a voltage regulator 87, real-time clock 72, coin cell battery 74, three micro switches 82, 84, 86. Optionally the circuit components also include an RFID/NFC antenna within the keypad 15 and an RFID/NFC Circuit.

FIGS. 4-2 and 4-3 show the placement of the microcontroller circuit components within the electronic lock housing frame 3*a*. The placement of the micro switches 82, 84, 86 is also shown in these figures.

Figures 1, 19:
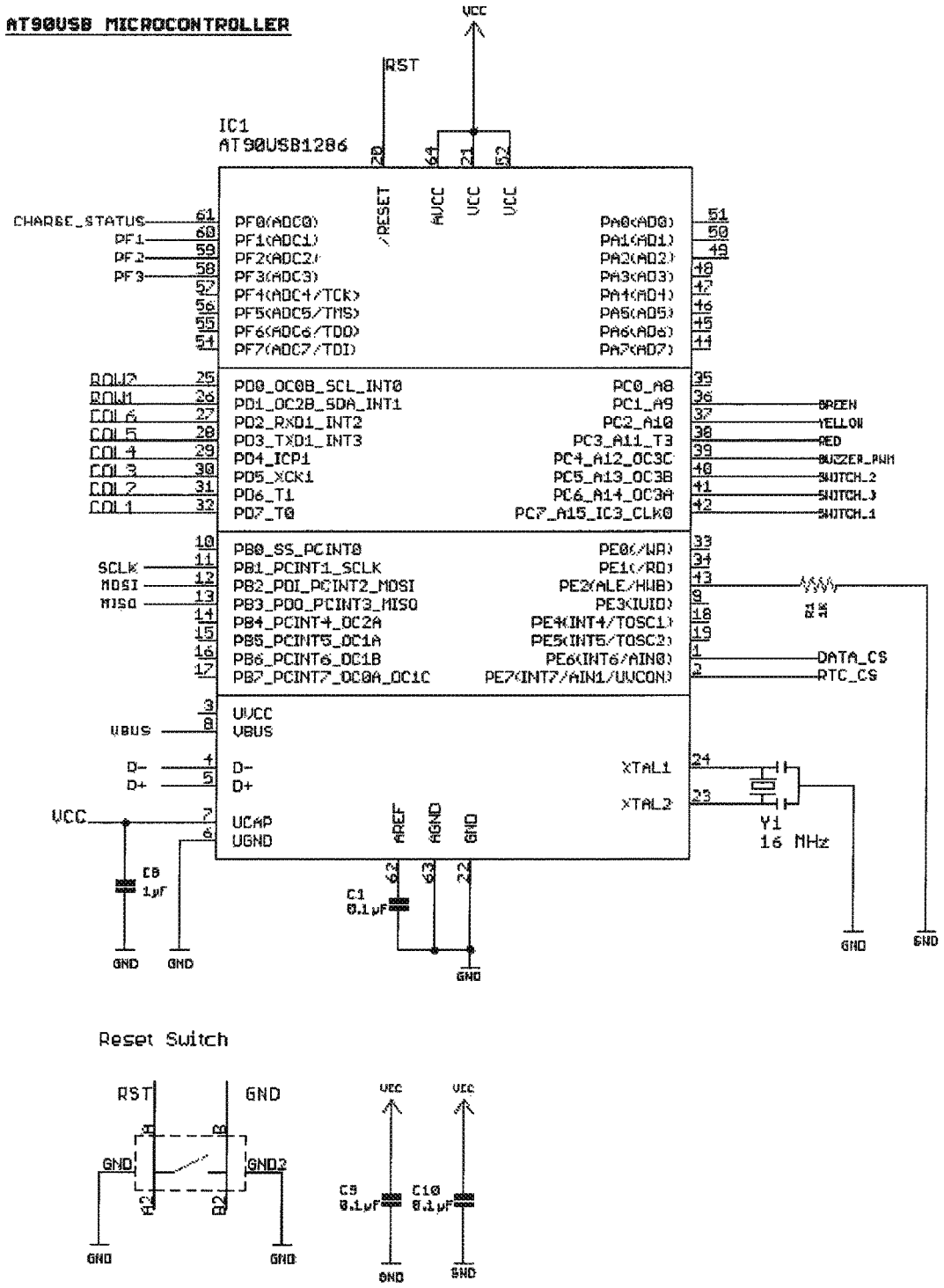
Figures 4, 19:
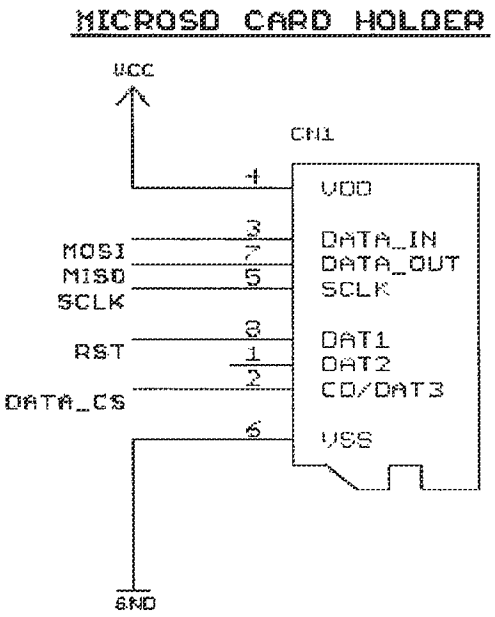
Figures 3, 19:
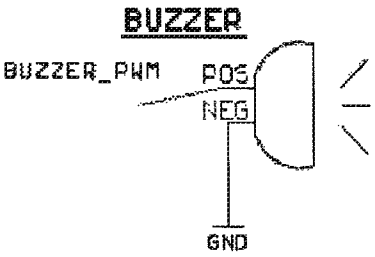
Figures 2, 19:
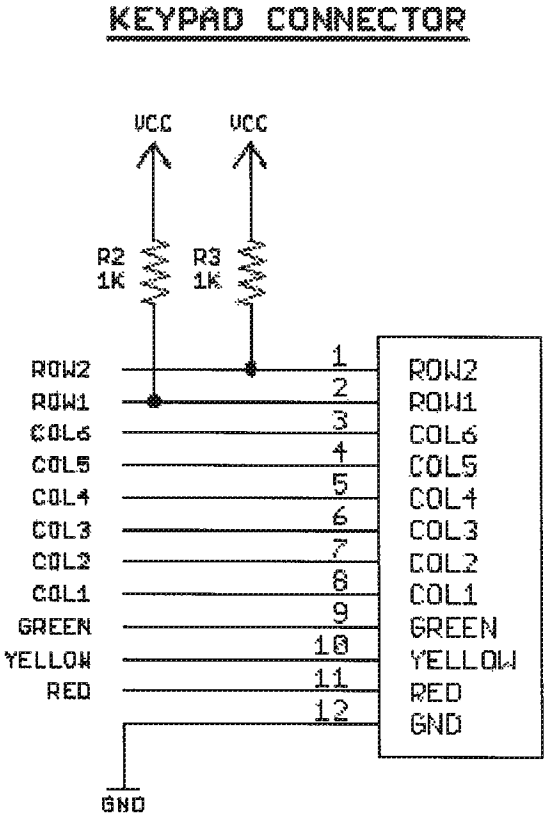
Figures 5, 19:
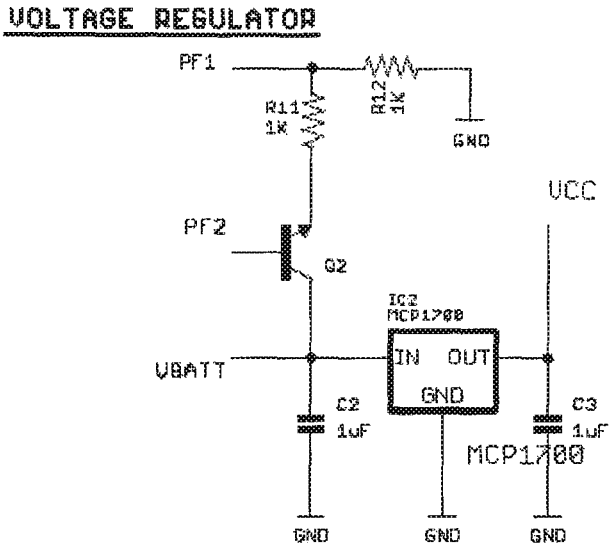
Figures 6, 19:
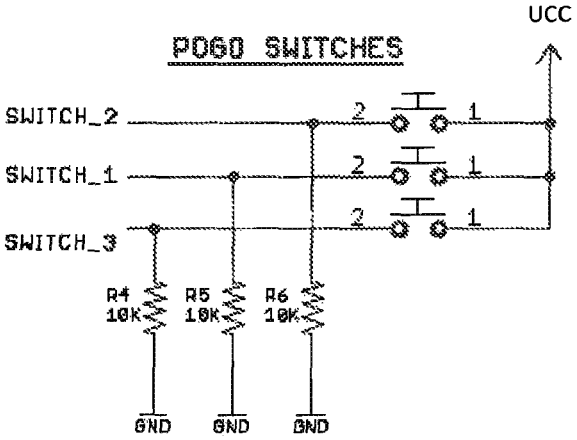
Figures 7, 19:
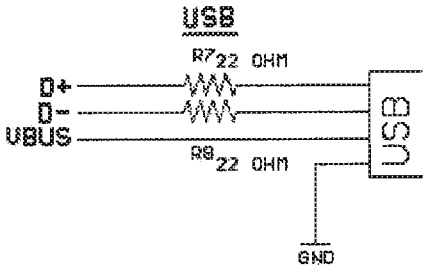
Figures 8, 19:
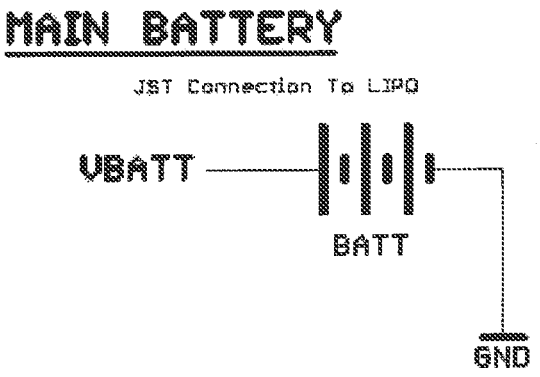
Figures 9, 19:
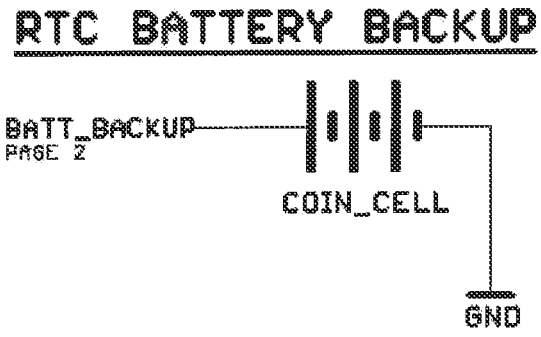
Figures 11, 19:
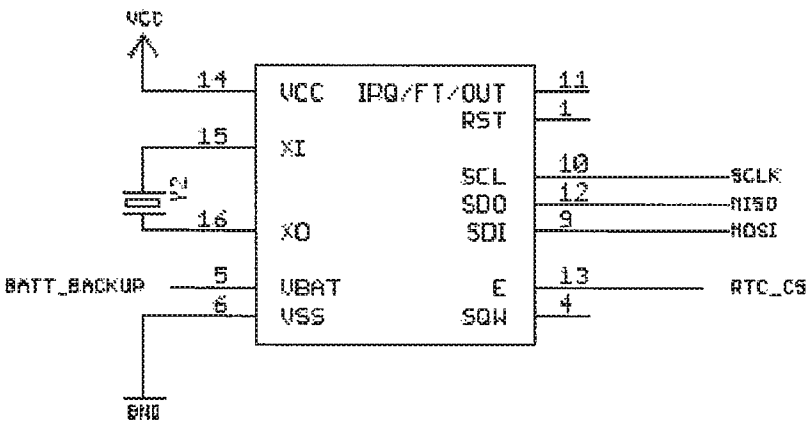
Figures 10, 19:
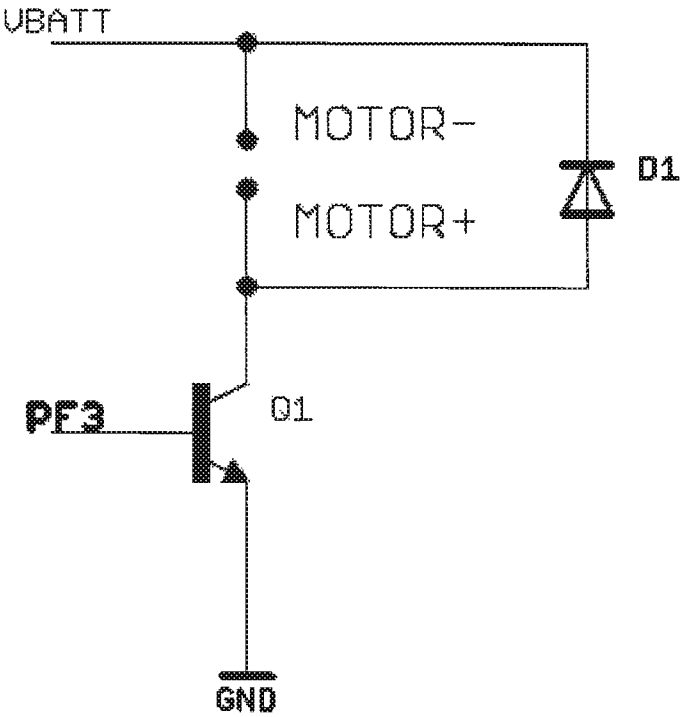
Figures 12, 19:
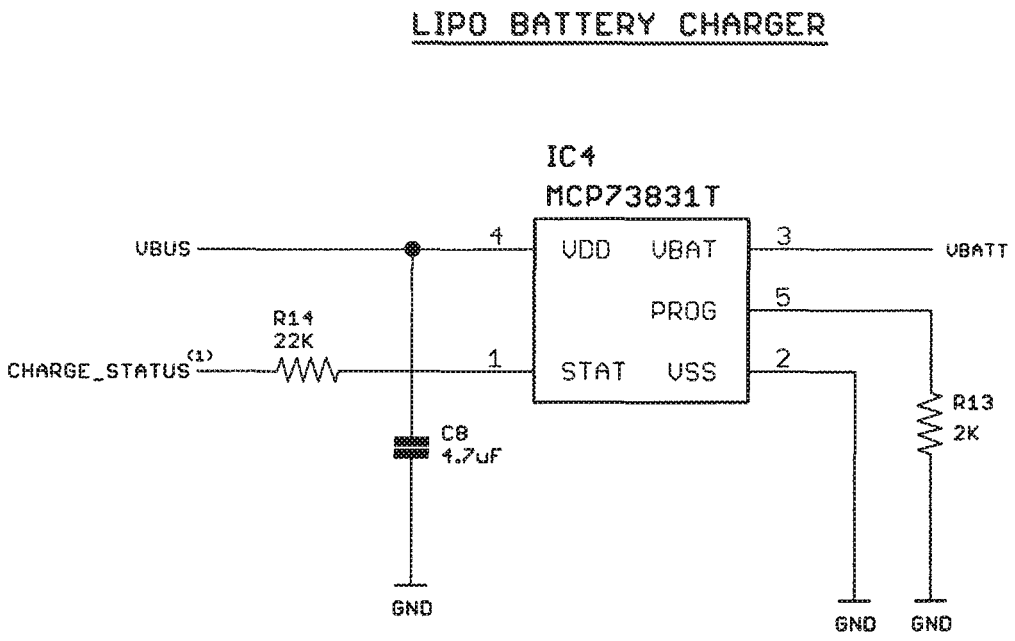

FIGS. 19-1 to 19-12 illustrate a suitable set of microcontroller schematics for an AT90USB microcontroller 78, keypad connection, buzzer 76, microSD memory card 80, voltage regulator (included in part 87), three micro switches 82, 84, 86, USB port 17, a main LIPO battery 33, a real-time clock battery 74, motor driver, real-time clock 72 and LiPo battery charger (included in part 87) for use in an electronic lock of the present invention.

Preferably, motor 32 is a relatively low cost, DC geared, small rotary motor used to rotate the collar cam 30 which in turn engages the gear segment assembly 20 and moves the slider 28 as described in more detail above. A DC geared rotary motor may be selected for one or more of the following reasons: (i) a rotary motor design may save space over several other motors alternatives; (ii) a geared motor may provide relatively high torque from a smaller motor; (iii) often, it will maintain its state without additional power; (iv) it may operate within a range of 3.0 V (or lower) to 5 Volts which means that power does not have to be regulated when used with a LiPo Battery; and (v) it may be configured for relatively low power consumption resulting from a relatively low power requirement and a relatively short duration of usage per operational cycle.

Preferably, the gear reduction is about 100:1 but other reductions such as 50:1 and 150:1 may also be used. A preferred DC geared rotary motor will allow voltage input over a 3-6 Volt range which would allow the motor to be attached directly to the LiPo battery, thus bypassing or avoiding a need for the voltage regulator.

As described in more detail above, each 180° turn with the shaft attached to the motor toggles the advanced/retracted position of the slider and gear segment assembly, thereby allowing the user to turn the knob barrel and open the lock.

Power from the LiPo battery 33 is applied to the motor 32 to accomplish each 180° turn of the shaft. In the preferred embodiment, each turn of the shaft (which is accomplished by human power) requires power to be applied for only approximately 0.25 seconds. For each full use cycle of the lock (corresponding to opening and closing the lock), the motor shaft will have accomplished two 180° turns over approx. 0.25 sec intervals each, totaling 360° and approximately 0.5 sec of power being applied from the LiPo battery. For each full open and close cycle of the lock, power usage will total approx. 0.004 mAh, or 0.00057% of the usable power capacity of the LiPo battery.

Table 1 contains a list of preferred parts for the circuit board of the preferred embodiment.

TABLE 1

Preferred Parts List for Circuit Board of the Preferred Electronic Lock

| Qty | Reference | Value | Source | Part # |
|---|---|---|---|---|
| 5 | R1, R2, R3, R11, R12 | 1K Ω | Digi-Key | P1.0KJCT-ND |
| 3 | R4, R5, R6 | 10K Ω | Digi-Key | P10KJCT-ND |
| 2 | R7, R8 | 22 Ω | Digi-Key | P22JCT-ND |
| 1 | R9 | 22K Ω | Digi-Key | P22KJCT-ND |
| 1 | R10 | 2K Ω | Digi-Key | P2.0KJTR-ND |
| 3 | C1, C9, C10 | 0.1 μF | Digi-Key | 445-4964-1-ND |
| 3 | C2, C3, C8 | 1.0 μF | Digi-Key | 587-1231-1-ND |
| 2 | C6, C7 | 4.7 μF | Digi-Key | 445-7395-1-ND |
| 1 | IC1 | Atmel AT90USB1286 (VQFN) | Digi-Key | AT90USB1286-MURCT-ND |
| 1 | IC2 | [MCP1700] LDO Power Regulator | Digi-Key | MCP1700T3302E TTCT-ND |
| 1 | IC3 | [M41T93]-SPI RTC with Batt. Backup | Digi-Key | 497-6303-2-ND |
| 1 | IC4 | Li—Po Charging IC-MCP73831 | Digi-Key | MCP73831T-2ACI/OTCT-ND |
| 2 | Q1, Q2 | Transistor-NPN type | Digi-Key | ZXTN07012EFFCT-ND |
| 1 | D1 | Snub Diode | Digi-Key | SMD1200PL-TPMSCT-ND |
| 1 | Y1 | 16 MHz Resonator | Digi-Key | 490-1198-1-ND |
| 1 | Y2 | 32 Khz Crystal-12.5 pF | Digi-Key | XC1195CT-ND |
| 1 | X1 | USB Port Micro-Type AB | Digi-Key | A97799CT-ND |

TABLE 1-continued

Preferred Parts List for Circuit Board of the Preferred Electronic Lock

| Qty | Reference | Value | Source | Part # |
|---|---|---|---|---|
| 1 | BATT | 2 mm spacing R/A SMT JST Connector | Digi-Key | 455-1749-1-ND |
| 1 | CN1 | microSD socket | Digi-Key | 101-00303-68-2-ND |
| 1 | CN2 | 12-pin SMT/ZIF connector (0.5 mm pitch) Horizontal Mount, Bottom Contact type 1-1734592-2 | Digi-Key | A100283TR-ND |
| 1 | SW2 | Pogo Switches | Digi-Key | CKN10231CT-ND |
| 2 | SW1, SW3 | Pogo Switches | Digi-Key | CKN10230CT-ND |
| 1 | COIN_ CELL | 3 V Coin Cell-SMT | Digi-Key | P279-ND |
| 1 | BUZZ | Buzzer | Digi-Key | 102-1153-ND |
| 1 | SW Reset | Reset Switch | Digi-Key | P80465CT-ND |

Many electronic locks use AA or AAA batteries which are physically large. In other cases, small LiPo, coin cell, or other batteries are used but they are not re-chargeable. Although these battery types may be used in other embodiments of the invention, they are not preferred.

The preferred design includes a microcontroller which is powered by Lithium Ion Polymer (LiPo) battery. Preferably, the battery is rechargeable. The preferred battery is a Tenergy 852045 with a capacity of 700 mAh, although batteries of different types and capacities may be used as a matter of design choice. Although it is not an essential requirement, the preferred 700 mAh capacity will in certain embodiments provide between about 7-12 months of normal operating usage on a single battery charge.

Preferably, the battery 33 has low-discharge circuit protection. This type of circuit protection will cut-off power flow from the battery if the battery voltage approaches a level low enough to damage the battery 33. Persons skilled in the art will appreciate that this type of circuit protection is important when the battery charge level is relatively low (e.g., if the filing cabinet is left locked for a long period of time). The power flow will be cut-off so that the battery may be re-charged, without damage to the battery, or without the need for replacement of the battery.

When the battery is no longer able to hold a sufficient charge (for example, approx. 700 mAh in the preferred example) then a user may replace the battery by (i) providing a supplemental power supply via the USB Port to open the lock, (ii) removing the electronic lock from the furniture, (iii) removing the back plate, (iv) disconnecting the battery from the electrical leads, and (v) re-installing the new battery within the electronic lock and the electronic lock secured in the storage unit (for example, office furniture). Optionally, a trap door may be provided in the housing to access the battery without having to remove the lock from the furniture. This trap door may be optionally secured so that the door is opened by entering commands on the keypad.

Preferably, a voltage regulator is used to maintain the voltage at a constant 3.3V for the microcontroller. A low-dropout or LDO voltage regulator (MCP1700) may be used because it can operate with a very small input-output differential voltage. The advantages of a low dropout voltage will often include: (i) a lower minimum operating voltage, (ii) a relatively higher efficiency of operation and (iii) relatively lower heat dissipation. The regulating process is preferred to step down the voltage coming from the battery which may vary between about 3.2V to 4.2V and the USB power which may operate at about 5V.

In the preferred embodiment, the lock includes a self-containing charging mechanism and as such does not require an auxiliary charger for the battery. The preferred circuit board includes a preferred LiPo charging integrated circuit (shown in FIG. 19-12), which safely charges the LiPo battery from power sources provided to it through the USB Micro-A Port (preferably 5V rated up to 500 mA). Preferred power sources include a USB power charger, computer or battery powered USB device. In addition, the circuitry may be easily adaptable to allow charging from other sources, such as by way of example, solar charging cells. Other power sources and connection ports may be used.

In the preferred embodiment, the microcontroller controls the logic of the system. The System Software is resident in the microcontroller and controls the operation of the microcontroller. A variety of microcontrollers may be used as a matter of design choice. However, the ATMEL AT90USB1286 was selected in the preferred embodiment, for the following reasons: (i) low power consumption was desired and only 3.3V are required to operate the Microcontroller; (ii) the selected microcontroller supports C and C++ languages for software applications; (iii) the microcontroller includes 8 KB of non-volatile memory which is used to store user and settings data. (Non-volatile memory is not erased due to loss of power.); (iv) the preferred microcontroller supports a microSD memory card which is desirable for extensive data logging; (v) native USB 2.0 support is included which automatically formats and copies data in memory but also supports USB connect and host mode; and (vi) the preferred microcontroller includes 2 internal timers, since two timers are desired in the preferred method of lock operation.

Data inputs in the preferred system include, data inputs from 3 micro switches, a preferred 12-button keypad and a real-time clock. Optional inputs are received from the RFID/NFC antenna.

In the preferred embodiment, the System Software controls the operation of the DC geared motor, buzzer and 3 LEDs. Optionally, the System Software controls the RFID/NFC circuit.

Preferably, the System Software reads and writes data records to the microSD memory card. Preferably, it also enables access to these data records when a computer or USB device is connected via the USB port (or other data port).

Preferably, the System Software maintains a User Database with privileges within the microcontroller EEPROM/flash memory.

During locking and unlocking processes, the System Software compares user codes inputted on the keypad to the permitted codes previously entered in the User Database to limit/control access to the electronic lock.

Although other data ports are available, a USB type port is preferred. The most preferred USB port is of the Micro-A type, although Standard and Mini USB ports could also be used. The Micro-A was selected as a preferred design choice because Micro-A was believed to be (i) evolving into a future standard; (ii) more durable than Mini ports; (iii) the smallest port available and (iv) the lowest cost port available.

The USB port allows charging of the LiPo battery, and access to the data records on the microSD memory card when the USB memory mode is enabled.

Preferably, the keypad connection will accommodate a plurality of alternative keypads. With reference to FIGS. 18 and 18-1, a preferred keypad assembly will have three primary layers: keypad circuit layer, membrane, keypad and optionally an RFID/NFC Antenna.

The preferred keypad is illustrated as a 12-button matrix style membrane keypad with 3 LEDs. The preferred keypad membrane is covered with a cast rubber silicone top.

In the preferred array, the 12 buttons include digits 0-9, an enter key, and a program key. These buttons allow all desirable user controls of the lock, such as for example, inputting user codes to access the lock, setting system variables like adding/removing users and muting the sound (of the buzzer or other audible alarm or warning components), and enabling system modes like the USB access mode of the system's microSD memory card.

Preferably, the real-time clock provides the calculation of UNIX Standard Time. UNIX Standard Time is preferred to date stamp and time stamp entries in the Database. Preferably, the real-time clock has two alternative power sources: the primary LiPo battery 33 and its own battery backup 74 in the event that the main battery 33 loses power. Preferably, a coin cell type battery 74 is used as a battery backup and under ideal conditions may provide about 2.5 years of backup power to ensure accurate timekeeping/data storage.

Preferably, the circuit board includes a microSD memory card for data storage. However, it will be understood that alternative storage systems, including memory cards of any size may be used. In a preferred embodiment, approx. 128 MB of storage space will, ideally, provide storage for up to 350,000 log file entries (e.g., lock openings or closings). Preferably, once the database is full, the System Software will manage the available storage space and delete the oldest records first so that up to 350,000 of the most recent actions are maintained in storage.

In the preferred embodiment, a buzzer 76 provides audible sounds corresponding events such as command success signals or command failure signals and key entry signals. The buzzer may be optionally disabled or enabled.

Figures 1, 17:
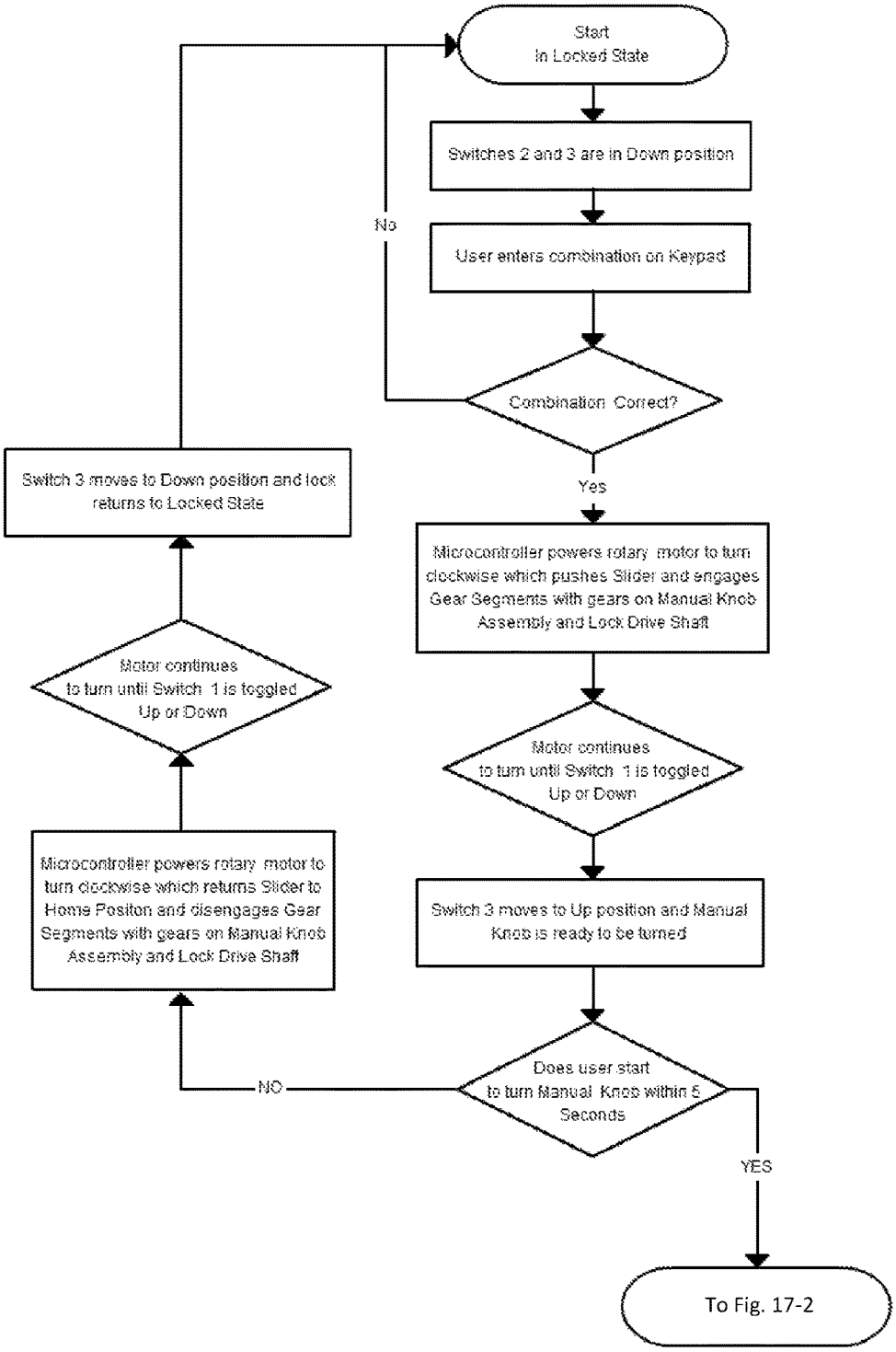
Figures 2, 17:
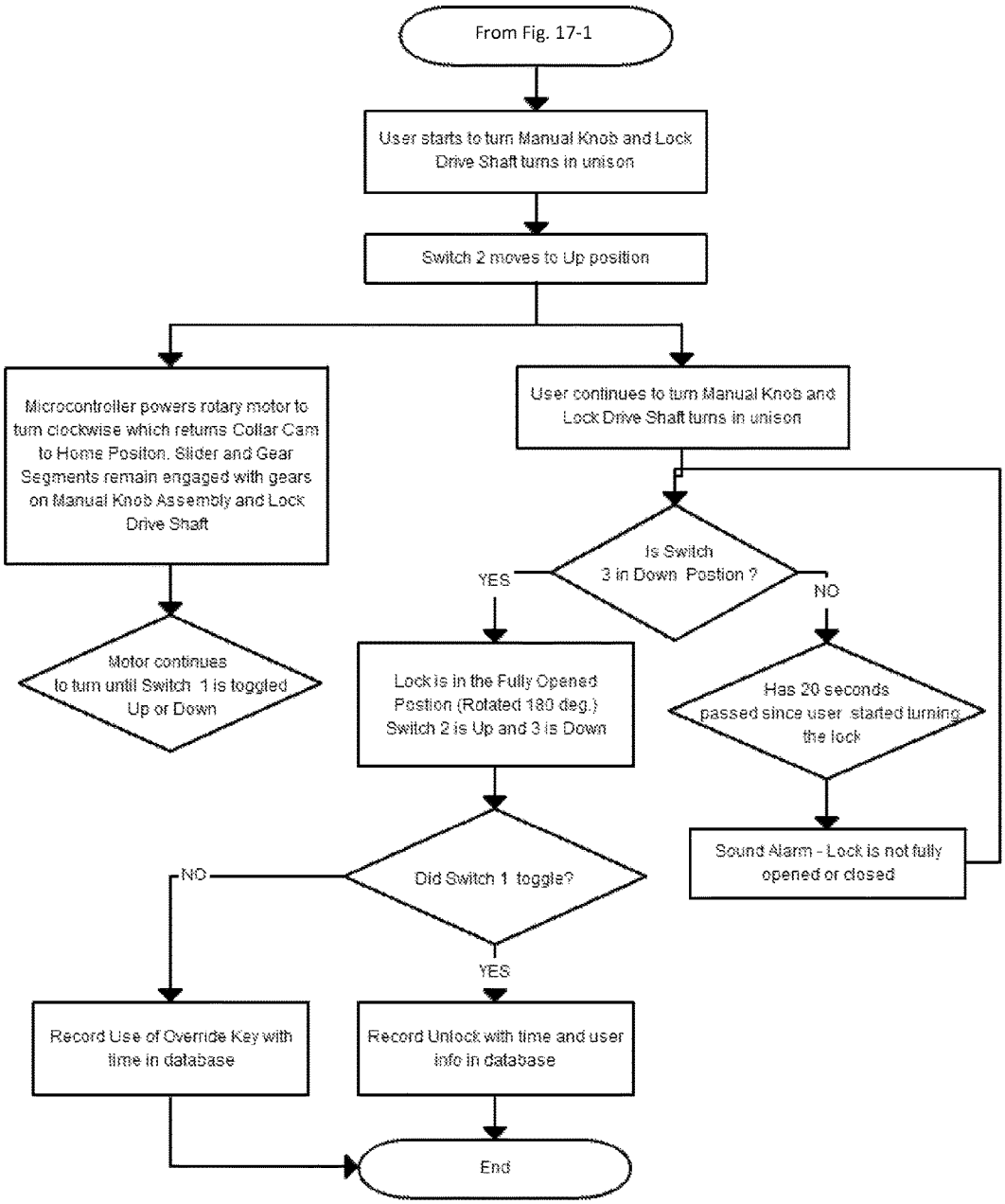
Figures 3, 17:
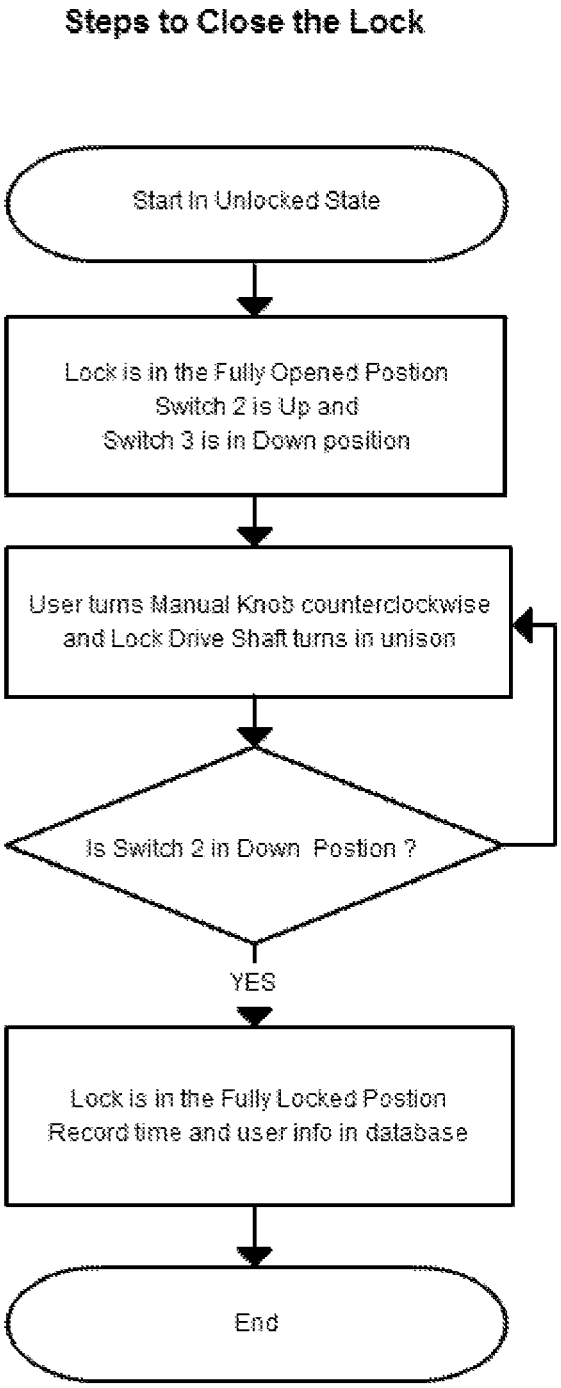

Micro switches 82, 84 and 86 are used by the System Software to manage the processes of opening and closing the electronic lock. In FIGS. 17-1 and 17-2 the preferred Software process of opening the lock is described with the operation of the micro switches 82, 84 and 86. FIG. 17-3 shows the steps to close the electronic lock. FIGS. 4-2 and 4-3 show the three micro switches on the circuit board 40.

Micro Switch 82 ensures that the rotary motor 32 turns precisely through 180° to engage and disengage the slider 28 and gear segment assembly 20. In the preferred embodiment, the rotary motor 32 always turns in a clockwise direction.

Micro switches 84 and 86 are used to detect the rotation of the gear segment assembly 20. In the preferred embodiment, these switches allow the System Software to detect: (i) when the user starts to rotate the manual knob 14, (ii) when the user completes the 180° rotation and the lock is open, (iii) if the manual knob is partially turned but not turned sufficiently to completely open the lock, (iv) when the lock is closed and locked, (v) and if the lock drive shaft is turned and the keypad was not used (i.e., if the manual override key was used).

Figure 21:
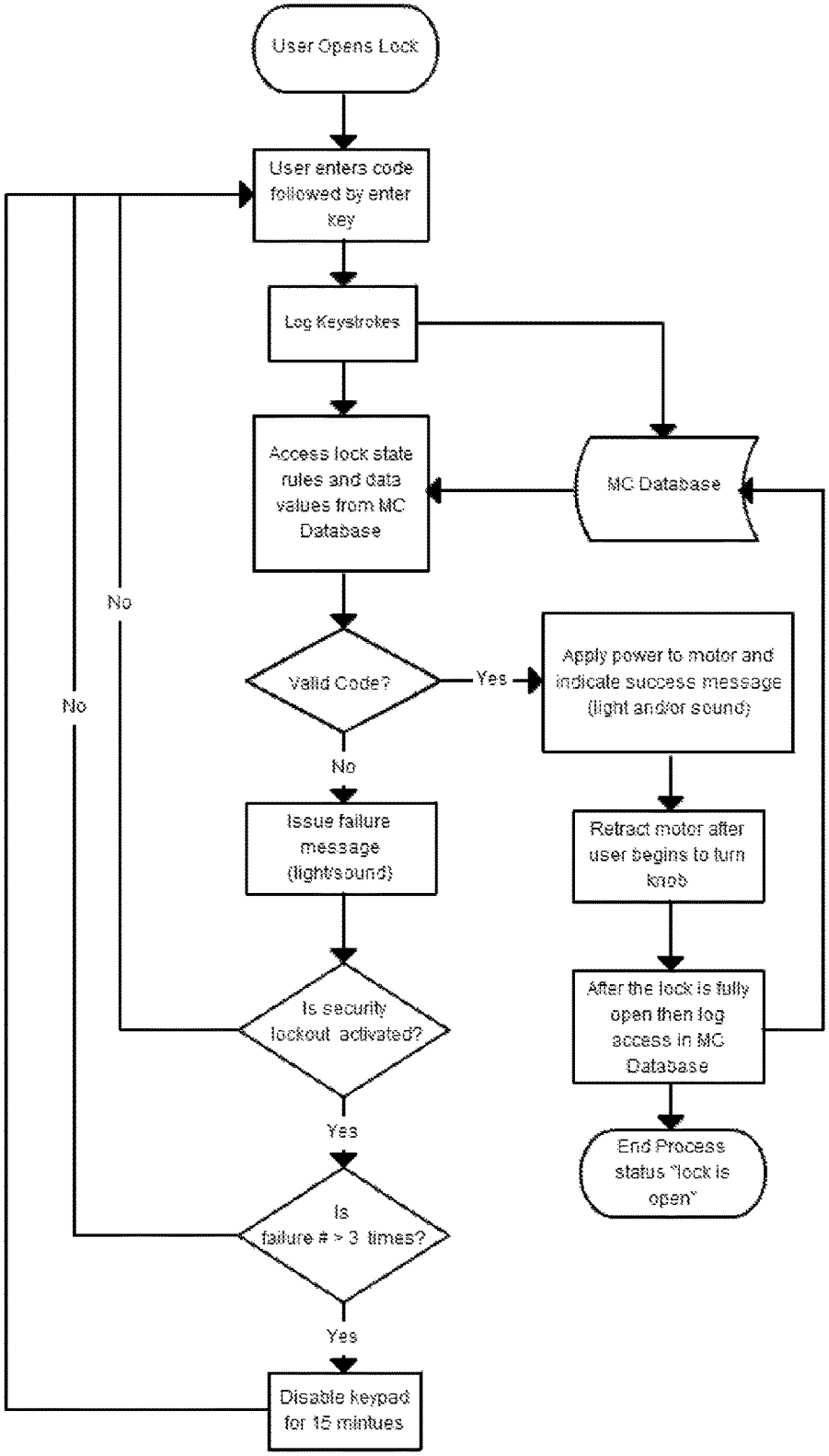
FIG. 21 is a flowchart illustrating an example of a method of operating an electronic lock of the present invention.

FIG. 21 illustrates a flowchart of the operational steps of the preferred System Software used to control the operation of the electronic lock. As the user enters a passcode or other data on the keypad, the System Software logs each keystroke and stores the key sequences in the database for an audit trail.

To validate a passcode, the microcontroller 78 accesses the database files to determine valid user codes and any rules and data values that have been applied or placed into effect for the electronic lock. For example, the lock may be set to be opened only for a specified period of time, during a limited time, during certain days. In some embodiments, other limitations and rules may be programmed into the System Software and the microcontroller 78.

The optional behaviors of the lock during the opening and closing process may be programmed for control by rules and data values entered into the System Software. For example an optional audible sound may be given for success messages and failure messages. In another example, a prescribed security time lockout may be activated if a passcode is incorrectly entered a specified number of times (for example, 3 incorrect entries).

Preferably, the System Software also records the user information, date and time when the lock was opened, failed attempts to open the lock, and the date and time that the lock was locked. Preferably time is recorded in Standard UNIX Time.

Figure 22:
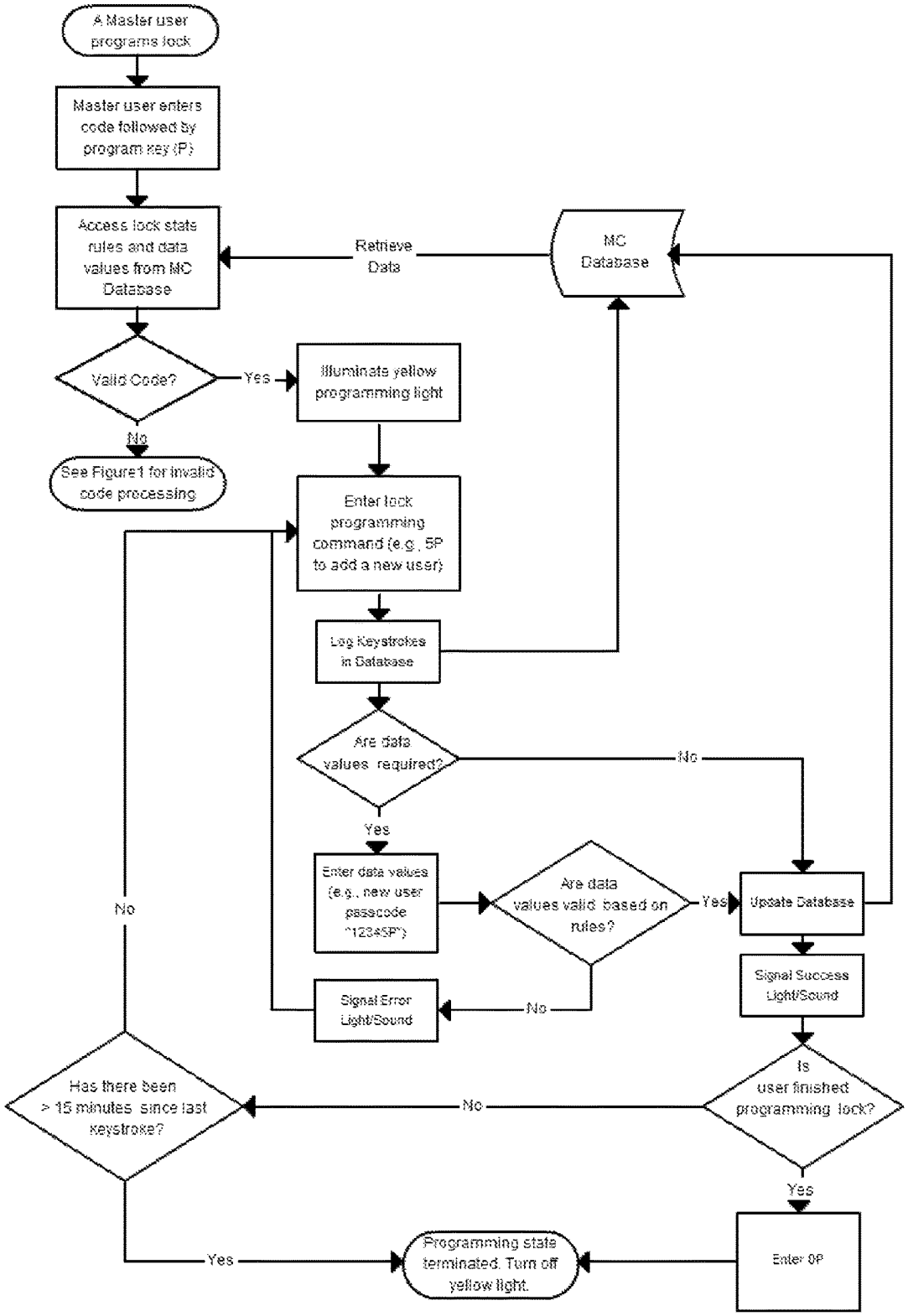
FIG. 22 is a flowchart illustrating an example of a method of programming the operational steps of an electronic lock of the present invention.

FIG. 22 illustrates a flowchart of the operational steps of the preferred System Software which controls the entry of user and master codes. Preferably, locking rules and data values may also be entered, edited and deleted through the keypad. Similar to method steps outlined in FIG. 21, the System Software preferably logs each keystroke and stores the key sequences in the database for an audit trail. Lock rules and associated data values may be stored in the microcontroller database.

FIG. 23 shows the list of preferred programming commands. As a matter of preference, programming commands are restricted to a limited number of users, preferably one of the Master Users. Regular (i.e., Non-Master) users may issue a limited number of programming commands, such as for example, to change their own passcode and to check the main battery level.

FIG. 24 shows the preferred selection of micro controller Database files for the electronic lock. These files are stored on either the microcontroller internal memory or the microSD memory card. These data files may be extracted by one of the Master Code Users for reporting and review of the electronic lock's audit trail. In the preferred embodiment, two alternative approaches may be used to extract these files: through USB Connect and USB Host.

In the USB Connect Mode, a standard USB to USB Micro-A cable (not shown) is first inserted into a laptop or other computer (also not shown) and the Micro-A connection is inserted into the USB port 17 in the electronic lock. The charging circuitry of the lock will activate and begin to charge the LIPO Battery.

After successfully entering the Master Passcode, the user enters predetermined commands, for example, '11' then followed by 'P', to activate data accessibility across the USB port. Preferably, a colored light (for example, yellow indicator light) will glow steadily when the USB data access mode has been enabled. The electronic lock's Database will show up on the computer as a mass storage drive, similar to the files presented on a USB memory stick. The user would then be able to access and copy the files onto the computer or open them with an application on the computer (e.g., Microsoft XL). Once finished, the Master User will then enter predetermined commands such as '11' and then 'P', to disable the USB data access mode and the colored indicator light will turn off.

In the USB Host Mode, a standard USB memory stick (not shown) is connected to the USB port 17 with a USB to USB Micro-A connector cable (not shown). After entering the Master Passcode, the user enters predetermined commands '13' and then 'P' to activate the USB port and the yellow indicator light will glow steadily. A green indicator light flashes as the database files are copied to the USB memory stick. The Master User then enters predetermined commands, such as '13' and then 'P', to disable the USB data access connection and the yellow indicator light turns off. The user would be able to copy the files from the USB memory stick (not shown) onto the computer (also not shown) or open them with an application on the computer (for example, Microsoft XL).

Preferably, the USB Connect Mode also allows a user, such as the Master User, upload a file containing "user privileges" (a "user privileges file") to be uploaded from a computer (not shown) connected through the USB port 17. After the Master User successfully enters the Master Passcode, the user enters predetermined commands, such as '14' and then 'P', to activate the USB port 17 in write mode. The yellow indicator light will then glow steadily when the USB mode has been enabled. The lock Database will show up on the computer as a mass storage drive, similar to the manner in which files are listed and presented on a USB memory stick. The user may then copy the user privileges file from the computer to the electronic lock drive. Preferably, a second indicator light, such as a green light, flashes as the user privileges file is being coped to the electronic lock drive. The Master User then enters the associated predetermined codes, such as '14' and then 'P', to disable the USB mode and the yellow indicator light turns off.

FIG. 6 illustrates the preferred components in the circuit board 40, including an optional RFID/NFC Antenna within the keypad and RFID/NFC Circuit.

Figure 20:
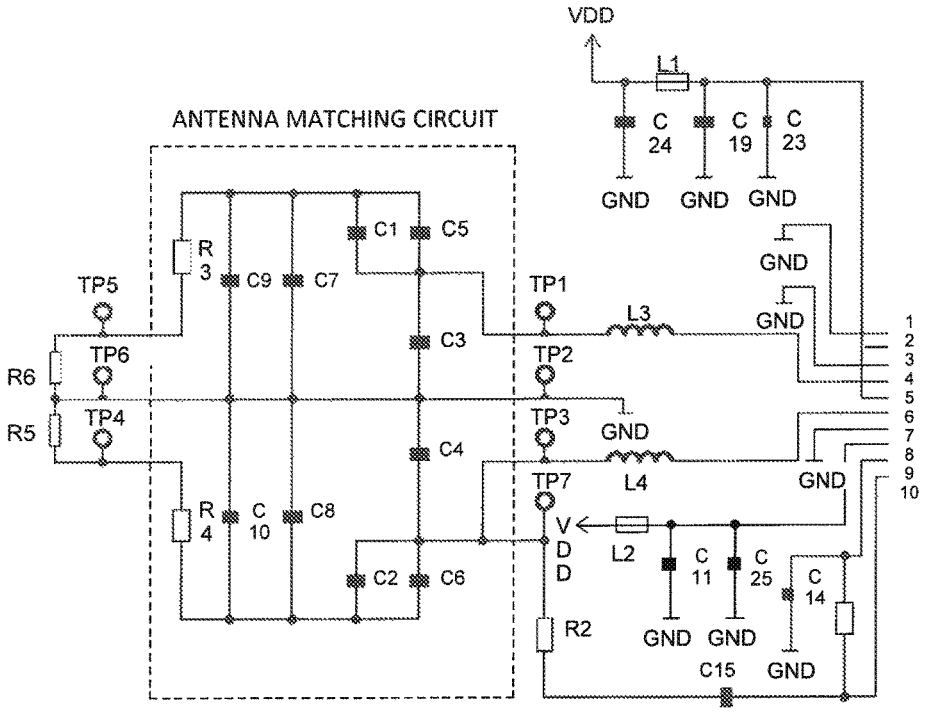
Figures 1, 20:
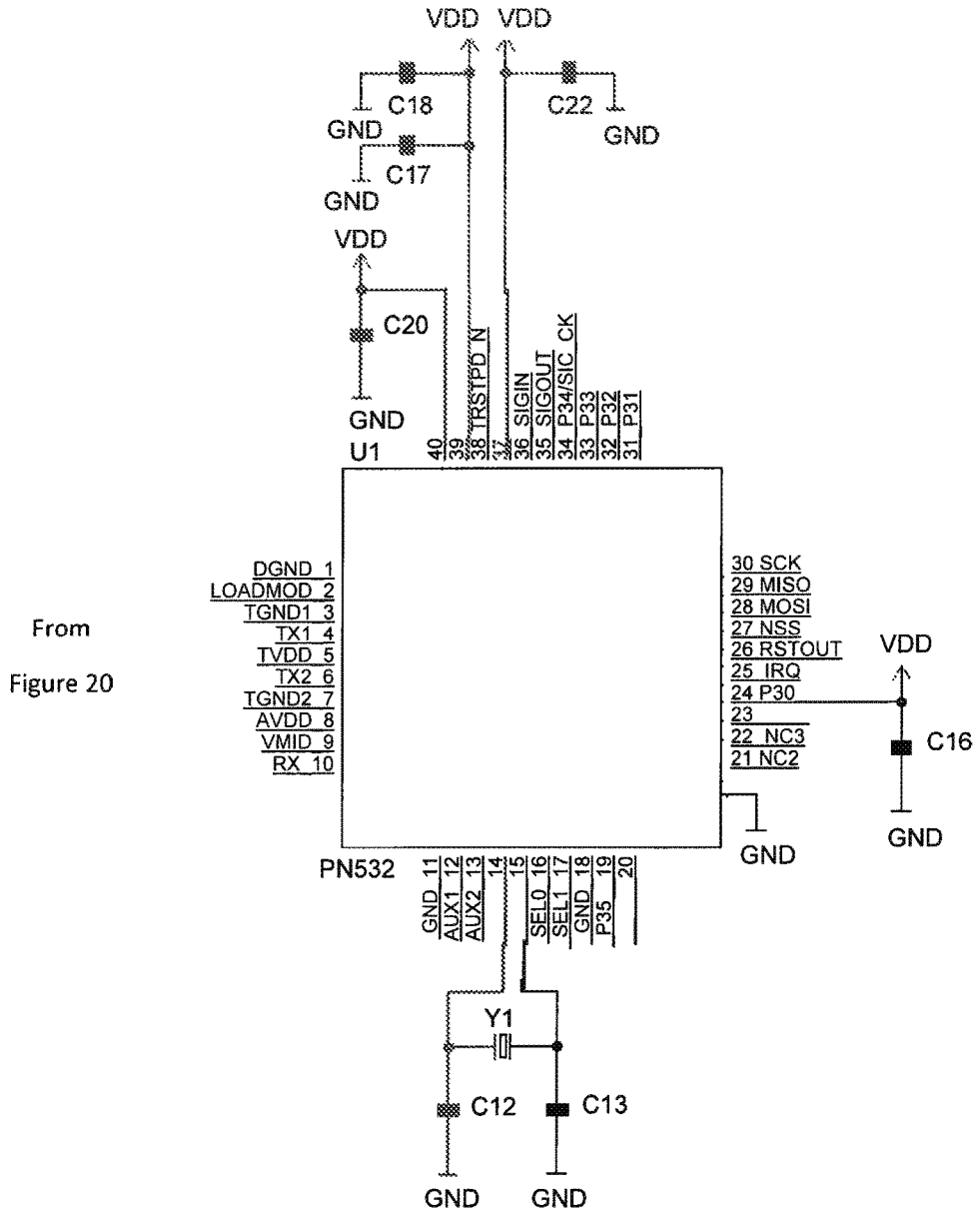

FIGS. 20 and 20-1 to 20-3 show the schematics and related component specifications for the RFID/NFC Antenna and RFID/NFC Circuit.

In the preferred embodiment, the RFID antenna may be made of a 2D coil design for a 125 kHz RFID antenna and made of printed copper onto a custom designed footprint and whose capacitor has been tuned so the read frequency is optimized to support 125 kHz RFID tags placed in close proximity to the keypad.

Preferably, the System Software supports the following RFID functions: (1) enable or disable optional RFID mode; (2) add or remove one or more RFID Tags; (3) Activate RFID mode once this function has been enabled and (4) Read RFID Tag.

Preferably, a Master User may enable the RFID mode by entering the programming mode as described above and then entering a corresponding predetermined command such as "20 P". Once the appropriate command has been accepted, RFID tags can be added. This is performed by entering another predetermined command such as "21P", followed by the step of bringing the valid RFID card or tag within proximity, typically within a few centimeters of the antenna. An indicator light, such as a green light, and an audible success sound may be programmed to notify the user if the RFID tag has been added.

Once the RFID mode is enabled and the RFID tag has been successfully added, the user having this tag may open the electronic lock by bringing the RFID tag within range of the keypad. To do this, the user will first push a predetermined command, such as the Enter button, to activate the RFID mode and then bring the tag within close proximity to the electronic lock. If the RFID tag is successfully validated, an indicator light, such as a green light and an audible success sound, will be returned and the user will be allowed to rotate the manual knob, as described more fully above, to operate the lock. Optionally, the RFID function may operate in low power mode to listen for RFID tag signal(s). This may eliminate the need for the user to press a key to reactivate the system. Once the RFID tag comes close to the antenna (e.g. within a few centimeters) the presence of an RFID tag first wakes up the system and then RFID tag is read.

NFC-enabled devices can act as electronic identity documents or keycards. As NFC has a short range and supports encryption, it may be more suitable than earlier, less secure RFID systems.

NFC is a set of short-range wireless technologies, typically requiring a distance of 4 cm or less. NFC operates at 13.56 MHz on ISO/IEC 18000-3 air interface and at rates ranging from 106 KBS to 424 KBS.

Preferably, the electronic lock is the initiator which actively generates an RF field that can power a passive target. The NFC targets to take very simple form factors such as tags, stickers, key fobs, or cards that do not require batteries. NFC Targets may also include a variety of NFC-enabled smartphones including selected models of Google Nexus, Samsung Galaxy, RIM Blackberry, Apple Phone, and many other examples of smartphones.

The operation of the electronic lock with passive NFC targets such as key fobs and cards is similar to the RFID mode as described above. Operation of the lock may also be performed from NFC-enabled smartphones in either of two modes: (i) Smart card-emulation mode allows the emulation of a contactless smart card or (ii) a Dedicated System Application saved on the smartphone which is enabled to transmit encrypted codes in a peer-to-peer mode between the smartphone and the RFID/NFC features provided on the electronic lock.

In the preferred embodiment, the System Software supports the following NFC functions: (1) enable or disable optional NFC mode; (2) Add or remove one or more NFC Targets; (3) Activate NFC mode once this function has been enabled and (4) Read NFC Tag.

In a preferred embodiment, the electronic lock is shipped with preloaded software and other information such as a unique internal serial number dedicated to each electronic lock. In the event that the Master Codes are lost for a particular device, the preferred electronic lock is provided with a secure preloaded program to execute a factory reset. This process will restore all of the lock defaults and set the master password to a known number. The preferred System Software may contain an encryption algorithm so that a unique factory reset code may be issued for each unique electronic lock Serial Number. In addition, the preloaded program may provide that this unique reset code will only be accepted by the specific electronic lock having the correct, corresponding Serial Number. The reset code may be programmed to be valid for a limited period of time as specified by the manufacturer.

An encryption algorithm may also provide a secure code combination for daily use of the lock. For example, this feature could be utilized in corporate hoteling uses where visiting employees could periodically use a free desk for a day. It could also be used for a day locker in public areas. A computer application may be provided to generate an encrypted code that would work for a specific time period or until the code is changed. The computer application may be synchronized with a specific lock so that the code will be unique to that lock.

FIGS. 25-1 to 31-3 illustrate other aspects of the electronic lock of the present invention, without the optional manual bypass feature previously described.

Figures 1, 25:
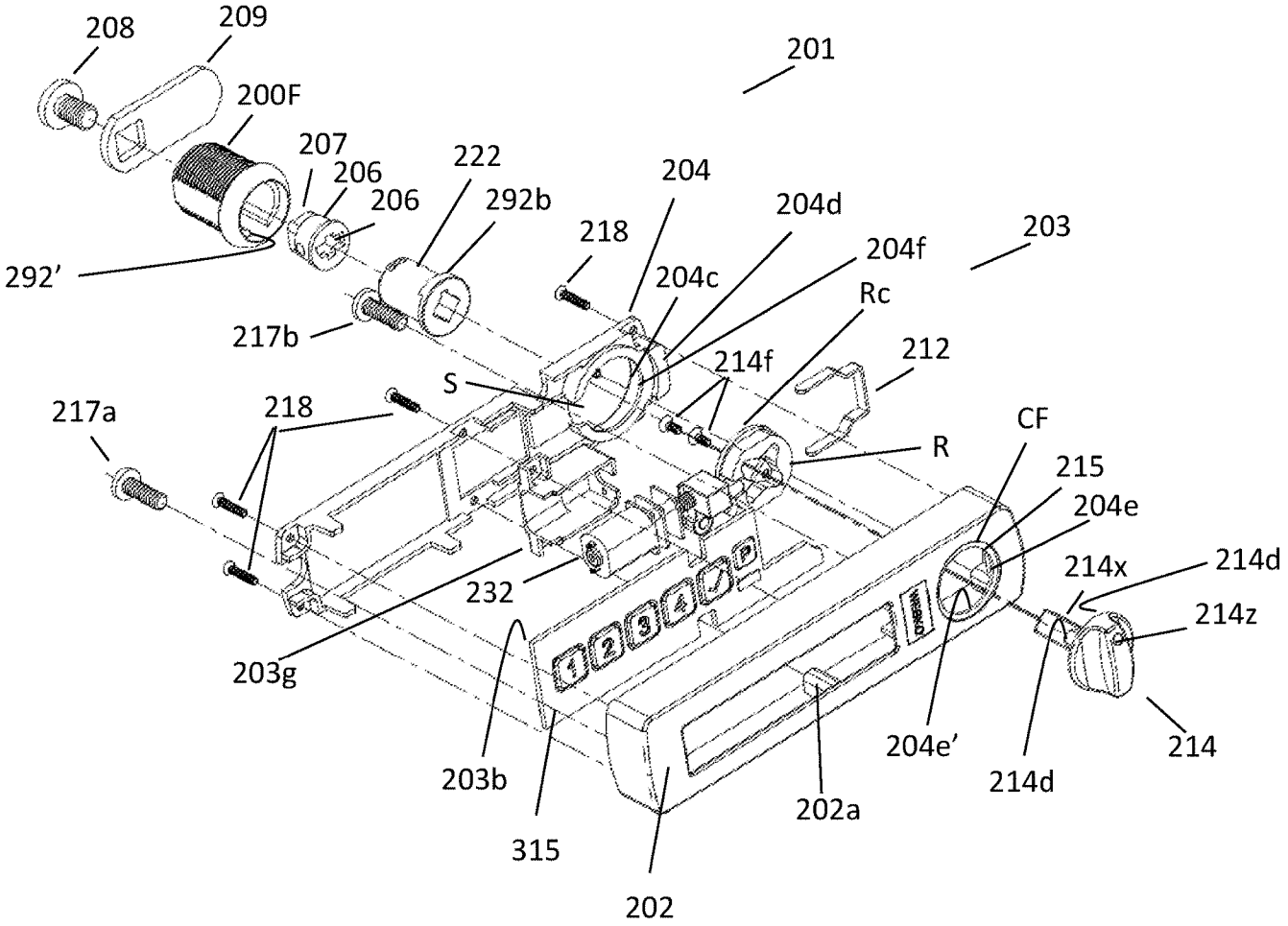
Figures 2, 25:
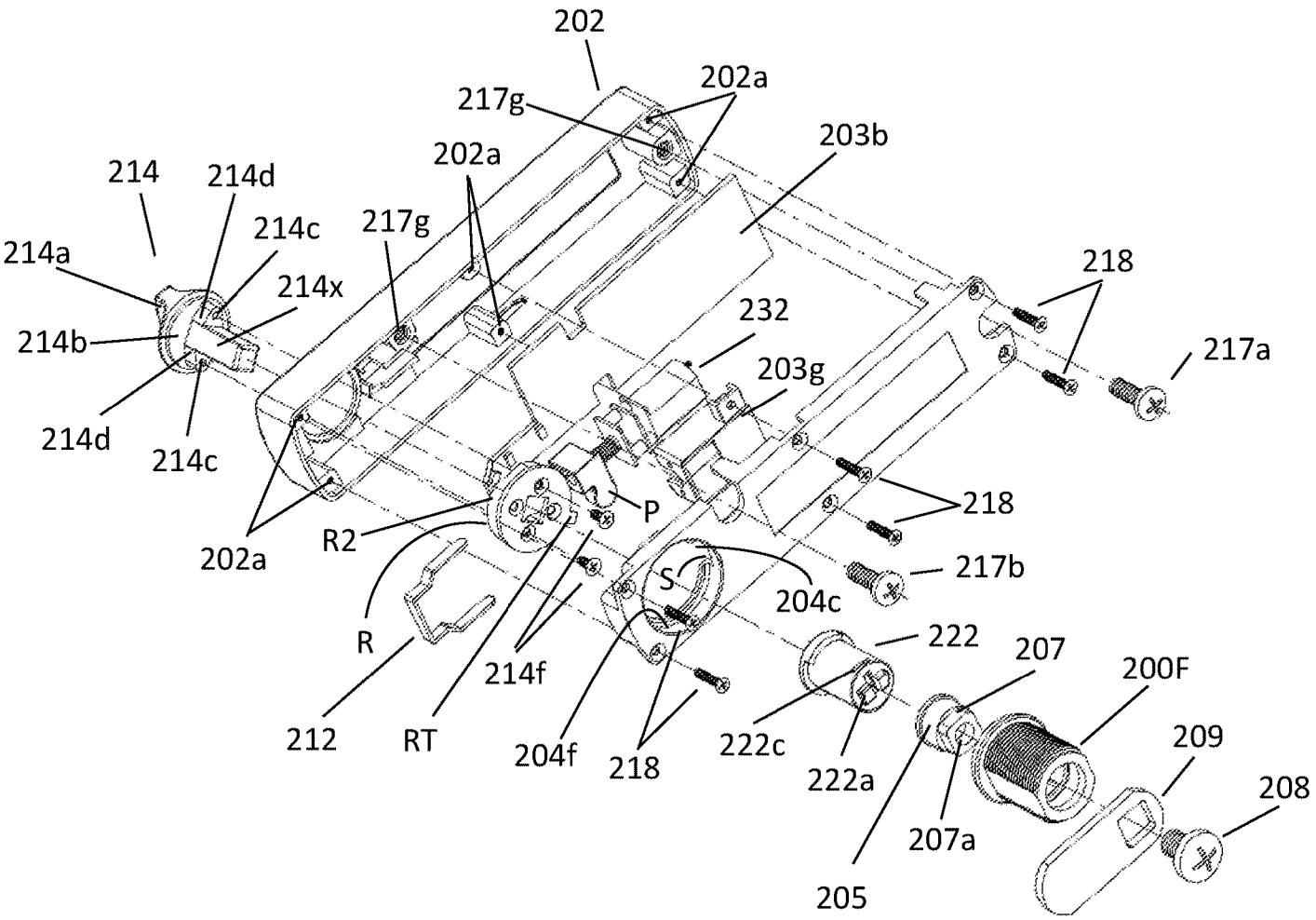
Figure 26:
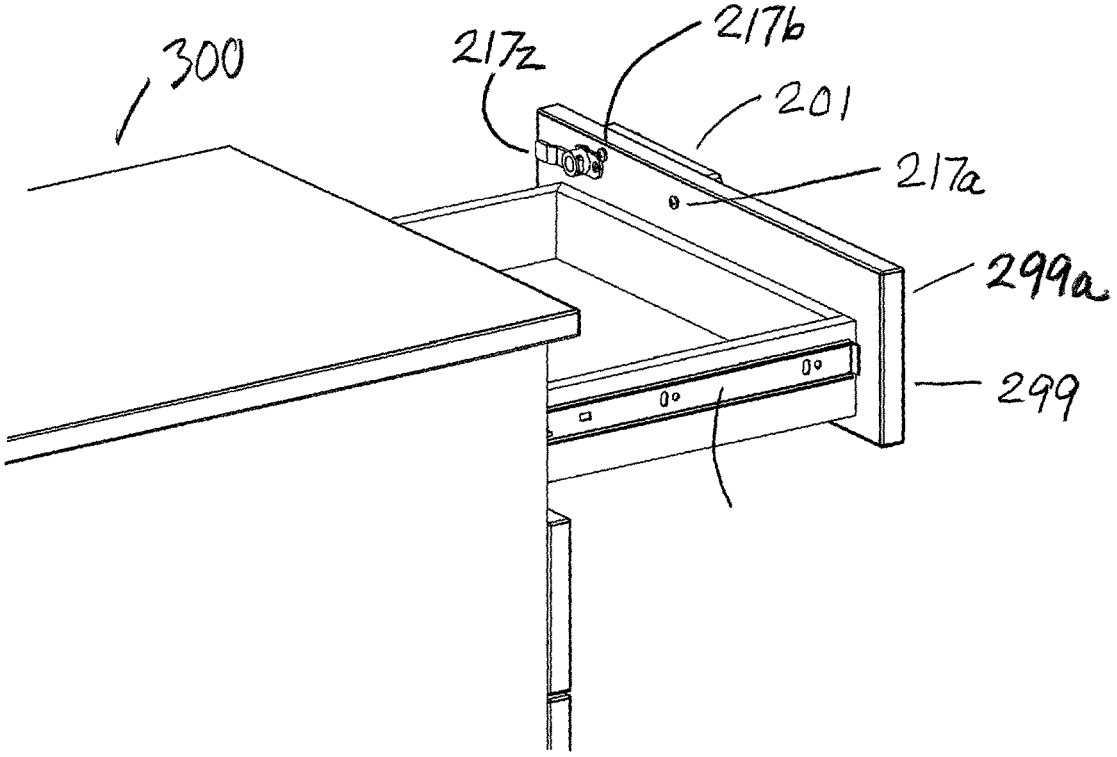
FIG. 26 is a rear view in perspective of the invention when installed in a storage structure.

For example, FIGS. 25-1 and 25-2 show another electronic lock 201 having an outer housing shell 202 configured as a protective covering for the internal components of the lock 201. The lock housing 203 includes a back plate 204 secured to the outer housing shell 202 with lock housing assembly fasteners 218 secured to corresponding threaded anchors 202*a* in outer housing shell 202. Mounting fasteners 217*a*, 217*b* are secured in threaded mounting anchors 217*g* to securely position the electronic lock 201 on the exterior surface of a storage compartment, for example, on the exterior face plate 299*a* of a drawer compartment 299, in a storage structure, for example, a multi compartment structure 300 as shown in FIG. 26. Preferably, the heads of mounting fasteners 217*a* and 217*b* are accessed from within the drawer compartment 299 for added security including inhibiting unauthorized removal or tampering with the electronic lock 201 or its components. The cam arm 217*z* is shown oriented toward the right (when viewing the storage compartment from the front of the storage structure) although other orientations may be configured so that the cam projects upwardly, to the left or in other orientations when adapted to other installations. Similarly, as described elsewhere herein, the knob assembly may be configured for clockwise or counterclockwise rotation between locked and unlocked positions.

In this aspect, the outer lock housing shell 202 is fitted with a printed circuit board (PCB) 203*b*, preferably secured within the interior of the outer wall of the lock housing shell 202. An electronic keyboard 315, configured in the printed circuit board (PCB) 203*b*, is provided in this embodiment to operate the internal motorized latching system, including electric motor 232, contained within the lock housing 203. The inside surface of the PCB 203*b* serves as a support for various components (not shown in the drawings of this embodiment but which are) previously described in association with other embodiments in which a circuit board supports such various components used to power and control the motorized latching assembly. The motor 232 is secured within mounting bracket 203*g* which in turn is positioned between back plate 204, PCB 203*b* and the lock housing shell 202.

The motorized latching assembly shown in FIGS. 25-1 and 25-2 is also shown in more detail in FIGS. 27-1, 27-2, 27-3, 28-1 and 28-2. In this preferred embodiment, the motor 232 drives a lead screw L via rotation of the gears arranged in a gear assembly 232*g* to move a locking pin P between a latched position in which the chamfered tip PC of the pin shaft PS is engaged between opposing side walls of pin port RP on rotor R. When the motor 232 moves the pin P to the unlatched position, the pin shaft PS is disengaged from rotor R, thus permitting an operator to turn knob 214 between a first position in which the lock 201 prevents opening of the drawer compartment 299 and a second position in which the lock permits the operator to open the drawer compartment 299. Although the knob 214 is shown having a generally circular configuration, alternative configurations of the knob are also included within the invention.

Figures 1, 27:
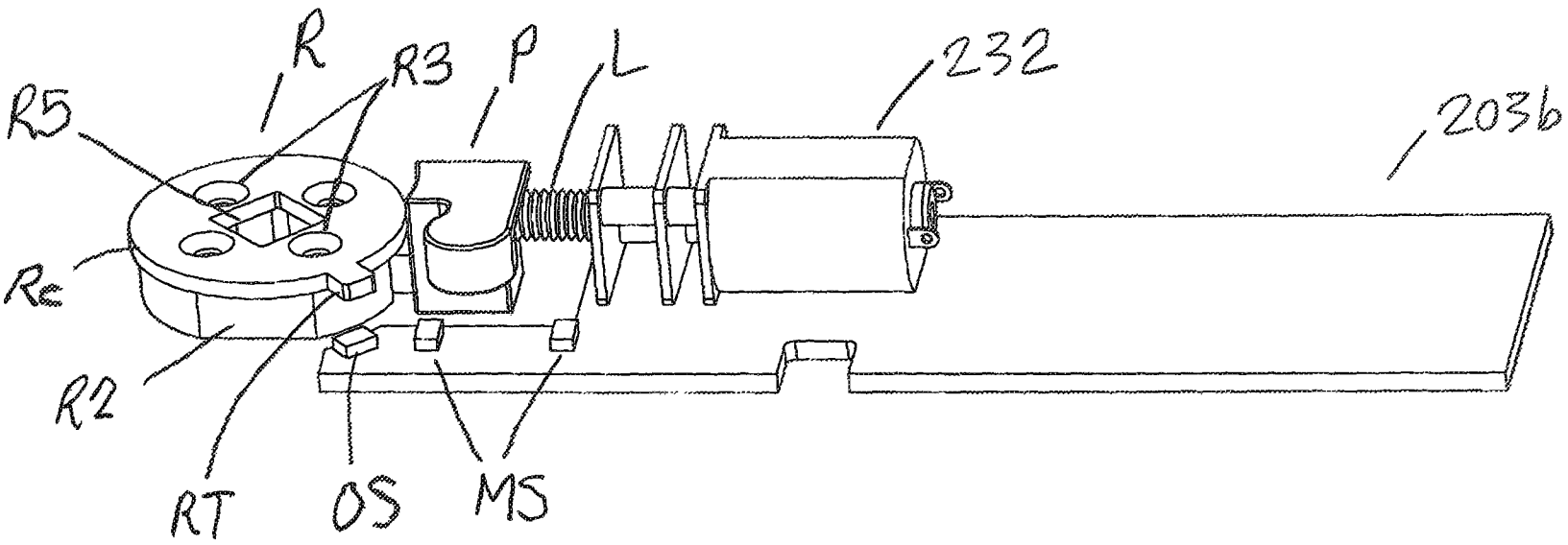
Figures 2, 27:
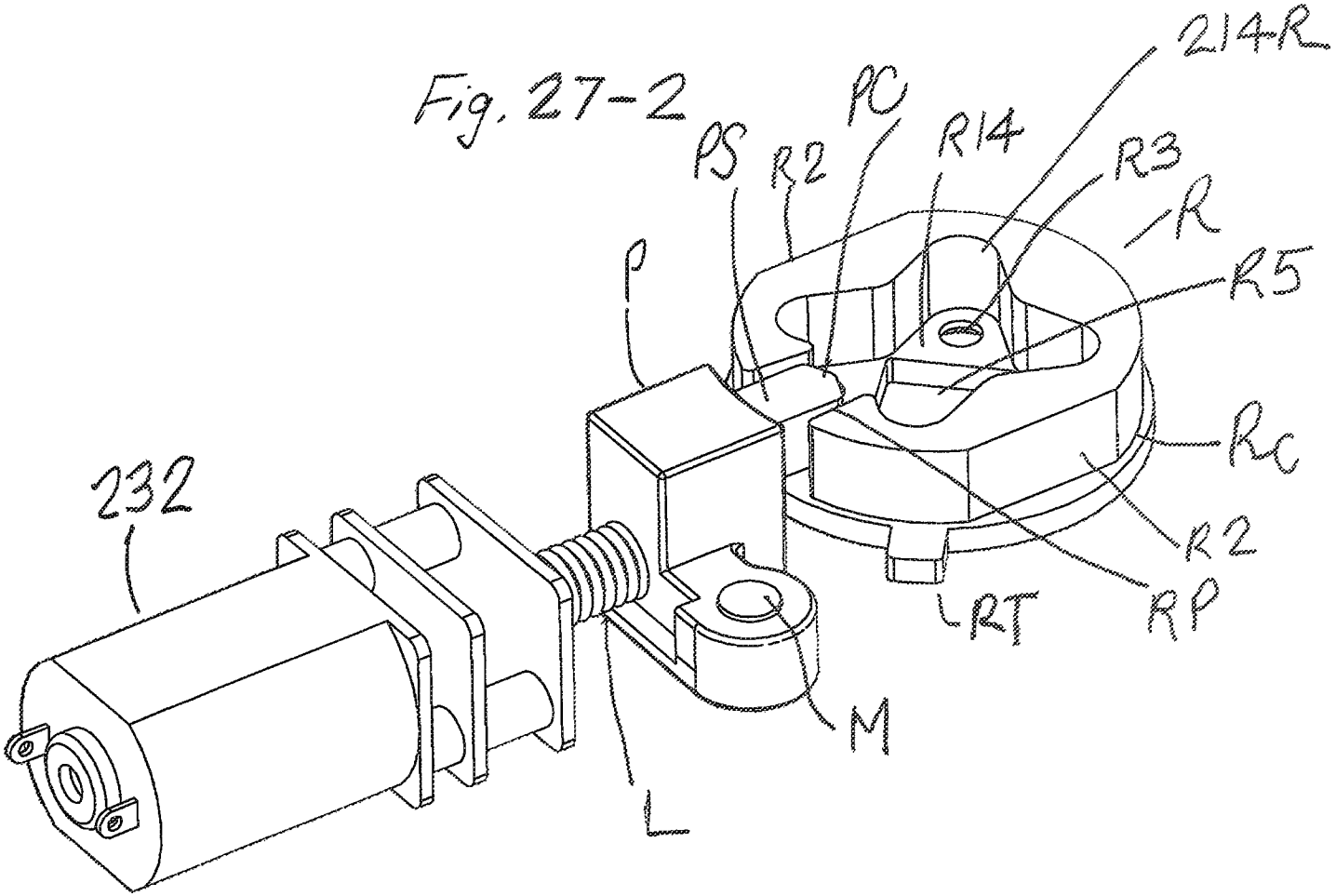
Figures 3, 27:
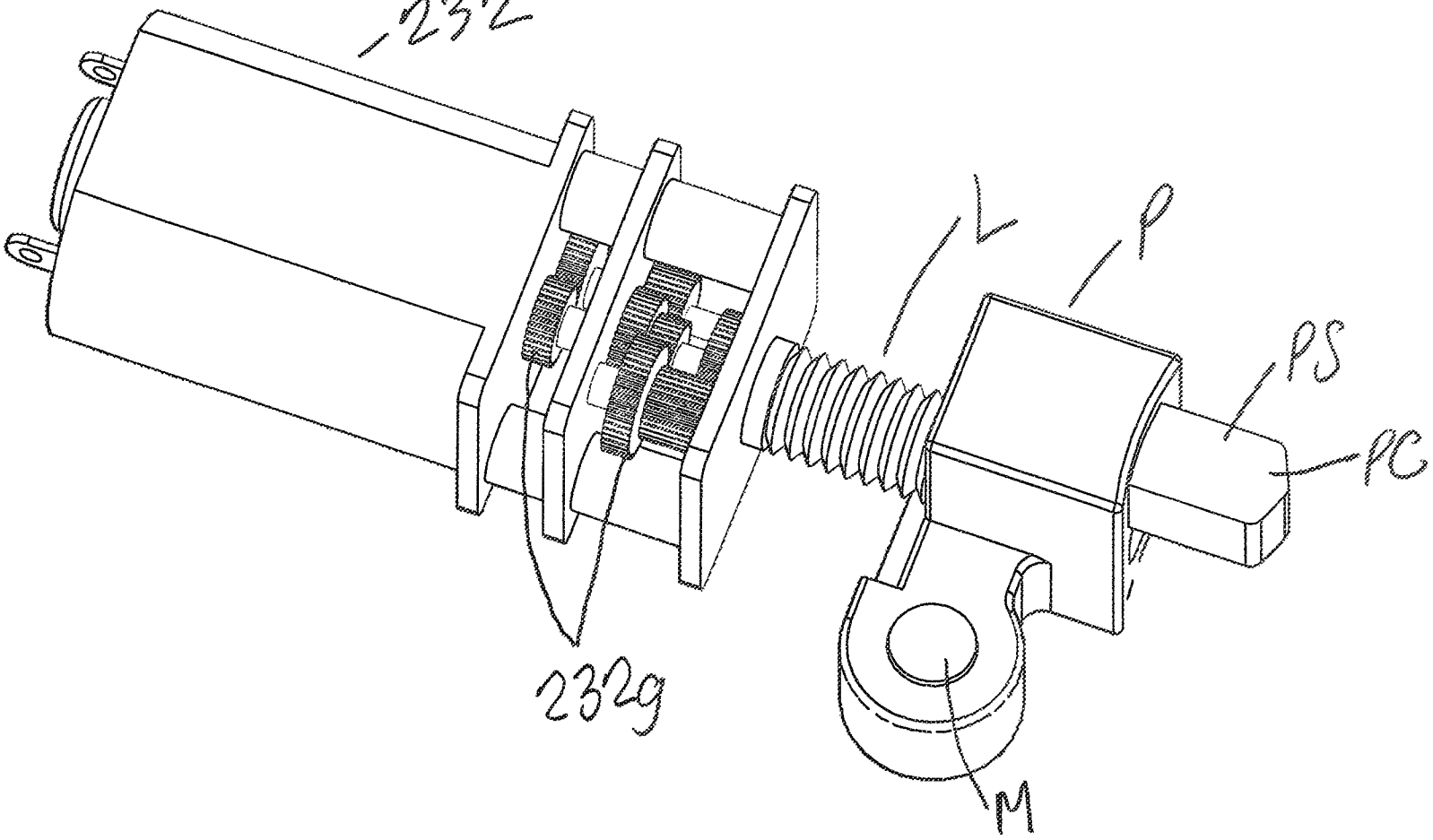

In this embodiment, the motorized latching assembly includes a sensor to detect, for example, a locking position of the electronic lock (which may be selected to be the 12 o'clock position), the position of the motorized latching assembly, for example, defined by the position of the locking pin P operating between the preferred locations for the first latched position and the second unlatched position, and other positions which may be indicated to an operator via a lock position indicator 214*z* on the knob 214 (FIG. 25-2), or another display feature or other communication device (not shown). In this example, FIG. 27-2 shows a magnet M mounted on an outwardly facing surface of a lobe portion of pin P. The latching assembly is configured so that the magnet M is positioned between a pair or magnetic sensors MS on the inside surface of the PCB 203*b* to define the assigned positioning limits of pin P, between the latched position in which pin shaft PS is engaged with the rotor R when the leadscrew is fully advanced, and the unlatched position when the leadscrew is retracted so that the pin shaft PS is fully withdrawn from the rotor R to allow rotation of the knob 214. The rotational position of the knob may be sensed by use of an optical sensor OS positioned opposite a reflective surface on the rotor R (for example a chrome plated surface) so that, when the rotor tab RT is positioned at a predetermined location adjacent the transmitting and receiving optical sensor OS, the optical sensor OS detects and transmits information to other control components on the PCB to indicate that the knob 214 is in a predetermined position, for example, at the 12 o'clock position corresponding to the locked position when an aimed beam of light is blocked by rotor tab RT. The optical sensor OS may also be used to detect and communicate other positions of the knob corresponding to other positions of the operationally associated drive assembly of the electronic lock.

Figures 1, 29:
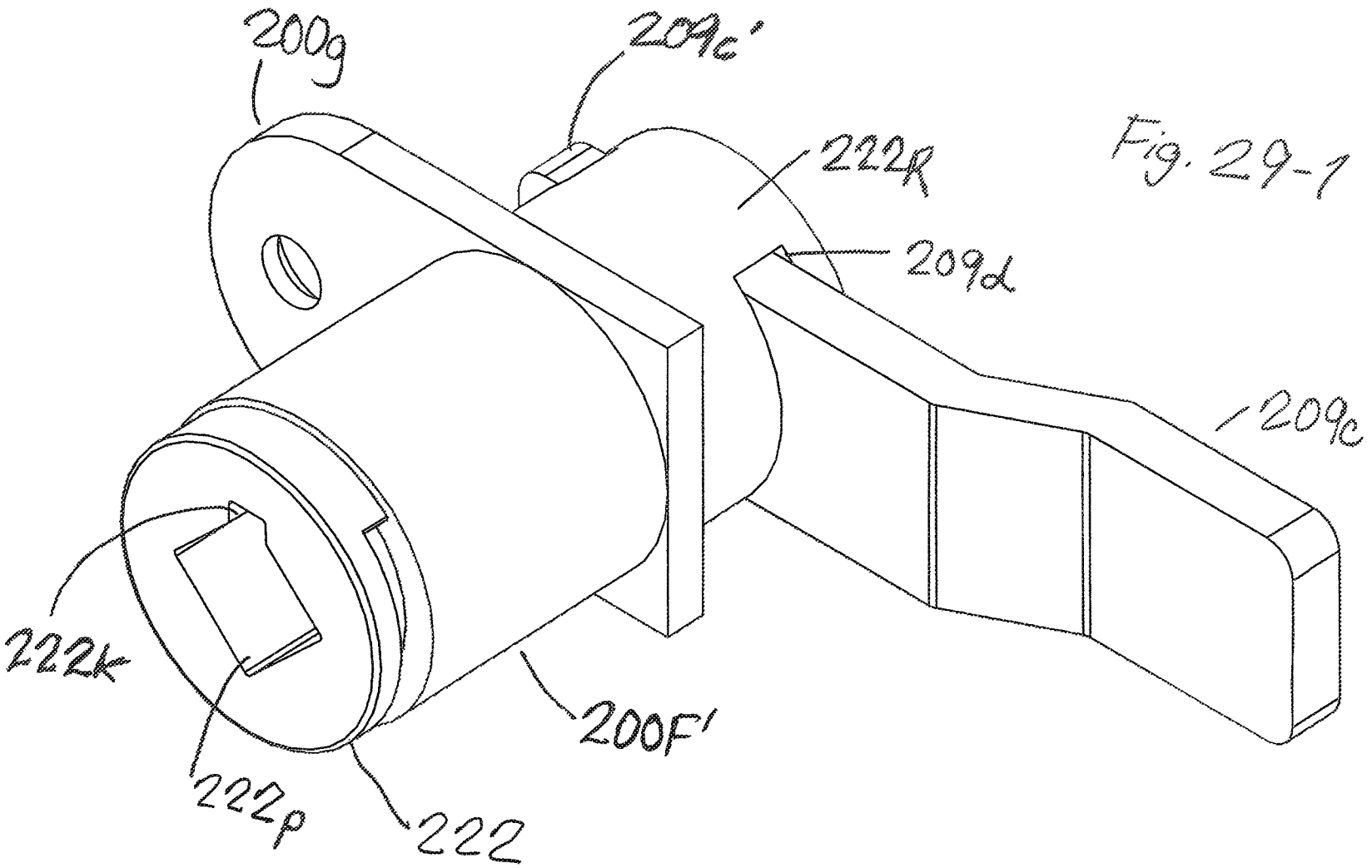
Figures 2, 29:
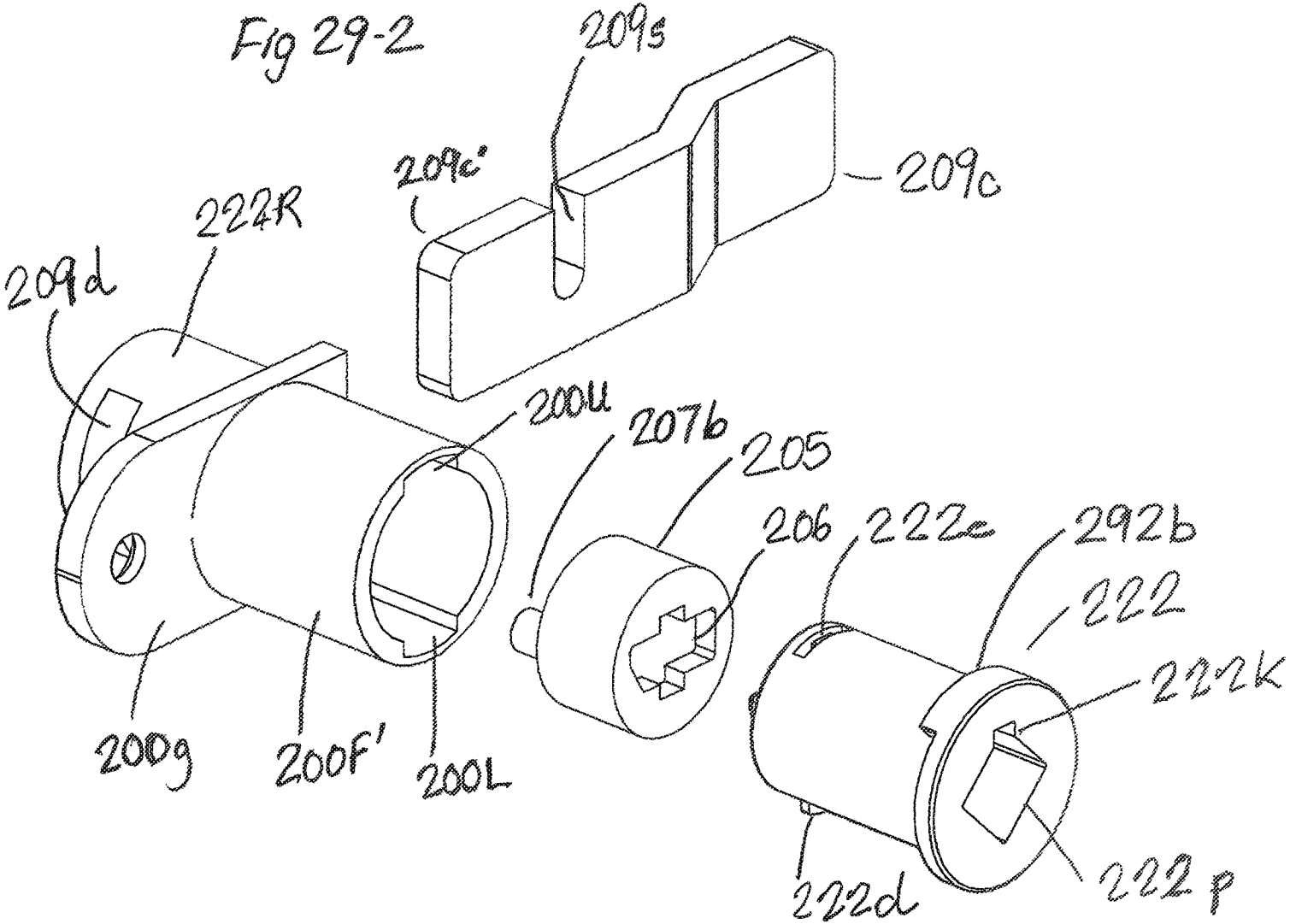

Preferably, the rotation of the knob 214 is controlled by:

- a head stop feature 292*b* on the plug adaptor 222 acting in cooperation with an abutment feature 292' when rotating within core shell 200F shown in FIG. 25-1, or
- a driver stop (not shown), or
- a slot 209*s* in a slider bolt 209*c* (as shown in FIG. 29-2) which limits the rotational range of driver pin 207*b*. Other rotational stop configurations are also possible. Such rotational stop configurations are not necessarily included in the electronic lock of the present invention, but may be found in pre existing components salvaged for use in a retrofit installation.

A pair of opposed channel abutments S defined by a collar 204*c* define a channel for advancing the pin shaft PS for latching engagement of the pin shaft PS with pin port RP on the rotor R. When the pin shaft PS is withdrawn from the pin port RP, the knob assembly is in the unlatched position, allowing the operator to rotate the knob 214 and associated drive assembly between the locked and unlocked positions. The rotational range of the knob 214 may be adjusted by suitably positioning the rotor relative to the selected position of the knob, and securing the rotor R to the knob 214 (using fasteners 214*f*), to correspond to the rotational range of a pre-existing locking system in a retrofit application involving a used storage structure. For example, in the illustrated embodiment, the configuration of fastener cavities R3 permits the knob to be oriented in up to four positions, for example, a 12 o'clock position, a 3 o'clock position, a 6 o'clock position, or a 9 o'clock position, if desired. The rotor R may be positioned and secured using two fasteners 214*f* relative to the knob 214 to adjust for rotational ranges such as 90 degrees, 180 degrees, or 270 degrees or other rotational range configurations. The configurations of the rotor R and knob 214 may also be adjusted for clockwise or counterclockwise rotational operation of the knob and associated drive assembly.

In this embodiment, the rotor R is also configured with a pair of opposed shoulders R2 which engage indexing spring 212 mounted on spring retainer 204*d* to define a detent position in which the operator may sense the desired orientation of the knob 214 before or after operational rotation or other movement of the knob 214. Preferably, the indexing spring 212 acts in cooperation with the opposed shoulders R2 to bias the operational positioning of the knob 214 into controlled alignment with the locking position. If desired, the configurations of the indexing spring and opposed shoulders may be adapted to bias operational positioning of the knob into alignment with a second position or other positions corresponding to one or more additional operational positions of the knob.

The knob 214 includes a circular knob base 214*b* which nests within a recessed track 204*e* facing outwardly from within a circular cavity 215 defined by outer housing shell 202. A circular flange CF projects inwardly from the perimeter of circular cavity 215. The circular flange 215 is positioned between recessed track 204*e* (which supports knob base 214*b* for selective rotational movement) and a second recessed track 204*e*', positioned inwardly of circular flange CF and recessed track 204*e*, so that the base of rotor R is supported within the second recessed track 204*e*' for selective rotation when the knob 214 is turned. The circular flange Rc extends along the circular perimeter of rotor R and up to rotor tab RT. When the lock 201 is assembled, the circular flange Rc rotates within a third recessed track 204*f* facing inwardly along the inside wall of collar 204*c*.

Figures 1, 28:
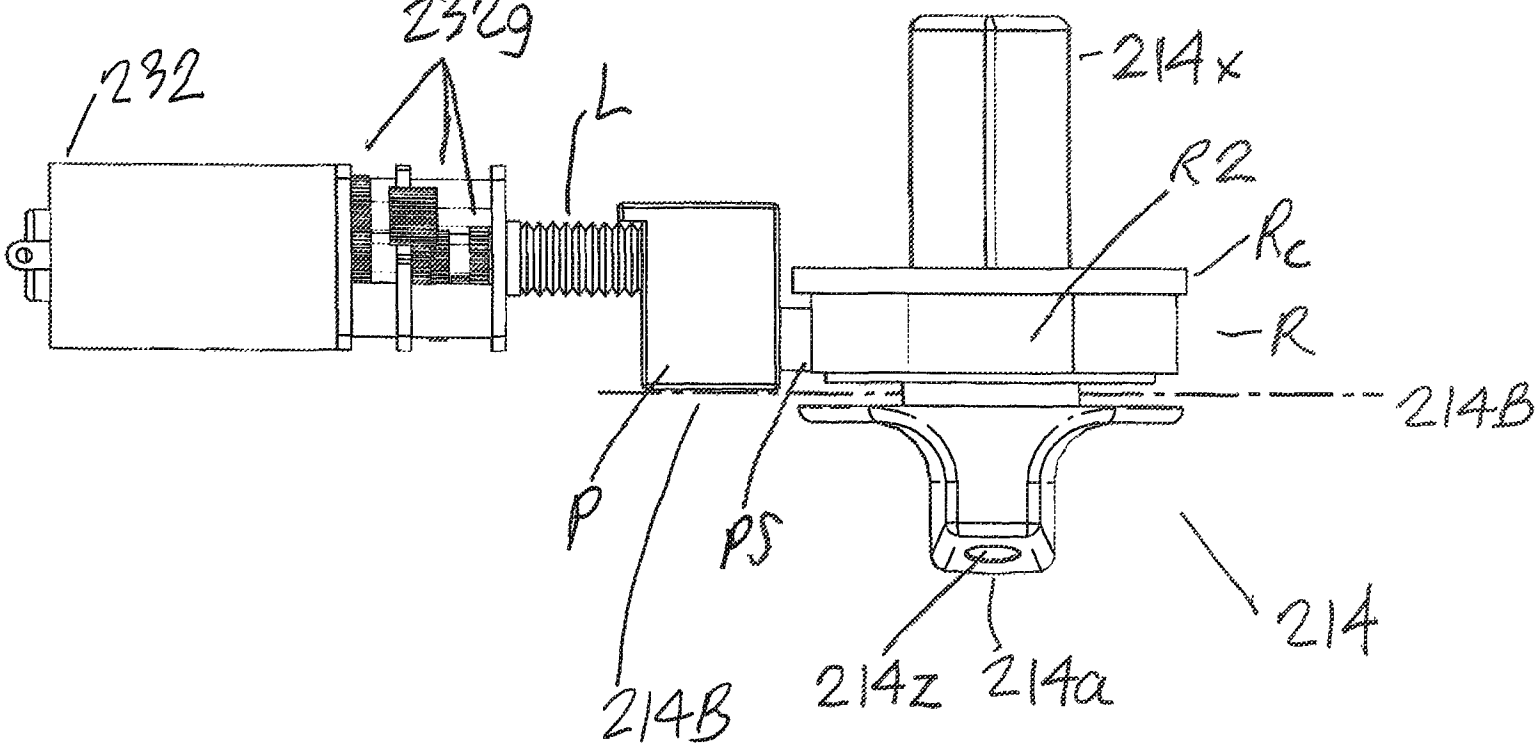
Figures 2, 28:
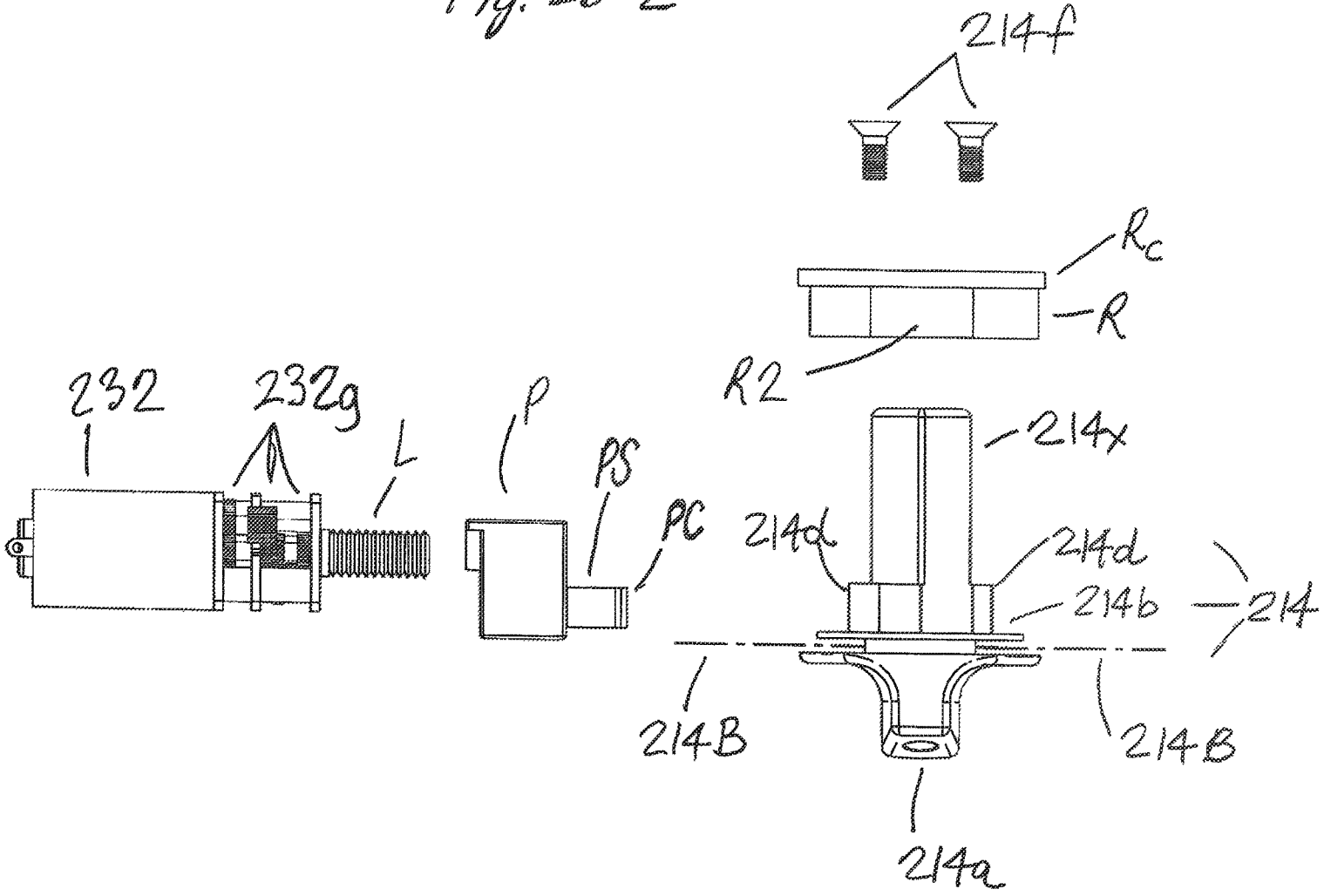

In FIGS. 28-1 and 28-2, an optional knob configuration is provided with a security feature to inhibit tampering with the operation and use of the electronic lock. Knob 214 includes a flared knob grip 214*a* and a narrow, weakened gap 214B between the flared base of knob grip 214*a* and the knob base 214*b* from which project two knob shoulders 214*d*, projecting from opposite sides of the knob shaft 214*x*. The knob shaft 214*x* is configured to fit snugly within a correspondingly configured knob port R5 provided in rotor R. The gap 214B may be further weakened by providing a cut, depression or other weakened band extending at a selected location along gap 214B to promote breakage along a break line along that weakened band. The rotor R (illustrated without rotor tab RT) is configured with recesses 214R each provided with a mounting flange RF. When assembled, the knob shoulders 214*d* fit snugly within recesses 214R of the rotor R, with the knob shoulders 214*d* abutting against a corresponding pair of mounting flanges RF. The rotor R is secured to the knob base 214*b* using a pair of knob fasteners 214*f* which extend through mounting cavities R3 in rotor R, and into engagement with threaded cavities 214*c* provided in knob shoulders 214*d*. If an unauthorized user attempts to breach the lock 201 by breaking away the knob grip 214*a* with a sufficient breaking force using, for example a hammer, screwdriver or locking pliers, the knob grip 214*a* is configured to break away leaving the remaining portion of the knob base 214*b* within circular cavity 215, and preferably below the outer surface of lock housing shell 202 so that an insufficient portion of the gap portion 214B remains exposed to further tampering, for example, malicious rotation with the use of locking pliers or similar tools. Similarly, a sufficiently thick portion of the knob base 214*b* remains in the first recessed track 204*e* to securely engage the circular flange CF. The remaining portion of the base 214*b* may be reinforced to inhibit further breakage or movement of the remaining portion across circular cavity 215.

In the embodiment shown in FIGS. 25-1 and 25-2, the knob shaft 214*x* is inserted into a corresponding cavity of a replacement core plug 222 (or replacement core adaptor) which functions as a rotatable spindle configured to rotate within a pre-existing core shell 200F. The core shell 200F may be provided in a Double D housing configuration, or in other configurations, in combination with various driver configurations, as previously described in this description. The core plug 222 may be provided with a retainer 222*d* (for example, a reinforced tumbler) operating within retainer slot 222*c*. When the retainer 222*d* is extended (as further described below) the core plug 222 is retained for selective rotational movement within the core shell 200F. The pre-existing core shell 200F may remain in a retrofit installation into a pre-existing storage structure (not shown). The core shell 200F may have been used as a housing (for example, a bushing) for a key operated rotatable lock core (not shown) of a pre-existing storage structure. Typically, the core shell 200F extends through an outer wall of the storage structure, such as for example, an outer wall of a storage compartment (which had been provided with dedicated keyed access). The core plug 222 is operationally connected to an adapter 205 having a portion rotating within the core shell 200F and configured so that the adapter 205 may serve as a coupling connected to a driver or as a coupling configured with a driver element. In the illustrated embodiment, the adapter 205 defines an adapter recess 206 to snugly couple with correspondingly configured opposing flanges 222*a* which project axially from the core plug 222. In this embodiment, the driver includes a driver arm 209 fastened to the driver base 207, the driver base 207 projecting from the adapter 205 along the rotational axis of the drive assembly. The driver arm 209 is secured to the adapter 205 by threaded engagement of the fastener 208 with a threaded cavity 207*a* defined by the driver base 207.

Figure 30:
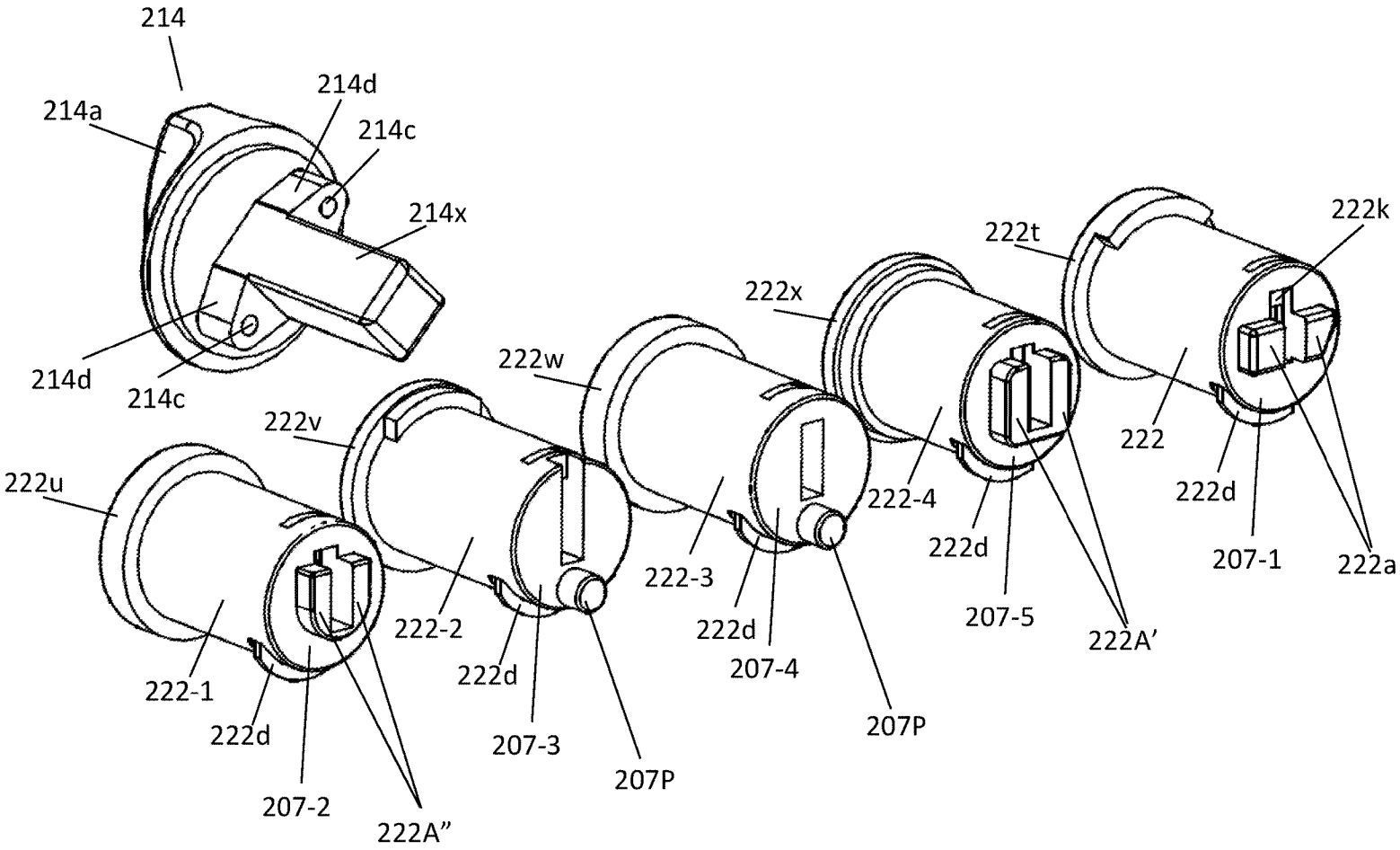
FIG. 30 is a rear view in perspective of the knob shown in FIG. 25-1 and five alternative plug including variants of the driver base, 207-1, 207-2, 207-3, 207-4, and 207-5.
Figures 1, 31:
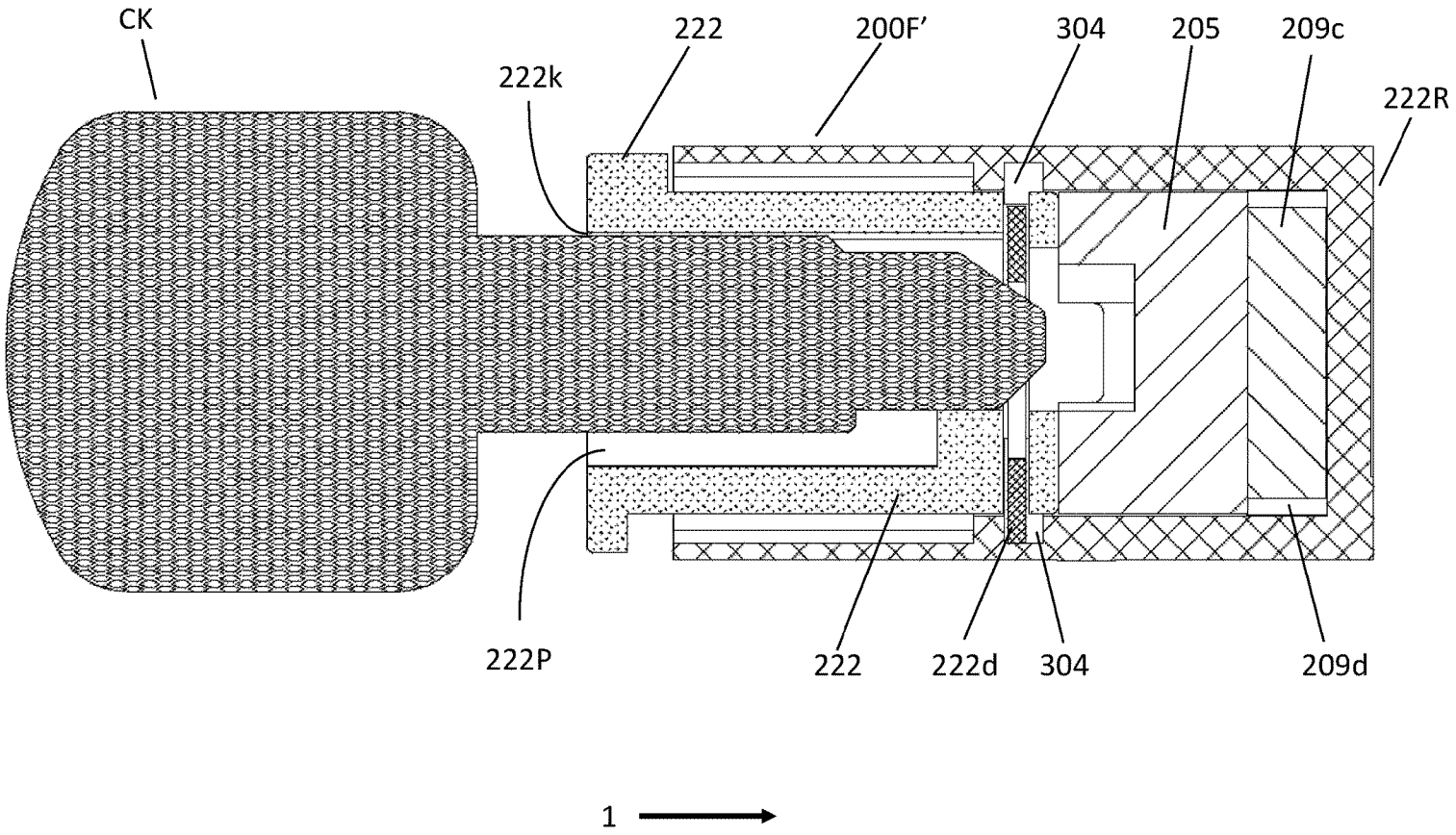
Figures 2, 31:
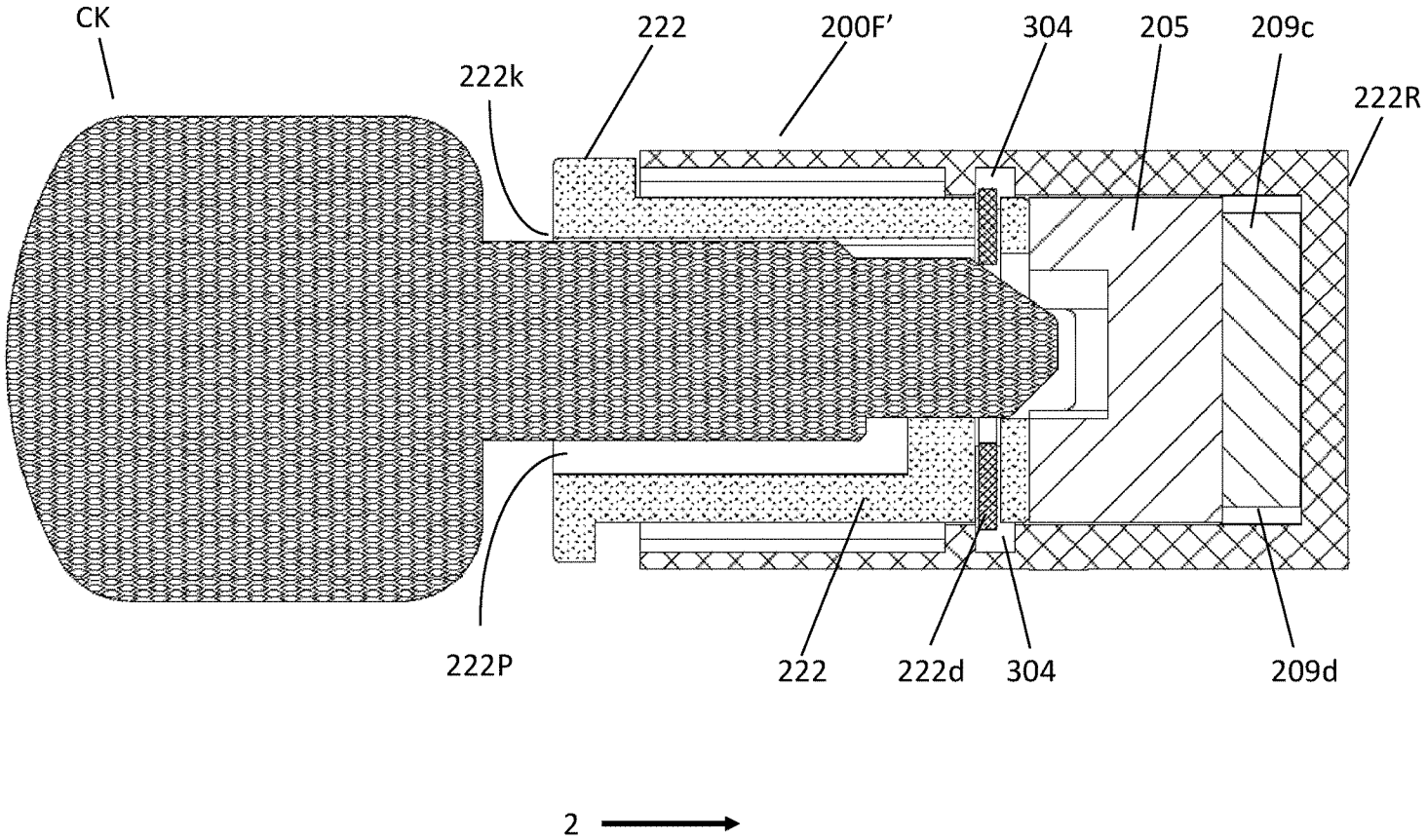
Figures 3, 31:
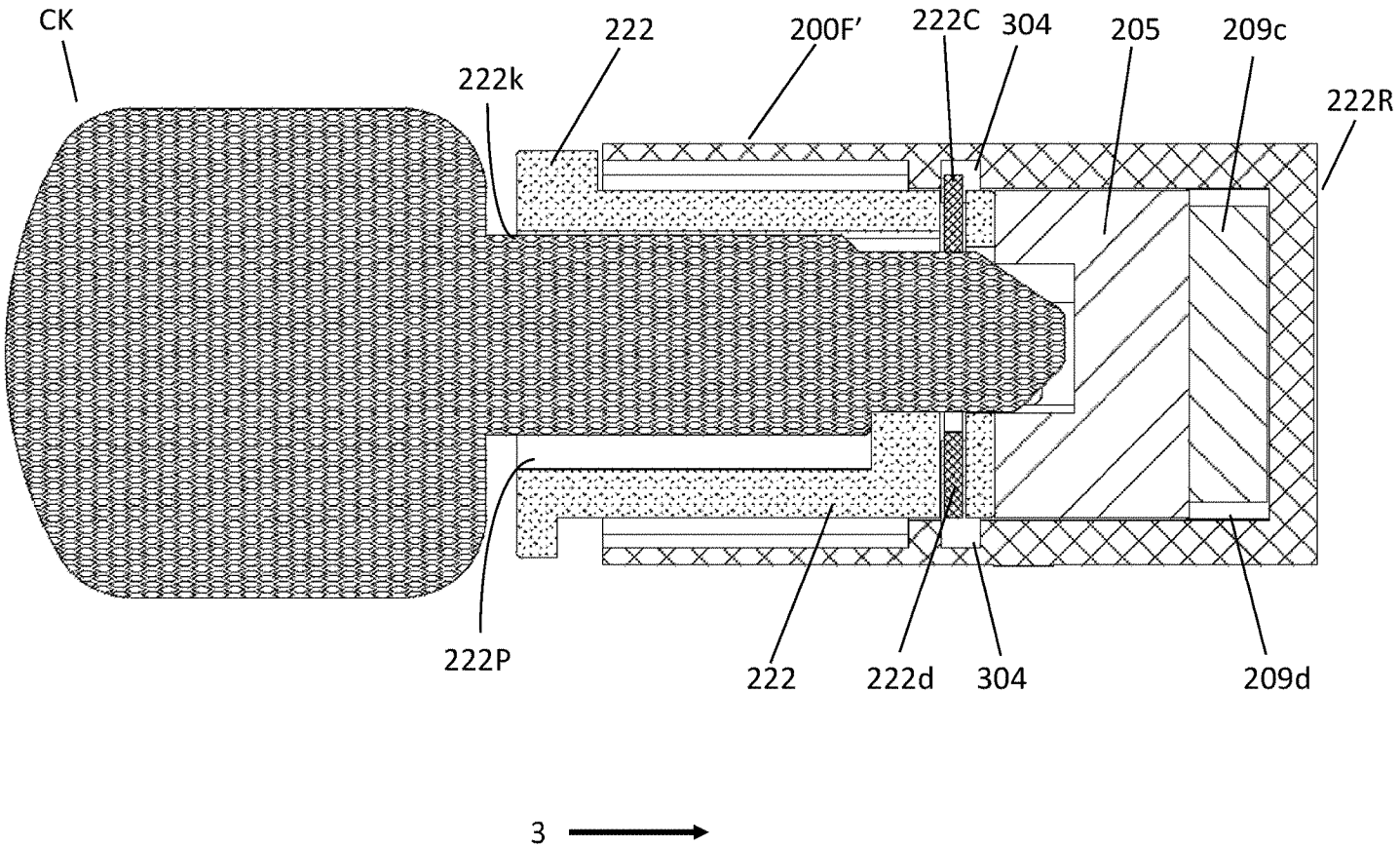

FIGS. 29-1 and 29-2 show an alternative core shell 200F' which may be found in pre-existing locking systems including key operated lock cores. The illustrated core shell 200F' is shown with lower channel 200L and upper channel 200U which were configured for use with a lock core having a retainer tumbler. In this illustrated aspect, the core shell 200F' is secured to an existing storage structure (not shown) using a fastener (not shown) engaged with mounting flange 200*g*. In this aspect, the driver includes a slider arm 209*c* which slides within slider slot 209*d* in shell base 222R. Replacement plug 222 is shown with a key slot 222*k* to receive a change key (for example, as shown in FIGS. 31-1 to 31-3) and connected knob port 222*p* configured to receive the knob shaft 214*x*. Plug 222 is shown with a head stop feature 292*b* acting in cooperation with abutments (not shown) within core shell 200F' to define the rotational range of the drive assembly associated with this embodiment. (Plugs 222 and 222-2 which include head stop features are also shown in FIG. 30.) Slider tab 209*c*' (which operates within slider slot 209*d*) is provided with a pin track 209*s*. In this aspect, the adapter 205 is configured with a driver pin 207*b* which slidably engages slider tab 209*c*' along pin track 209*s*. When the core plug 222 is rotated, the adapter pin 207*b* moves along an arcuate path to advance or retract the slider arm 209*c* in cooperation with an existing locking system in a storage structure.

FIGS. 31-1 to 31-3 are cross sectional views showing selected points in time when a change key CK (which may be used for installation or removal) is inserted into key slot 222*k* of a plug 222 connected to adapter 205 and in turn slider bolt 209*c* positioned within slot 209*d*. The alternative core shell 200F' and other illustrated components are shown in isolation from other components of the electronic lock. However, to illustrate the operation of the change key CK, FIG. 31-1 shows the tip of the key CK beginning to engage the central key port in retainer 222*d* along the path marked by Arrow 1. In this position, the retainer 222*d* is engaged with retainer channel 304, preventing withdrawal of the core plug from the alternative housing 200F'. As the key CK is advanced in the direction of Arrow 2 as shown in FIG. 31-2, the retainer 222*d* is partially lifted toward its removal position illustrated in FIG. 31-3. In FIG. 31-3, retainer 222*d* is fully lifted upwardly and disengaged from the track 304 in the direction of Arrow 3, allowing the retainer to move outwardly along an upper channel 200U defined by core shell 200F' so that the key may be used to extract the core plug and adapter from the core shell 200F'.

FIG. 30 illustrates a selection of alternative plug designs which may be used as drive features for interchangeable replacement of key operated lock cores and other pre-existing locks in storage structures which may be refitted for continued use with an electronic lock. Although FIG. 30 shows similarities in certain features, such as for example, a similar retainer 222*d* positioned in a similar located in each of the illustrated plugs, other configurations are possible with this invention. FIG. 30 shows the preferred example of the knob 214 compatible with a rotor R as previously described, the knob including a shaft 214*x* configured to fit within corresponding cavities (for example, knob port 222*p*) which may be defined by five selected examples of alternative plugs, 222, 222-1, 222-2, 222-3 and 222-4 suited for use with this invention. For example, the alternative plugs may be provided with predetermined configurations to replace key operated lock cores of different configurations, including different shapes, dimensions, lengths, etc.

In FIG. 30-1, plug 222 is provided with plug rim 222*t* to operate in cooperation with a corresponding core shell design (not shown). For example, the plug rim 222*t* may include a ridge or other feature to limit the range of rotation of the plug within that corresponding core shell design. At the opposite end of the plug 222, a pair of opposing flanges 222*a* project outwardly from the first driver base 207-1 configured to operationally engage an adapter with a correspondingly configured recess. By way of further example, plugs 222-1, 222-2, 222-3 and 222-4 are respectively shown with differently configured plug rims 222*u*, 222*v*, 222*w* and 222*x* intended for use with differently configured core shells. In addition, the opposite ends of the plugs 222-1, 222-2, 222-3 and 222-4 feature different corresponding driver base configurations 207-2, 207-3, 207-4 and 207-5.

Plugs 222, 222-1 and 222-4 are examples of two plug configurations in which the driver bases 207-1, 2017-2 and 207-4 are respectively configured with corresponding opposed pairs of outwardly projecting flanges 222*a*, 222A" and 222A', each pair of flanges positioned adjacent a slot which in these examples may receive the tip of a change key CK, to permit engagement of the key tip with corresponding adapters. Plugs 222-2 and 222-3 show examples of differently configured plugs with alternative driver base configurations in which single flanges are configured as pins 207P and 207P' for use in association with other drive assembly configurations.

Persons skilled in the art will appreciate that the foregoing descriptions were directed to specific embodiments of the invention. However, many other variations and modifications of the invention are also possible. Several preferred embodiments of the invention have been described with regard to the appended drawings. It will be apparent to those skilled in the art that additional embodiments are possible and that such embodiments will fall within the scope of the appended claims.

| PARTS LIST | |
|---|---|
| Prior Art FIG. 1 and FIG. 2 | |
| A | crank arm |
| B | irregularly shaped driver |
| C | retainer |
| E | locking core |
| F | lock housing unit |
| G | two drawer locking cabinet |
| Embodiments of the Invention FIG. 3 | |
| 78 | microcontroller |
| 1. | electronic lock |
| 3. | lock housing |
| 5 | "Double D" shaped housing insert |
| 7 | drive shaft |
| 9 | driver |
| 11 | manual knob assembly |
| 13 | bypass (override) key core |
| 15 | keypad |
| 17 | USB port and cover |
| FIG. 4-1 | |
| 20 | gear segment assembly |
| 21a | first cam segment |
| 21b | second cam segment |
| 22 | front drive gear assembly |
| 24 | rear drive gear assembly |
| 27a | torsion spring |
| 28 | slider |
| 29 | first slider cam |
| 30 | collar cam |
| 32 | motor |
| FIG. 4-2 | |
| 17 | USB port |
| 72 | real-time clock |
| 74 | clock battery |
| 76 | buzzer |
| 80 | micro SD storage |
| 84 | micro switch 2 |
| 86 | micro switch 3 |
| FIG. 4-3 | |
| 82 | micro switch 1 |
| 87 | LiPo charger and voltage regulator |
| 90 | keypad connector |
| FIG. 5 | |
| 3a | housing frame |
| 3b | housing front plate |
| 3c | collar |
| 3f | chassis |
| 3g | mounting bracket |
| 4 | interchangeable housing back plate |
| 4a | "Double D" shaped housing plug insert |
| 12 | index spring |
| 12a | window lens |
| 14 | knob grip |
| 14a | knob |
| 14b | knob barrel |
| 14c | knob barrel cap |
| 22 | front drive gear |
| 4e | inner cam surface |
| 14f | inner cam |
| 17 | USB port cover |
| 18 | USB gasket |
| 20a | front gear segment |
| 20b | rear gear segment |
| 20c | gear segment sleeve |
| 24a | rear drive gear segment |
| 27 | (second) torsion spring |
| 27a | torsion spring |
| 28a | second ramped surface on slider cam 29 |
| 28b | second slider cam |

-continued

| PARTS LIST | |
|---|---|
| 29 | first slider cam |
| 31 | indicator |
| 33 | battery |
| 40 | circuit board |
| 42 | keypad circuit |
| 44 | keypad membrane |
| 44a | gasket |
| 45 | indicator light array |
| | FIG. 6-1 |
| | electronic lock |
| | lock housing |
| | housing back plate |
| 4a | "Double D" shaped housing plug insert |
| 7 | drive shaft |
| 7a | shortened drive shaft |
| 9 | driver (illustrated as a cammed driver) |
| 9a | embodiment of an alternative driver base |
| | FIG. 8-1 |
| | See above |
| | FIG. 8-2 |
| CW | clockwise rotation |
| | FIG. 8-3 |
| | See above |
| | FIG. 8-4 |
| $CW_1$ | clockwise rotation |
| | FIG. 8-5 |
| $CW_2$ | clockwise rotation |
| | FIG. 9 |
| CCW | counter clockwise rotation |
| | FIGS. 10-1 to 10-3 |
| K | key |
| 3h | aperture |
| 3j | positioning rest |
| 13b | horseshoe shaped extension |
| 14g | irregular slot |
| 20d | channel |
| 20x | gear lobe |
| 24e | recess |
| 28x | slider lobe |
| 50 | dog |
| 52 | cam follower |
| 60 | modular chassis assembly |
| | FIGs 15-1, 15-2 |
| 24f | ramped surface |
| 31s | indicator tab (cam follower) |
| | FIG. 25-1 |
| 200F | core shell (e.g., Double D core housing) |
| 201 | electronic lock |
| 202 | outer lock housing shell (e.g., front case) |
| 202a | anchor |
| 203 | lock housing |
| 203b | printed circuit board (PCB) |
| 203g | motor mounting bracket |
| 204 | back plate |
| 204c | collar |
| 204d | spring retainer |
| 204e | recessed track |
| 204e' | second recessed track |
| 204f | third recessed track |
| 205 | alternative coupling (adapter with driver base) |
| 206 | adapter recess |

-continued

| PARTS LIST | |
|---|---|
| 207 | driver base |
| 208 | driver fastener (e.g., cam fastener) |
| 209 | driver arm (e.g., cam, tenon or other feature) |
| 212 | index spring (e.g., detent clip) |
| 214 | knob |
| 214b | knob base |
| 214d | knob shoulder |
| 214f | knob fastener |
| 214x | knob shaft |
| 214z | lock position indicator |
| 215 | chamfered cavity |
| 217a | mounting fastener |
| 217b | mounting fastener |
| 218 | lock housing assembly fasteners |
| 222 | core plug (spindle) |
| 232 | motor |
| 292b | head stop feature on plug 222 |
| 292' | head stop abutments in core shell 200F' |
| 315 | keypad (e.g., on PCB) |
| CF | circular flange |
| P | locking pin |
| R | rotor |
| Rc | circular flange |
| S | opposed abutments (e.g., a pin pathway) |
| | FIG. 25-2 |
| 200F | core shell |
| 202 | outer lock housing shell (e.g., front case) |
| 202a | anchor |
| 203b | PCB |
| 203g | mounting bracket for motor |
| 204c | collar |
| 204e | recessed track |
| 205 | alternative coupling (adapter e.g., with driver base) |
| 207 | driver base |
| 207a | threaded cavity |
| 208 | driver fastener (e.g., cam fastener) |
| 209 | driver arm (e.g., cam, tenon, or other feature) |
| 212 | index spring (e.g., detent clip) |
| 214 | knob |
| 214a | knob grip |
| 214b | knob base |
| 214c | threaded cavity |
| 214d | knob shoulder |
| 214f | knob fastener |
| 214x | knob shaft |
| 217a | mounting fastener |
| 217b | mounting fastener |
| 217g | mounting anchor |
| 218 | lock housing assembly fastener |
| 222 | core plug (spindle) |
| 222a | opposing flanges (e.g., driver base) |
| 222c | plug retainer slot |
| 222d | plug retainer (reinforced tumbler) |
| 232 | motor |
| P | locking pin |
| R | rotor |
| R2 | rotor shoulder |
| RT | rotor tab |
| S | opposed abutments (e.g., pin pathway) |

-continued

| PARTS LIST | |
|---|---|
| FIG. 26 | |
| 201 | electronic lock |
| 217a | mounting fastener |
| 217b | mounting fastener |
| 299 | drawer compartment |
| 299a | drawer face plate |
| 300 | example of a storage structure |
| FIG. 27-1 | |
| 203b | PCB |
| 232 | motor |
| L | lead screw |
| MS | magnetic sensor |
| OS | optical sensor |
| P | locking pin |
| R | rotor |
| R2 | rotor shoulder |
| R3 | mounting cavities (e.g., screw ports) |
| R5 | knob port |
| RT | rotor tab |
| FIG. 27-2 | |
| 214R | recess (e.g., configured for up to four screw positions/orientations of rotor relative to knob) |
| 232 | motor |
| L | lead screw |
| M | magnet |
| P | locking pin |
| PC | chamfered tip |
| PS | pin shaft |
| R | rotor |
| R2 | rotor shoulder |
| R3 | mounting cavities |
| R5 | knob port |
| R14 | mounting flanges |
| Rc | circular flange |
| RP | pin port |
| RT | rotor tab |
| FIG. 27-3 | |
| 232 | motor |
| 232g | gear assembly |
| L | lead screw |
| M | magnet |
| P | locking pin |
| PC | chamfered tip |
| PS | pin shaft |
| FIG. 28-1 | |
| 214 | knob |
| 214a | knob grip |
| 214B | break line |
| 214x | knob shaft |
| 214z | lock position indicator |
| 232 | motor |
| 232g | gear assembly |
| L | lead screw |
| P | locking pin |
| PS | pin shaft |
| R | rotor |
| R2 | rotor shoulder |
| Rc | circular flange |
| FIG. 28-2 | |
| 214 | knob |
| 214a | knob grip |
| 214b | knob base |
| 214B | break line |
| 214d | knob shoulder |
| 214f | knob fastener |
| 214x | knob shaft |
| 232 | motor |

-continued

| PARTS LIST | |
|---|---|
| 232g | gear assembly |
| L | lead screw |
| P | locking pin |
| PC | chamfered tip |
| PS | pin shaft |
| R | rotor |
| R2 | rotor shoulder |
| Rc | circular flange |
| FIG. 29-1 | |
| 200F' | alternative core shell (e.g., core housing) |
| 200g | mounting flange |
| 209c' | slider tab |
| 209d | slider slot |
| 222 | plug |
| 222k | key slot |
| 222p | knob port |
| 222R | shell base |
| FIG. 29-2 | |
| 200F' | alternative core shell |
| 200g | mounting flange |
| 200L | lower channel |
| 200U | upper channel |
| 205 | insert (e.g., coupling, or adapter with driver base) |
| 206 | recess |
| 207b | driver pin |
| 209c | slider bolt |
| 209c' | slider tab |
| 209d | slider slot |
| 209s | pin track |
| 222 | core plug (spindle) |
| 222c | plug retainer slot |
| 222d | plug retainer (reinforced tumbler) |
| 222k | key slot |
| 222p | knob port |
| 222R | shell base |
| 292b | head stop feature on core plug 222 |
| FIG. 30 | |
| 207-1 | first e.g., driver base |
| 207-2 | second e.g., driver base |
| 207-3 | third e.g., driver base |
| 207-4 | fourth e.g., driver base |
| 207-5 | fifth e.g., driver base |
| 207P | driver base flange |
| 207P' | alternative driver base flange |
| 214 | knob |
| 214a | knob grip |
| 214c | threaded cavity |
| 214d | knob shoulder |
| 214x | knob shaft |
| 222 | core plug (spindle) |
| 222-1 | alternative core plug (second example) |
| 222-2 | alternative core plug (third example) |
| 222-3 | alternative core plug (fourth example) |
| 222-4 | alternative core plug (fifth example) |
| 222a | driver base configuration with opposing flanges |
| 222A' | driver base configuration with alternative opposing flanges |
| 222A" | driver base with second alternative opposing flanges |
| 222d | plug retainer (reinforced tumbler) |
| 222k | key slot |
| 222f | plug rim |

-continued

| PARTS LIST | |
|---|---|
| 222u | plug rim |
| 222v | plug rim |
| 222x | plug rim |
| FIG. 31-1, FIG. 31-2, FIG. 31-3 | |
| 200F' | alternative core shell |
| 205 | coupling (adapter) |
| 209c | slider bolt |
| 209d | slot |
| 222 | plug |
| 222d | plug retainer |
| 222k | key slot |
| 222p | knob port |
| 222R | shell base |
| 304 | retainer track |
| CK | change key |

We claim:

1. An electronic lock for selectively locking and unlocking a storage structure comprising a selectively movable member having an exposed outside surface and an inside surface opposing the outside surface, the inside surface defining a portion of the storage structure, the lock comprising:

an electronic lock housing assembly defining a cavity, the electronic lock housing assembly positioned on an exposed outside surface of the selectively movable member;

an actuatable lock assembly associated with the electronic lock housing assembly, upon installation of the electronic lock in the storage structure, the actuatable lock assembly being rotatable relative to the electronic lock housing assembly in at least a closed orientation and an open orientation, the actuatable lock assembly further comprising:

a cylindrical housing extending through a bore in the selectively movable member, the cylindrical housing defining a central bore, and having an end wall with a latch opening extending therethrough;

a knob rotatably positionable relative to the electronic lock housing assembly and adjacent the cylindrical housing;

a coupling having a body positionable within the central bore with a second end extending through the latch opening, the coupling configured to be rotatable within the central bore about an axis defined by the second end extending through the latch opening, the coupling having a plug attachment portion positioned within the central bore; and a rotatable plug having a knob attachment portion and a coupling attachment portion, the knob attachment portion attachable to the knob, so as to rotate therewith, with the coupling attachment portion extending into the central bore and attachable to the plug attachment portion of the coupling, relative rotation of the rotatable plug relative to the coupling is substantially precluded when the rotatable plug is operatively attached to the plug attachment portion, the rotatable plug defining a spindle member having a keyway extending along the axis, a retaining member defining a keyway portion for selective engagement with an installation key, the retaining member operating across the keyway between an extended position for rotational movement relative to the axis and along a track defined by the cylindrical housing and a retracted position for movement of the spindle member along the central bore during insertion or extraction of the spindle member relative to the cylindrical housing; and a latching assembly positionable in one of a locked position and an unlocked position, the latching assembly being positioned within the cavity of the electronic lock housing assembly, the latching assembly further including a motor, such that the motor, upon actuation thereof, is configured to position the latching assembly in one of the locked position and the unlocked position, wherein positioning in the unlocked position allows direction of the actuatable lock assembly from a closed orientation to the open orientation, and wherein positioning in the locked position precludes direction of the actuatable lock assembly into the open orientation.

2. The electronic lock of claim 1, whereupon attachment of the plug attachment portion of the coupling and the coupling attachment portion of the rotatable plug, relative axial movement is substantially precluded between the coupling and the rotatable plug.

3. The electronic lock of claim 1, further comprising an electronic control assembly electrically coupled to the motor and positioned within the electronic lock housing assembly, the electronic control assembly configured to control the motor, and an input device positioned on a user accessible surface of the electronic lock housing assembly, the input device allowing a user to provide an authorizing signal to the electronic control assembly to direct the motor to initiate movement of the latching assembly between the locked position and unlocked position.

4. The electronic lock of claim 3, wherein the input device comprises a keypad.

5. The electronic lock of claim 1, wherein the knob is positionable on a surface of the electronic lock housing assembly, with the rotatable plug extending through an opening defined by the electronic lock housing assembly.

6. The electronic lock claimed in claim 1, wherein the cylindrical housing defining a bushing comprising the central bore, for rotation of the rotatable plug within the central bore during operational movement of the lock assembly between the closed orientation and the open orientation.

7. The electronic lock claimed in claim 1, wherein the coupling comprising a driver adapted for operative connection to an actuator adapted for operational connection between the latching assembly and the driver when a blocker within the latching assembly is in the unlocked position.

8. The electronic lock claimed in claim 1, wherein a latch flange is coupled adjacent the second end outside of the central bore.

9. The electronic lock claimed in claim 1, wherein the spindle member having a distal end defining the coupling attachment portion, the coupling attachment portion configured to provide offset parallel attachment flanges extending outwardly along the axis.

10. The electronic lock claimed in claim 1, wherein the coupling is defined by a driver comprising a latch flange coupled with the second end outside of the central bore.

11. The electronic lock claimed in claim 1, wherein the coupling attachment portion comprising offset parallel attachment flanges extending axially from the rotatable plug.

12. The electronic lock of claim 1, wherein a driver is coupled to the second end outside of the central bore.

13. The electronic lock of claim 1, wherein the latching assembly further comprises:

a latch movable relative to the electronic lock housing assembly, the latch having a proximal end and a distal end, the distal end configured to interface with the actuatable lock assembly wherein movement of the actuatable lock assembly between the closed orientation and the open orientation imparts movement of the latch relative to the electronic lock housing assembly;

a blocker slidably movable between a locked position and an unlocked position, wherein, in the locked position, the blocker precludes movement of the latch to thereby preclude the direction of the actuatable lock assembly from a closed orientation to an open orientation, and wherein, in the unlocked position, the blocker is moved relative to the latch so as to allow the latch to move relative to the blocker, to allow the actuatable lock assembly to move between the closed orientation and the open orientation, the blocker having a cam profile disposed thereon; and a cam rotatably mounted within the cavity of the electronic lock housing assembly, the cam having a first follower configured to coact with the cam profile of the blocker, to move the blocker to allow the latch to move between the locked position and the unlocked positions;

wherein the motor is coupled to the cam, and whereupon actuation of the motor causes rotation of the cam to permit movement of the latch between the locked position and unlocked position.

14. The electronic lock of claim 13, wherein upon actuation of the motor, from either the locked or the unlocked position, the cam rotates to impart a force upon the blocker to slidably move the blocker into the other of the locked position or unlocked position.

15. The electronic lock of claim 14, wherein the blocker comprises a slidable gear assembly.

16. The electronic lock of claim 13, wherein the blocker defines a slidable gear assembly moving between the locked position and the unlocked position upon rotation of the cam by the motor.

17. The electronic lock of claim 13, wherein the blocker further includes a second cam profile disposed thereon, the first and second cam profiles defining a longitudinal channel therebetween, the cam further includes a body and a second follower, the first follower extending from a first side of the body and a second follower extending from a second side of the body, wherein the cam follower interfaces with the cam profile and the second cam follower interfaces with the second cam profile.

18. The electronic lock of claim 12, wherein the blocker comprises a slidable gear assembly moving between the locked position and the unlocked position upon rotation of the cam by the motor.

19. An electronic lock attachable to a coupling with a first end positioned within a central bore of a bushing that is attachable to an outer surface of a storage structure, and a second end extending out of the bushing and having a locking flange, the electronic lock comprising:

an electronic lock housing assembly defining a cavity, the electronic lock housing assembly positionable on the outer surface of the storage structure;

an actuatable lock assembly associated with the electronic lock housing assembly, the actuatable lock assembly being rotatable relative to the electronic lock housing assembly in at least a closed orientation and an open orientation, the actuatable lock assembly further comprising:

a spindle member having a knob attachment portion and a coupling attachment portion, with a knob coupled to the knob attachment portion, the spindle member and the knob configured to rotate relative to the housing assembly, the coupling attachment portion extendable into a central bore and attachable to a coupling positioned therein, whereupon attachment of the spindle member and the coupling, relative rotation of the spindle member and the coupling is substantially precluded, the spindle member having a keyway extending along the axis, a retaining member defining a keyway portion for selective movement across the keyway between an extended position for rotational movement relative to the axis and along an interior track defined by the cylindrical housing and a retracted position for movement of the spindle member within the central bore during insertion or extraction of the spindle member relative to the cylindrical housing; and a latching assembly positionable in one of a locked position and an unlocked position, the latching assembly being positioned within the cavity of the electronic lock housing assembly, the latching assembly further including a motor, which upon actuation of the motor, is configured to position the latching assembly in one of the locked position and the unlocked position, wherein positioning in the unlocked position allows rotation of the knob, and, in turn, direction of the actuatable lock assembly from a closed orientation to the open orientation, and wherein positioning in the locked position precludes direction of the actuatable lock assembly into the open orientation.

20. The electronic lock of claim 19, the coupling attachment portion further includes a body and a coupling member latching portion, the body further including:

a retention coupling portion that defines a transverse slot having a base, a first upstanding wall and a second upstanding wall positioned in a spaced apart orientation extending from the base; and an internal cavity portion defining an opening adjacent the base spaced apart from the first upstanding wall and the second upstanding wall; and the coupling member latching portion slidably movable through the opening from within the internal cavity so as to be within the transverse slot, wherein, a portion of the coupling is retained adjacent the base and substantially precluded from rotation at least partially by the coupling member latching portion extending beyond the base.

21. The electronic lock of claim 19, wherein the coupling attachment portion includes a body and a coupling member latching portion, the body further including:

a retention coupling portion that defines a transverse slot having a base, a first upstanding wall and a second upstanding wall positioned in a spaced apart orientation extending from the base; and the coupling member latching portion further including an arm extending along the body, wherein the arm engages an opening defined by the coupling to substantially preclude relative rotation between the spindle member and the coupling.

22. An electronic lock attachable to a driver with a first end of the driver positioned within a central bore extending along a longitudinal axis of a cylindrical housing that is attachable to an outer surface of a storage structure, and a second end of the driver extending out of the cylindrical housing, the electronic lock comprising:

an electronic lock housing assembly defining a cavity, the electronic lock housing assembly positionable on the outer surface of the storage structure;

an actuatable lock assembly associated with the electronic lock housing assembly, the actuatable lock assembly being rotatable relative to the electronic lock housing assembly in at least a closed orientation and an open orientation, the actuatable lock assembly further comprising:

a spindle member having a knob attachment portion and a coupling attachment portion, with a knob coupled to the knob attachment portion, the spindle member and the knob configured to rotate relative to the electronic lock housing assembly, the coupling attachment portion extendable into the central bore and attachable to the driver positioned therein, whereupon attachment of the spindle member and the driver, relative rotation of the spindle member and the driver is substantially precluded, the spindle member having a keyway extending along the axis, a retaining member defining a keyway portion for selective movement across the keyway between an extended position for rotational movement relative to the axis and along an interior track defined by the cylindrical housing and a retracted position for movement of the spindle member within the central bore during insertion or extraction of the spindle member relative to the cylindrical housing; and a latching assembly positionable in one of a locked position and an unlocked position, the latching assembly being positioned within the cavity of the electronic lock housing assembly, the latching assembly further including a motor, where upon actuation of the motor, the motor is configured to position the latching assembly in one of the locked position and the unlocked position by motorized movement of a blocker between the locked position and the unlocked position, wherein positioning of the blocker in the unlocked position allows rotation of the knob, and, in turn, direction of the actuatable lock assembly from a closed orientation to the open orientation, and wherein positioning of the blocker in the locked position precludes direction of the actuatable lock assembly into the open orientation.

23. The electronic lock claimed in claim 22, wherein the cylindrical housing defines a bushing comprising the central bore, for rotation of the spindle member within the central bore during operational movement of the lock assembly between the closed orientation and the open orientation.

24. The electronic lock claimed in claim 22, wherein the driver is adapted for operative connection to an actuator adapted for operational connection between the latching assembly and the driver when the blocker is positioned in the unlocked position.

25. The electronic lock claimed in claim 22, wherein a latch flange is coupled adjacent the second end outside of the central bore.

26. The electronic lock claimed in claim 22, wherein the spindle member having a distal end defining the coupling attachment portion, the coupling attachment portion configured to provide offset parallel attachment flanges extending outwardly along the axis.

27. The electronic lock claimed in claim 22, wherein the driver comprises a latch flange coupled with the second end outside of the central bore.

28. The electronic lock claimed in claim 22, wherein the coupling attachment portion comprising offset parallel attachment flanges extending axially from the spindle member.

29. The electronic lock claimed in claim 22, wherein the keyway provides limited access to retainer for selective movement of the retainer between an extended position for annular retention of the retainer within the central bore and a retracted position for axial movement of the spindle member within the central bore.

30. The electronic lock claimed in claim 1, wherein the knob is configured with a security feature comprising a weakened zone between a base section of the knob and a locking rotor in the latching assembly, such that when a portion of the knob is broken away, a remaining portion of the knob base remains attached to the locking rotor, terminating adjacent to an outer face of the electronic lock housing assembly.

31. The electronic lock claimed in claim 19, wherein the knob defines a break zone at an outer face of the electronic lock housing assembly configured to break away a portion of the knob so that a remaining portion of the knob remains attached to the latching assembly, the remaining portion terminating at the outer face.

32. The electronic lock claimed in claim 22, wherein the knob is configured to break adjacent and inward of an outer face of the electronic lock housing assembly and leaving a portion of the knob base inward of the outer face and attached to the locking rotor to inhibit unauthorized operation of the latching assembly between the locked position and the unlocked position.

33. An electronic lock attachable to a driver with a first end of the driver positioned within a central bore extending along a longitudinal axis of a cylindrical housing that is attachable to an outer surface of a storage structure, and a second end of the driver extending out of the cylindrical housing, the electronic lock comprising:

an electronic lock housing assembly defining a cavity, the electronic lock housing assembly positionable on the outer surface of the storage structure;

an actuatable lock assembly associated with the electronic lock housing assembly, the actuatable lock assembly being rotatable relative to the electronic lock housing assembly in at least a closed orientation and an open orientation, the actuatable lock assembly further comprising:

a spindle member having a knob attachment portion and a coupling attachment portion, with a knob coupled to the knob attachment portion, the spindle member and the knob configured to rotate relative to the electronic lock housing assembly, the spindle member has a keyway extending along the axis, the keyway providing limited access to a retainer adapted for selective movement of the retainer between an extended position for retention of the retainer within an annular track within the central bore and a retracted position for axial movement of the spindle member within the central bore, the coupling attachment portion extendable into the central bore and attachable to the driver positioned therein, whereupon attachment of the spindle member and the driver, relative rotation of the spindle member and the driver is substantially precluded;

the coupling attachment portion comprising offset parallel attachment flanges extending axially from the spindle member; and a latching assembly positionable in one of a locked position and an unlocked position, the latching assembly being positioned within the cavity of the electronic lock housing assembly, the latching assembly further including a motor, where upon actuation of the motor, the motor is configured to position the latching assembly in one of the locked position and the unlocked position by motorized movement of a blocker between the locked position and the unlocked position, wherein positioning of the blocker in the unlocked position allows rotation of the knob, and, in turn, direction of the actuatable lock assembly from a closed orientation to the open orientation, and wherein positioning of the blocker in the locked position precludes direction of the actuatable lock assembly into the open orientation.

34. The electronic lock claimed in claim 33, wherein the cylindrical housing defines a bushing comprising the central bore, for rotation of the spindle member within the central bore during operational movement of the lock assembly between the closed orientation and the open orientation.

35. The electronic lock claimed in claim 34 comprising a driver, wherein the driver is adapted for operative connection to an actuator for operational connection between the latching assembly and the driver when the blocker is positioned in the unlocked position.

36. The electronic lock claimed in claim 35, wherein the knob is configured with a weakened zone between a base section of the knob and a locking rotor in the latching assembly, such that when a proximate portion of the knob is broken away, a portion of the knob base remains attached to the locking rotor, the portion of the knob base terminating inwardly of an outer face of the electronic lock housing assembly.

37. The electronic lock claimed in claim 36, wherein the offset parallel attachment flanges removably attach the spindle member to the driver.

* * * * *